US009543706B2

(12) United States Patent
Zhang

(10) Patent No.: US 9,543,706 B2
(45) Date of Patent: Jan. 10, 2017

(54) ELECTRICAL CONNECTOR WITH POWER TERMINALS

(75) Inventor: Xuehai Zhang, Xuzhou (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/237,305

(22) PCT Filed: Aug. 3, 2012

(86) PCT No.: PCT/CN2012/001042

§ 371 (c)(1),
(2), (4) Date: Dec. 18, 2014

(87) PCT Pub. No.: WO2013/020359

PCT Pub. Date: Feb. 14, 2013

(65) Prior Publication Data

US 2015/0056839 A1 Feb. 26, 2015

(30) Foreign Application Priority Data

Aug. 5, 2011 (CN) ..... 2011 2 0291630 U
Aug. 2, 2012 (CN) ..... 2012 2 0378234 U
(Continued)

(51) Int. Cl.
*H01R 13/6581* (2011.01)
*H01R 12/72* (2011.01)
(Continued)

(52) U.S. Cl.
CPC ..... *H01R 13/6581* (2013.01); *H01R 12/724* (2013.01); *H01R 13/506* (2013.01); *H01R 13/6271* (2013.01)

(58) Field of Classification Search
CPC ..... H01R 13/6581; H01R 13/506; H01R 13/6271
(Continued)

(56) References Cited

U.S. PATENT DOCUMENTS 6,935,870 B2 8/2005 Kato et al.
7,442,056 B1 * 10/2008 Ju ..... H01R 12/716 439/540.1
(Continued)

FOREIGN PATENT DOCUMENTS

CN 201230098 Y 4/2009
CN 201387960 Y * 1/2010
(Continued)

OTHER PUBLICATIONS

International Search Report for PCT/CN2012/001042.

*Primary Examiner* — Abdullah Riyami
*Assistant Examiner* — Justin Kratt
(74) *Attorney, Agent, or Firm* — James A. O'Malley

(57) ABSTRACT

An electrical connector assembly comprises a receptacle electrical connector and a plug electrical connector. The receptacle electrical connector includes a first body having a first and a second tongues and a plurality of first terminals, the first terminals located on opposite surfaces of the first tongue and offset relative to each other. The plug electrical connector includes a second body and a third and fourth mating chambers located in the second body; a plurality of third terminals, wherein the third terminals located on upper and lower sides of the third mating chamber are offset relative to each other. The receptacle electrical connector and the plug electrical connector can mate with each other so the first terminals and the third terminals are mated with each other to transmit signals and the second tongue and the fourth mating chamber are connected to transmit power.

11 Claims, 61 Drawing Sheets

(30) Foreign Application Priority Data

| | | |
|---|---|---|
| Aug. 2, 2012 | (CN) | 2012 2 0378258 U |
| Aug. 2, 2012 | (CN) | 2012 2 0378276 U |
| Aug. 2, 2012 | (CN) | 2012 2 0378302 U |
| Aug. 2, 2012 | (CN) | 2012 2 0378325 U |
| Aug. 2, 2012 | (CN) | 2012 2 0378383 U |

(51) Int. Cl.
*H01R 13/506* (2006.01)
*H01R 13/627* (2006.01)

(58) Field of Classification Search
USPC ..... 439/607.24, 653, 607.01, 924.1, 924.2,439/60
See application file for complete search history.

(56) References Cited

U.S. PATENT DOCUMENTS

| | | | | |
|---|---|---|---|---|
| 7,467,977 | B1 | 12/2008 | Yi et al. | |
| 2009/0318026 | A1* | 12/2009 | Yi | H01R 13/6658 439/607.24 |
| 2011/0021088 | A1 | 1/2011 | Chen et al. | |
| 2011/0097933 | A1 | 4/2011 | Sommers et al. | |
| 2012/0225583 | A1 | 9/2012 | Kamarauskas et al. | |

FOREIGN PATENT DOCUMENTS

| | | |
|---|---|---|
| CN | 202145500 U | 2/2012 |
| JP | 05-026945 | 2/1993 |
| JP | 07-201424 | 8/1995 |
| JP | 10-106668 | 4/1998 |
| JP | 2009-043713 | 2/2009 |
| JP | 2009-043723 | 2/2009 |
| JP | 3150862 U | 6/2009 |

* cited by examiner

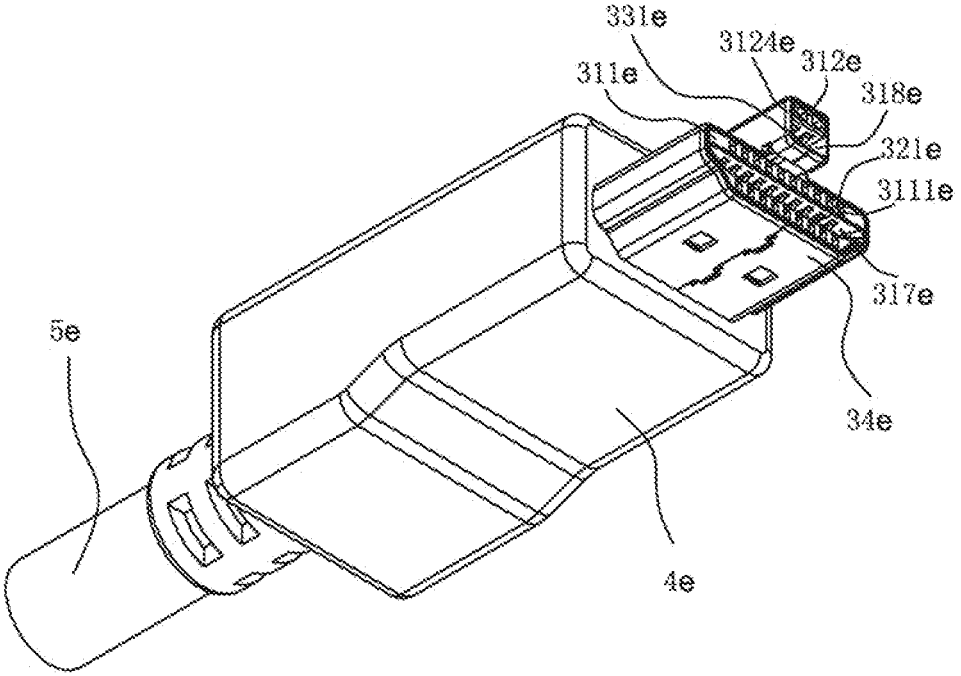
Fig.54
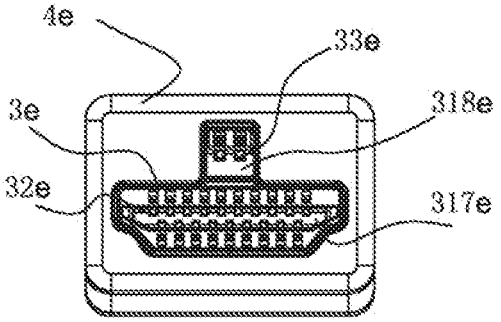

ELECTRICAL CONNECTOR WITH POWER TERMINALS

RELATED APPLICATIONS

This application is a national phase of PCT Application No. PCT/CN2012/001042, filed Aug. 3, 2012, which in turn claims priority to the following applications: Chinese Application No. 201120291630.0, filed Aug. 5, 2011; Chinese Application No. 201220378234.6, filed Aug. 2, 2012; Chinese Application No. 201220378258.1, filed Aug. 2, 2012; Chinese Application No. 201220378276.X, filed Aug. 2, 2012; Chinese Application No. 201220378302.9, filed Aug. 2, 2012; Chinese Application No. 201220378325.X, filed Aug. 2, 2012; and Chinese Application No. 201220378383.2, filed Aug. 2, 2012, all of which are incorporated herein by reference in their entirety.

FIELD OF THE INVENTION

The present invention relates to an electrical connector, and more particularly, to a receptacle electrical connector, a plug electrical connector and an electrical connector assembly having an improved structure for transmitting signals and power.

BACKGROUND OF THE INVENTION

Conventional electrical connector assembly comprises a receptacle electrical connector and a corresponding plug electrical connector, through which a signal cable connector can be combined with a power cable connector, such that an electrical connection for transmitting both video signal and power between a video source device (such as computer, DVD, Video Game) and a display device (such as a display, TV, projector) can be achieved through one cable.

Chinese Patent ZL 200920002141.1 discloses a plug electrical connector, a receptacle electrical connector and an electrical connector assembly. The plug electrical connector comprises a first insulated housing having a first main body and a first protrusion extending upward from an upper surface of the first main body, the first main body having an upper tongue and a lower tongue which are provided with a plurality of first terminal slots, the first protrusion being provided with two second terminal slots; a plurality of first terminals, each of which is provided in the first terminal slot respectively, and has a guiding portion protruding out of a rear wall of the first main body; two second terminals, each of which is provided in the second terminal slot respectively, and has an inserting portion protruding out of a front wall of the first protrusion and a guiding portion protruding out of a rear wall of the first protrusion; and a first metal element enclosing the first insulated housing and having a first mating opening at a side adjacent to the inserting portions of the two second terminals. The receptacle electrical connector comprises a second insulated housing having a second main body, a second protrusion extending upward from an upper surface of the second main body, a third tongue extending forward from the second main body, an extension portion extending forward from the second protrusion and spaced from the third tongue, a plurality of third terminal slots being provided in an upper and a lower side of the third tongue respectively and two fourth terminal slots running through the second protrusion and the extension portion; a plurality of third terminals, each of which is provided in the third terminal slot, and has a contacting portion in a side of the third tongue; two fourth terminals, each of which is provided in the fourth terminal slots respectively, and has a contacting portion; and a second metal element enclosing the second insulated housing and having a second mating opening at a side adjacent to the third tongue. The electrical connector assembly comprises the above receptacle electrical connector and the above plug electrical connector, the receptacle electrical connector can be mated with the plug electrical connector via the first and second mating openings, the first terminals and the third terminals are electrically connected with each other, the two second terminals and the two fourth terminals are electrically connected with each other, such that both the video signals and the power are transmitted simultaneously. Thereby, cables can be handled easily and a space can be saved.

However, the inserting portion of the second terminals for transmitting the power in the conventional plug electrical connector is exposed and extending straightforward without any protection. So, the inserting portion of the second terminals in the plug electrical connector is easily failed due to the bending caused by the extension portion of the receptacle electrical connector when mis-plugging, during mating with the conventional receptacle electrical connector. Thus, the reliability of electrically connection between the video source device and the display device is lowered. In addition, the fourth terminals in the receptacle electrical connector mated with the second terminals of the plug electrical connector are two contacting portions formed by fixing arms having an invert U shape and extending opposite. Thus, the structures of contacting portions of the fourth terminals are too complex to manufactured, and occupy a relative larger space and fail to have a compact design. Furthermore, the contacting portions of the third terminals on the upper and lower sides of the third tongue in the conventional receptacle connector are aligned up and down relative to each other, such that the two contacting portions in the upper and lower side are arranged face to face. Therefore, the arranging manner of the above contacting portions tends to produce signal noise and is not propitious to improve the transmitting quality of signals.

Therefore, it is necessary to further improve the conventional electrical connector so as to satisfy the requirements of the current products.

SUMMARY OF THE INVENTION

There is provided a receptacle electrical connector with a first body, comprising a first main body portion, a first tongue and a second tongue being parallel with each other and extending forward from the first main body portion, wherein the first tongue has a width greater than that of the second tongue, a plurality of first receiving slots are provided on opposite first and second surfaces of the first tongue, at least two second receiving slots are provided on a surface of the second tongue and a plurality of first terminals for transmitting signal, provided in the first receiving slots respectively, each first terminals being provided with a mating portion in a plate shape and a soldering portion, and the mating portions of the first terminals located on a first surface are offset relative to those on a second surface of the first tongue; at least two second terminals for transmitting power, provided in the at least two second receiving slots respectively, each second terminals being provided with a mating portion in a plate shape and a soldering portion; and a first cage mounted on the first body; wherein a first mating chamber, which is formed around and enclosing the first tongue, has a width larger than that of a second mating chamber which is formed around and enclosing the second tongue, a receiving chamber is formed by stacking the first and second mating chambers communicated with each other.

In an embodiment, a plug electrical connector includes a second body having a second main body portion and a second protrusion protruding upward from a top surface of the second main body portion, middle of the second main body portion is provided with a third mating chamber, a plurality of third receiving slots are provided on upper and lower sides of third mating chamber, two fourth receiving slots are provided on the second protrusion and a plurality of third terminals are provided in the plurality of third receiving slots respectively, each of the third terminals comprises a mating portion being an elastic protrusion and a soldering portion, and the mating portions of the third terminals located on the upper side of the third mating chamber are offset relative to those located on the lower side of the third mating chamber and two fourth terminals for transmitting power are provided in the two fourth receiving slots respectively, each of the fourth terminals comprises a mating portion being an elastic protrusion and a soldering portion; and a second cageenclosing a periphery of the second body, a fourth mating chamber is formed by the second cage enclosing the second protrusion, the mating portion of the fourth terminals protrudes from the fourth receiving slots towards the fourth mating chamber.

Another embodiment provides an electrical connector assembly with a receptacle electrical connector, comprising a first body, comprising a first main body portion, a first tongue and a second tongue being parallel with each other and extending forward from the first main body portion, wherein the first tongue has a width greater than that of the second tongue, a plurality of first receiving slots are provided on opposite first and second surfaces of the first tongue, at least two second receiving slots are provided on a surface of the second tongue and a plurality of first terminals for transmitting signal provided in the first receiving slots respectively, each first terminals being provided with a mating portion in a plate shape and a soldering portion, and the mating portions of the first terminals located on a first surface are offset relative to those on a second surface of the first tongue and at least two second terminals for transmitting power are provided in the second receiving slots respectively, each second terminals being provided with a mating portion in a plate shape and a soldering portion; and a first cage mounted on the first body that defines a first mating chamber which is formed around and enclosing the first tongue, has a width larger than that of a second mating chamber which is formed around and enclosing the second tongue, a receiving chamber is formed by stacking the first and second mating chambers communicated with each other; and The electrical connector assembly includes a plug electrical connector that can include a second body having a second main body portion, middle of the second main body portion is provided with a third mating chamber, and a plurality of third receiving slots are provided on upper and lower sides of the third mating chamber are provided with a plurality of third terminals provided in the plurality of third receiving slots respectively, each of the third terminals comprises a mating portion being an elastic protrusion and a soldering portion, and the mating portions of the third terminals located on the upper side of the third mating chamber are offset relative to those located on the lower side of the third mating chamber and a second cage enclosing a periphery of the second body and the first tongue of the receptacle electrical connector is mated with the third mating chamber of the plug electrical connector, so that the plurality of first terminals are electrically connected with the plurality of third terminals to transmit video signals.

BRIEF DESCRIPTION OF THE DRAWINGS

FIG. 54 is a perspective view of a second cable connector shown in FIG. 53;

FIG. 55 is a front view of a second cable connector shown in FIG. 54;

DETAILED DESCRIPTION OF THE PREFERRED EMBODIMENTS

Figure 1:
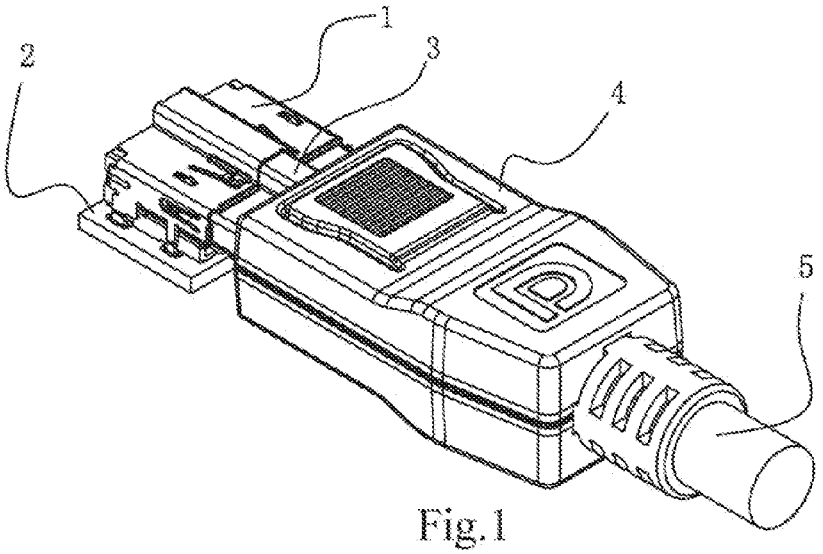
FIG. 1 is a perspective view showing a first embodiment of an electrical connector assembly and a circuit board, and wherein, a cable connector with a plug electrical connector and a receptacle electrical connector in the circuit board are in a state of mating with each other.
Figure 2:
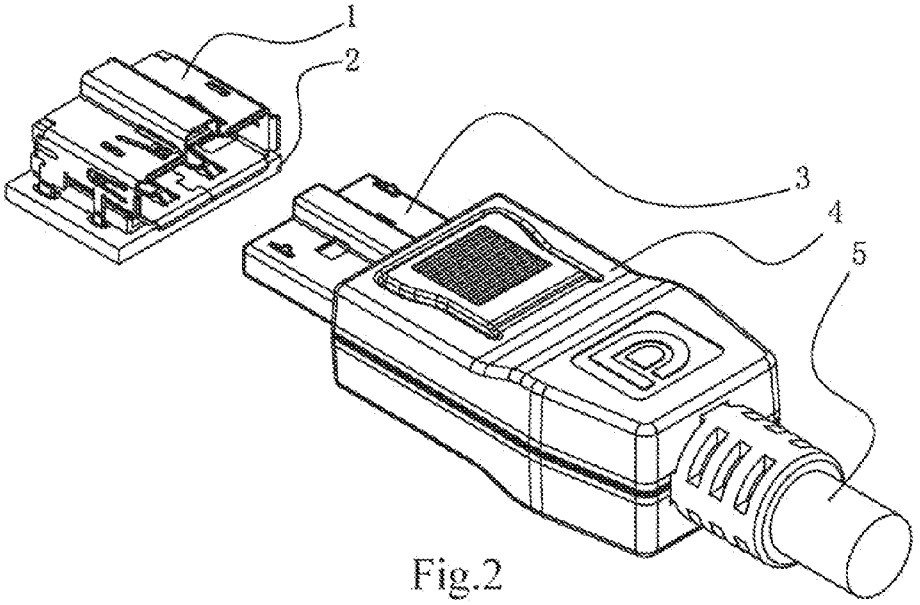
FIG. 2 is a perspective view showing a first embodiment of an electrical connector assembly and a circuit board, and wherein, a first cable connector with a plug electrical connector and a receptacle electrical connector in the circuit board are in a state of separated with each other in a first view angle.
Figure 3:
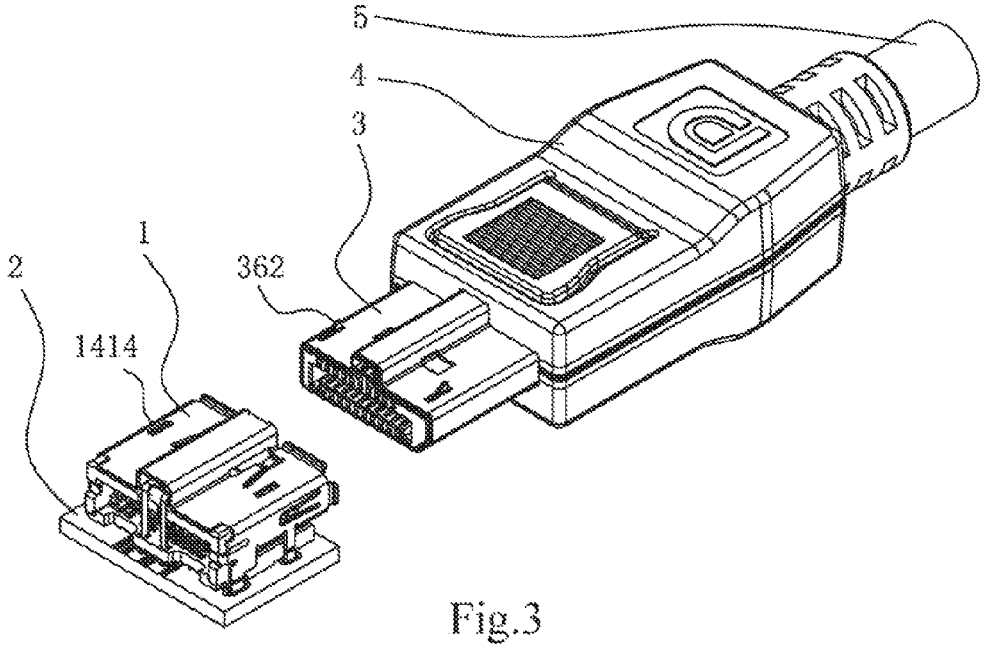
FIG. 3 is another perspective view showing a first embodiment of an electrical connector assembly and a circuit board, and wherein, a first cable connector with a plug electrical connector and a receptacle electrical connector in the circuit board are in a state of separated with each other in a second view angle.

While the present invention may be susceptible to in different forms of embodiment, there is shown in the Figures, and will be described herein in detail, specific embodiments, with the understanding that the disclosure is to be considered an exemplification of the principles of the Present Application, and is not intended to limit the present invention to that as illustrated.

One technical problem that can addressed by the present disclosure is to provide a plug electrical connector, a receptacle electrical connector and an electrical connector assembly having an improved structure for transmitting signals and power, such that the signals transmitting quality between the video source device and the display device can be improved and a compact design propitious to manufacture can be achieved. Compared to the prior art, the plug electrical connector, the receptacle connector and the electrical connector assembly in may have several advantageous benefits.

The mating portions of the fourth terminals in the plug electrical connector are configured to have an elastic protrusion shape, and partly received in the fourth receiving slots of the second protrusion so as to protrude upward, such that the mating portions of the fourth terminals can be protected by the second protrusion. Therefore, the mating portions of the fourth terminals in the plug electrical connector are not easily to be bent and failed during mating with the receptacle electrical connector.

The mating portions of the second terminals in the receptacle electrical connector are configured to have a flat shape, and partly received in the second receiving slots of the surface of the second tongue, such that the mating portions of the second terminals have a relative simply structure so as to easily manufacture and have a compact design.

The mating portions of upper row of the first terminals in the receptacle electrical connector are offset relative to those of lower row of the first terminals, and the mating portions of upper row of the third terminals in the plug electrical connector are also offset relative to those of lower row of the third terminals, such that the signal noises can be reduced and the signal transmitting quality between the video source device and the display device can be improved.

In the embodiments illustrated in the Figures, representations of directions such as up, down, left, right, front and rear, used for explaining the structure and movement of the various elements of the Present Application, are not absolute, but relative. These representations are appropriate when the elements are in the position shown in the Figures. If the description of the position of the elements changes, however, these representations are to be changed accordingly.

As shown in FIGS. 1-4, the electrical connector assembly in accordance with a first embodiment of the present disclosure comprises a receptacle electrical connector 1 and a plug electrical connector 3 mated with each other. The receptacle electrical connector 1 can be soldered to a circuit board 2 of a video source device (not shown) or a display device (not shown), the plug electrical connector 3 can be combined with an outer housing 4, which can be formed of an insulative material, and a cable 5 so as to form a first cable connector. The receptacle electrical connector 1 and the plug electrical connector 3 are mated with each other, such that the video signal and power can be transmitted between the video source device and the display device.

As shown in FIGS. 5-12, which depict a first embodiment, the receptacle electrical connector 1 comprises a first body 11, which can be formed of an insulative material; a plurality of first terminals 12 and two second terminals 13 mounted on the first body 11; a first cage 14 mounted on an outside of the first body 11 and a first retention element 15 mounted on a rear end of the first body 11.

The first body 11 comprises a first main body portion 111, a first tongue 112 and a second tongue 113 extending forward from the first main body 111. The first main body portion 111 has a first protrusion 116 protruding upward and having a relative narrow width. The first tongue 112 extends forward from a middle of the first main body portion 111, and the second tongue 113 extends forward from the first protrusion 116. The first body 11 further comprises a bottom plate 114 extending forward from a bottom of the first main body portion 111, and a retention plate fixing portion 115 provided on a rear end of the bottom of the first main body portion 111.

Figure 5:
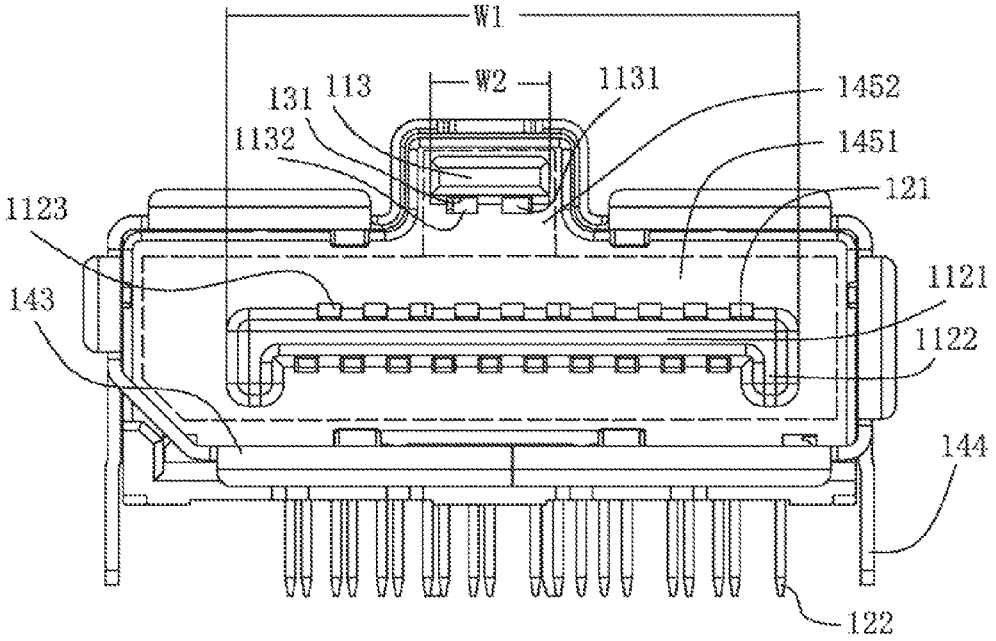
FIG. 5 is a front view showing a first embodiment of a receptacle electrical connector.

Referring to FIG. 5, the first tongue 112 comprises a base 1121 in a plate shape and two keying ribs 1122 protruding downward from a left and right side edge of the base 1121 respectively. A plurality of first receiving slots 1123 are provided on opposite upper and lower surfaces (opposite first and second surfaces) of the base 1121. The first tongue 112 can be mated with a standard DP (Display Port) type plug electrical connector. The two keying ribs 1122 of the first tongue 112 can prevent the other different type plugs from being wrongly inserted into the receptacle electrical connector 1, so as to prevent the first cage 14 from breaking.

The first and second tongue 112 and 113 are configured to be parallel with each other and arranged in an upper and lower relationship. The first tongue 112 has a width W1 larger than that W2 of the second tongue 113, such that the mating plug electrical connector 3 can be effectively prevented from being mistakenly inserted onto the receptacle electrical connector 1.

Figure 12:
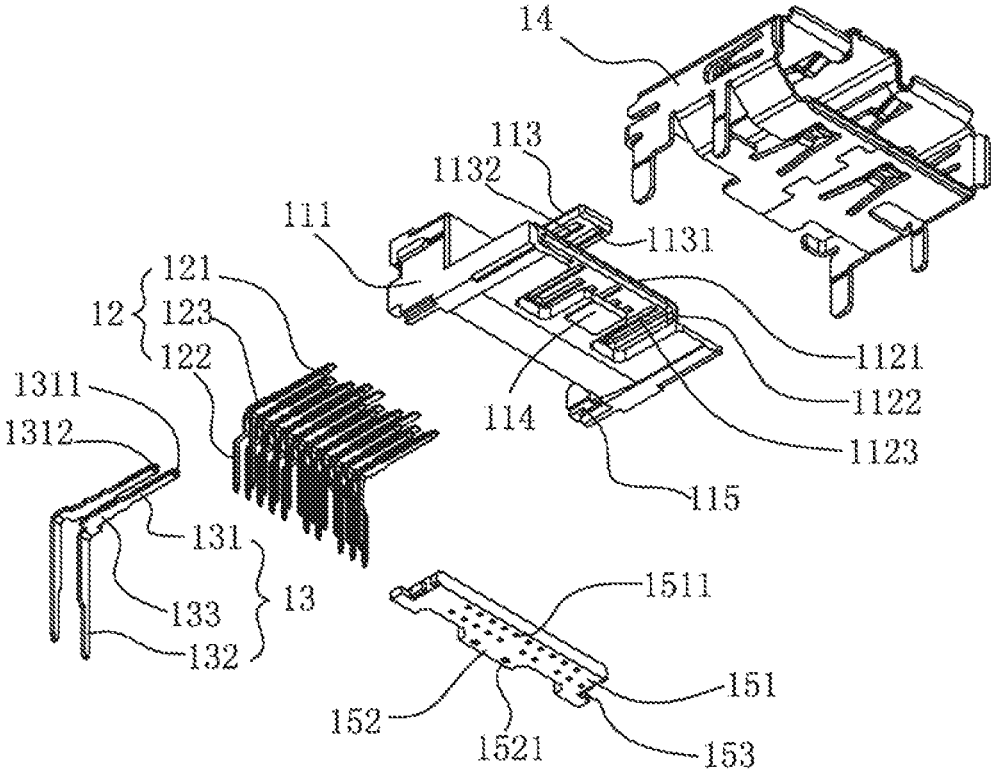
FIG. 12 is another exploded perspective view showing a first embodiment of a receptacle electrical connector in a second view.

Referring to FIG. 12, two second receiving slots 1131, 1132 are provided on the lower surface of the second tongue 113. A front end of the second receiving slot 1131 is located at a position forward of the second receiving slot 1132.

The first terminals 12 can be divided into upper and lower rows. Each of the first terminals 12 has a mating portion 121 in a plate shape, a soldering portion 122 and a fixing portion 123 connected between the mating portion 121 and the soldering portion 122. The mating portions 121 of the first terminals 12 are provided in first receiving slots 1123 located on upper and lower surfaces of the base 1121 of the first tongue 112, for transmitting high definition video signals. Also referring to FIG. 5, the mating portions 121 of the first terminals 12 located on the upper surface of the first tongue 112 are offset relative to those on the lower surface of the first tongue 112, that is, the mating portions 121 are not faced or aligned with each other in an upper and lower direction, such that the distance between the mating portions 121 of the upper row of first terminals and those of the lower row of first terminals can be increased, thusly reducing the signal noises during the high frequency data transmission and improving the signals transmitting quality.

Figure 6:
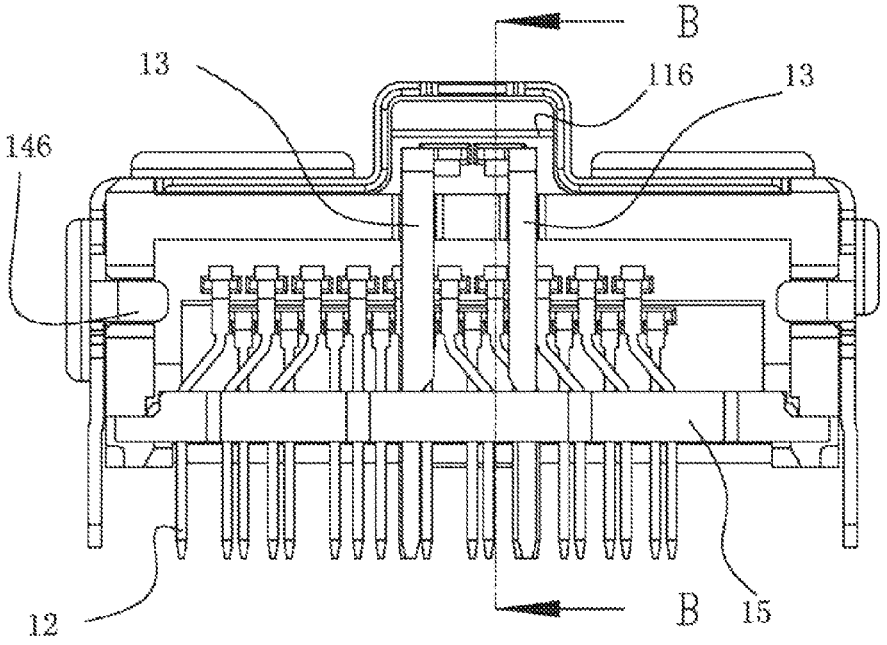
FIG. 6 is a rear view showing a first embodiment of a receptacle electrical connector.
Figure 7:
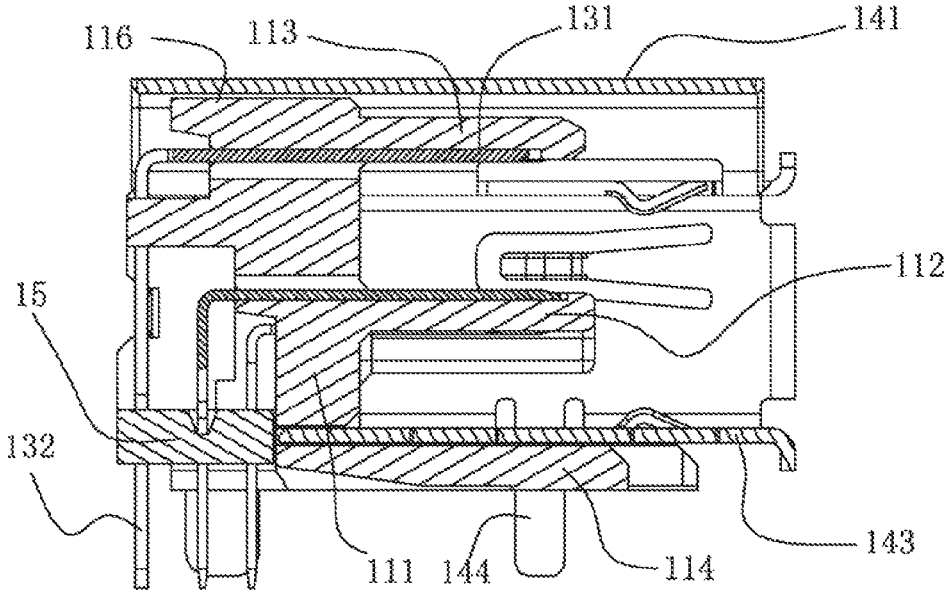
FIG. 7 is a sectional view in a B-B direction in FIG. 6.
Figure 8:
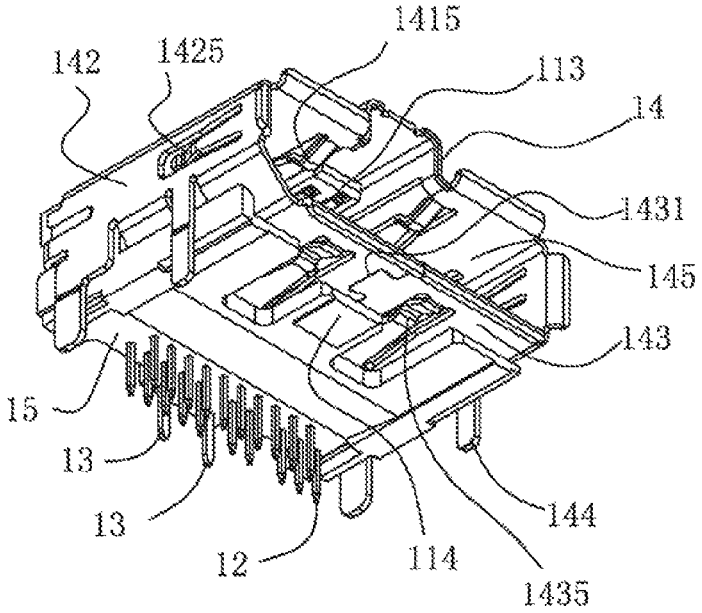
FIG. 8 is a perspective view showing a first embodiment of a receptacle electrical connector.

Each of the second terminals 13 comprises a mating portion 131 in a plate shape, a soldering portion 132 and a fixing portion 133 connected between the mating portion 131 and the soldering portion 132. One second terminals 13 received in the corresponding second receiving slot 1131 is used to connect with the negative pole of the power source, and the other received in the corresponding second receiving slot 1132 is used to connect with the positive pole of the power source. A distal 1311 of the mating portion 131 of the one second terminals 13 connected to the negative pole of the power source is located on a position closer to the front than a distal 1312 of the mating portion 131 of the other second terminals 13 connected to the positive pole of the power source. The two second terminals 13 are used to transmit the power required by the display device, so as to save one separate power cable of the display device. In addition, as shown in FIGS. 6 and 12, the two soldering portions 132 of the two second terminals 13 bend and extend away from each other, such that a first distance between the two soldering portions 132 is larger than a second distance between the two mating portions 131 of the two second terminals 13.

Figure 9:
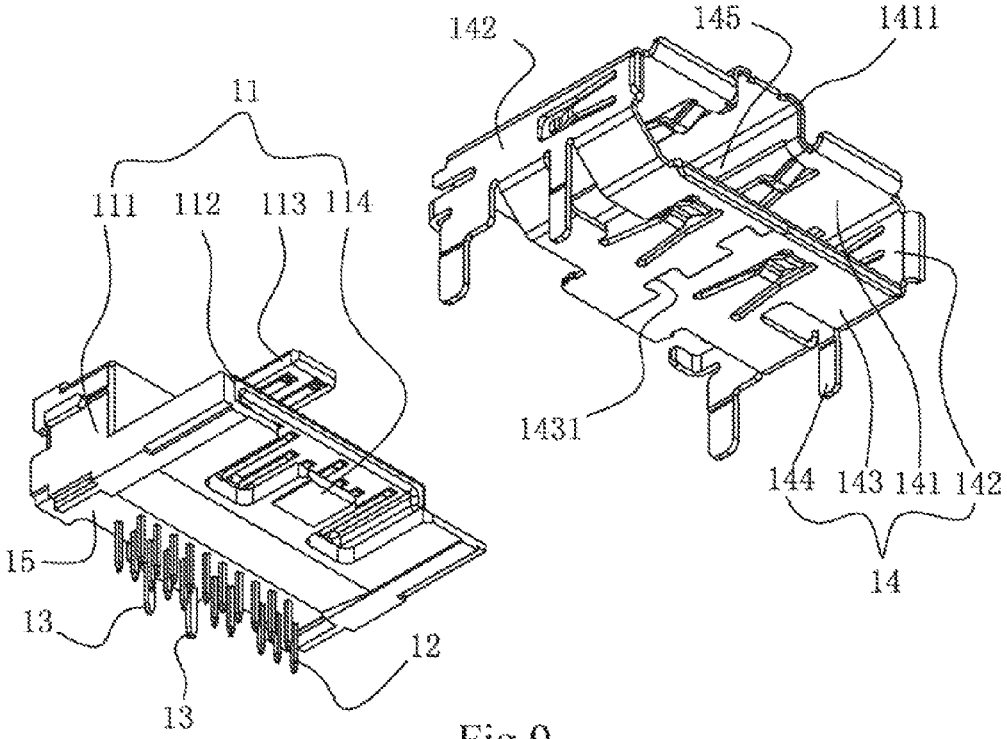
FIG. 9 is an exploded perspective view showing a first embodiment of a receptacle electrical connector.
Figure 10:
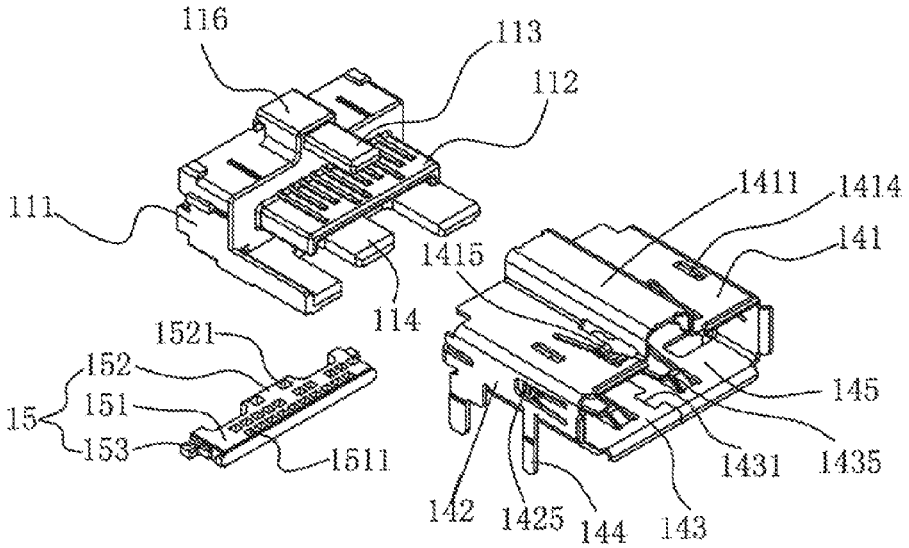
FIG. 10 is a further exploded perspective view showing a first embodiment of a receptacle electrical connector in a first view angle.
Figure 11:
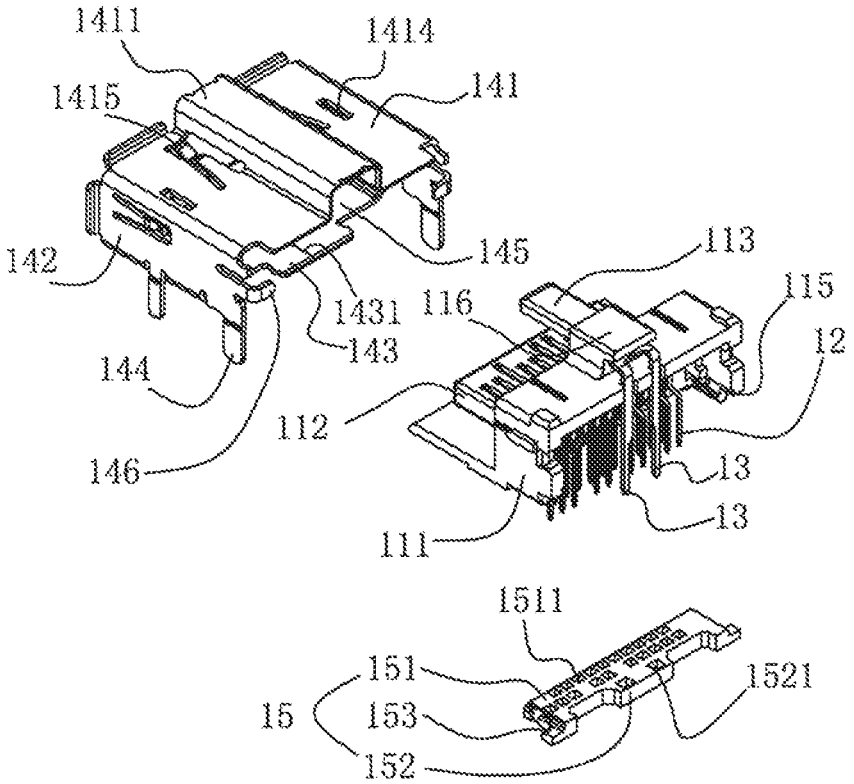
FIG. 11 is a further exploded perspective view showing a first embodiment of a receptacle electrical connector in a second view angle.

Referring to FIGS. 9-11, the first cage 14 is formed by punching a metal plate and has a shape with a small upper portion and a larger lower portion. The first cage 14 comprises a top plate 141, two side plates 142 bending and extending downward from left and right sides of the top plate 141, a bottom plate 143 formed by horizontally bending and extending the two side plates 142 toward each other and finally engaging with each other, and four fixing foots 144 extending downward from the side plates 142. An arching portion 1411 in an invert U shape extends upward from a middle of the top plate 141.

Referring to FIG. 5, the first cage 14 encloses the first and second tongue 112 and 113, such that a receiving chamber 145 in a shape of small upper portion and large lower portion is formed. The receiving chamber 145 comprises a first mating chamber 1451 and a second mating chamber 1452 (as shown by the dotted-line in FIG. 5) stacked in an up and down direction and communicated with each other. The first tongue 112 is received in the first mating chamber 1451 in which a standard DP plug can be inserted. The second tongue 113 is received in the second mating chamber 1452 which is located above the first mating chamber 1451 and has a much narrower width than that of the first mating chamber 1451. An engaging line 1431 extending in a front to rear direction is formed on the bottom of the first cage 14. The bottom plate 114 of the first body 11 supports the first cage 14 from below the engaging line 1431 of the first cage 14, so as to prevent the engaging line 1431 the first cage 14 from breaking and widening due to the distortion after using the receptacle connector for a long term.

Referring to FIG. 10, the first cage 14 is provided with a hole 1414 on each of the left and right sides of the arching portion 1411. The top plate 141 is provided with a flexible clasp arm 1415 extending from rear to front on each of the left and right sides of the arching portion 1411. The bottom plate 143 is provided with a flexible clasp arm 1435 extending from rear to front on each of the left and right sides thereof. Each of the two side plates 142 is provided with a flexible clasp arm 1425 extending from front to rear. Those flexible clasp arms 1414, 1425, 1435 can be clasped on the different sides and positions in different depths of the plug electrical connector 3, to improve the engaging strength.

Referring to FIGS. 10 and 11, the first retention element 15 comprises a base 151 in a plate shape, a protrusion 152 protruding backward from a middle of rear end of the base 151, and two body fixing portions 153*f* provided on two sides of the base 151. The base 151 is provided with a plurality of perforations 1511 communicated in an upper and lower direction, through which the soldering portions 122 of the plurality of first terminals 12 are inserted. The protrusion 152 is provided with two second perforations 1521 communicated in an upper and lower direction, through which the soldering portions 132 of the two second terminals 13 are inserted. The body fixing portion 153 is mated with the retention plate fixing portion 115 in the body 11, such that the first retention element 15 is fixed on the rear end of the first body 11. The first retention element 15 is mated with the first and second terminals 12 and 13, so as to prevent the first and second terminals 12 and 13 from unsuitable bending.

Figure 4:
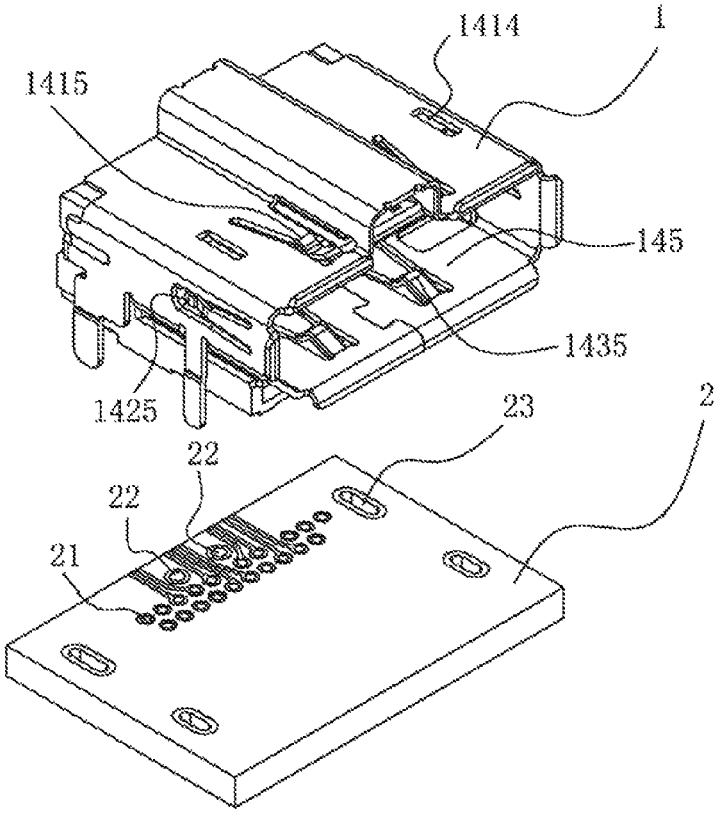
FIG. 4 is an exploded perspective view showing a first embodiment of a receptacle electrical connector and a circuit board.

Please see FIG. 4, the circuit board 2 soldered with the receptacle electrical connector 1 is provided with a plurality of first soldering holes 21 corresponding to the an flexible portions 122 of the plurality of first terminals 12, two second soldering holes 22 corresponding to the soldering portions 132 of the two second terminals 13, and four fixing holes 23 corresponding to the four fixing foots 144 of the first cage 14.

The assembly procedure of the receptacle electrical connector 1 is as follows: firstly inserting the first and second terminals 12 and 13 into the first body 11 in a direction of from rear to front; aligning the first retention element 15 with the soldering portions 122 of the first terminals 12 and the soldering portions 132 of the second terminals 13 and inserting the first retention element 15 in a direction of from upper to lower, until the body fixing portion 153 of the first retention element 15 is mated with the retention plate fixing portion 115 of the first body 11 such that the first retention element 15 is clasped with the first body 11; and then mounting the above formed assembly into the receiving chamber 145 of the first cage 14 in a direction of from rear to front; finally bending the fixing portion 146 located on the rear end of the first cage 14 as the shape shown in FIG. 11, and fixing the above assembly into the first cage 14.

Figure 13:
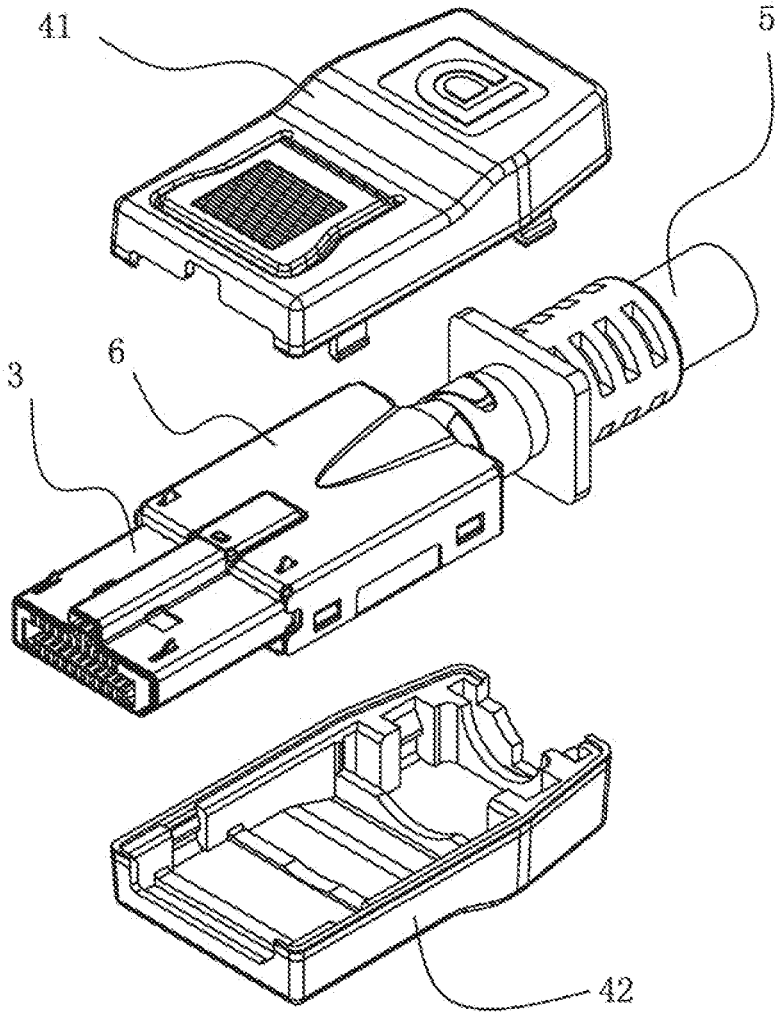
FIG. 13 is an exploded perspective view showing a first embodiment of a plug electrical connector and an insulated outer housing, a metal inner housing and a cable.
Figure 14:
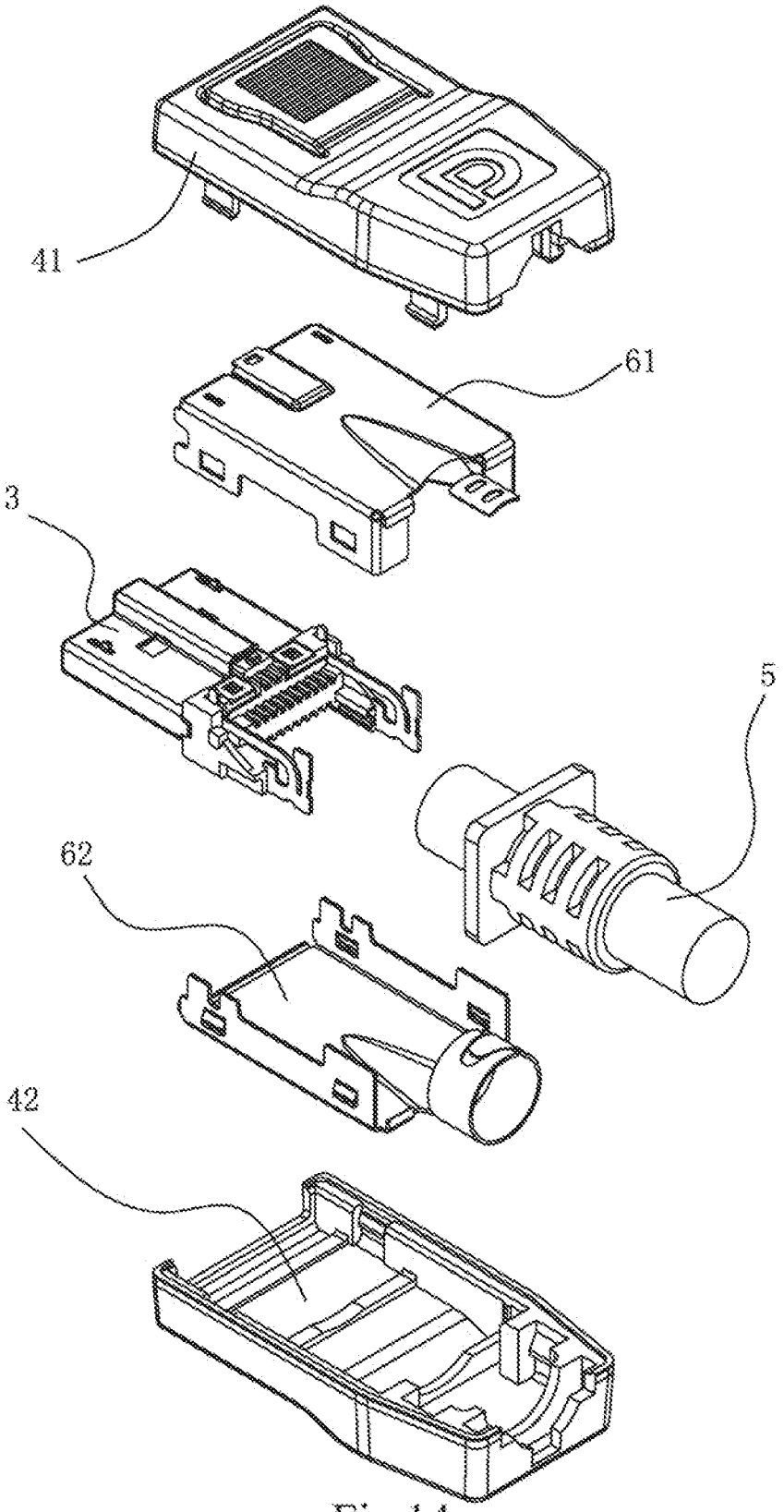
FIG. 14 is a further exploded perspective view of FIG. 13.

Referring to FIGS. 13 and 14, the plug electrical connector 3 can be electrically connected with a cable 5. The plug electrical connector 3, a metal inner housing 6 covering the connection position between the plug electrical connector 3 and the cable 5, and an insulated outer housing 4 are assembled together to form a cable connector. The insulated outer housing 4 is composed of an upper housing 41 and a lower housing 42 clasped with each other. The metal inner housing 6 is also composed of an upper housing 61 and a lower housing 62 clasped with each other.

Figure 17:
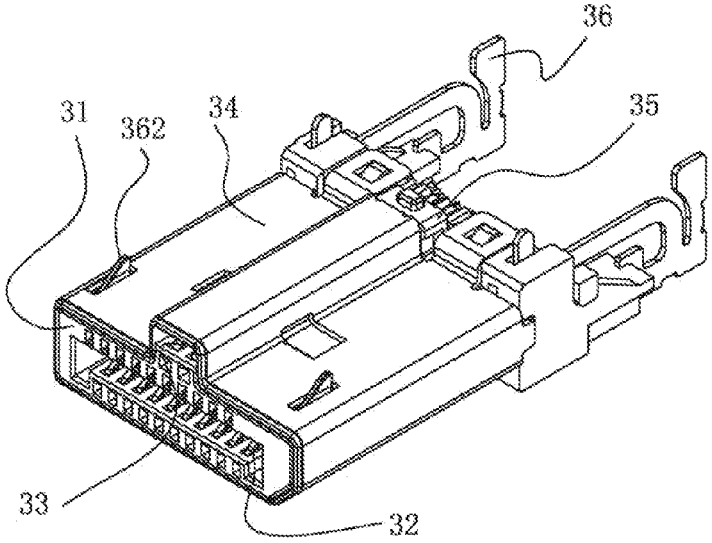
FIG. 17 is a perspective view of a first embodiment of a plug electrical connector.

Referring to FIG. 17, the plug electrical connector 3 comprises a second body 31, a plurality of third terminals 32 and two fourth terminals 33 mounted on the second body 31; a second cage 34 mounted on an outside of the second body 31; a second retention element 35 mounted on a rear end of the second body 31; and two hooks 36 mounted on the second insulate body 31. Each of the hooks 36 has a hook portion 362 elastically movable up and down at its front end.

Figure 18:
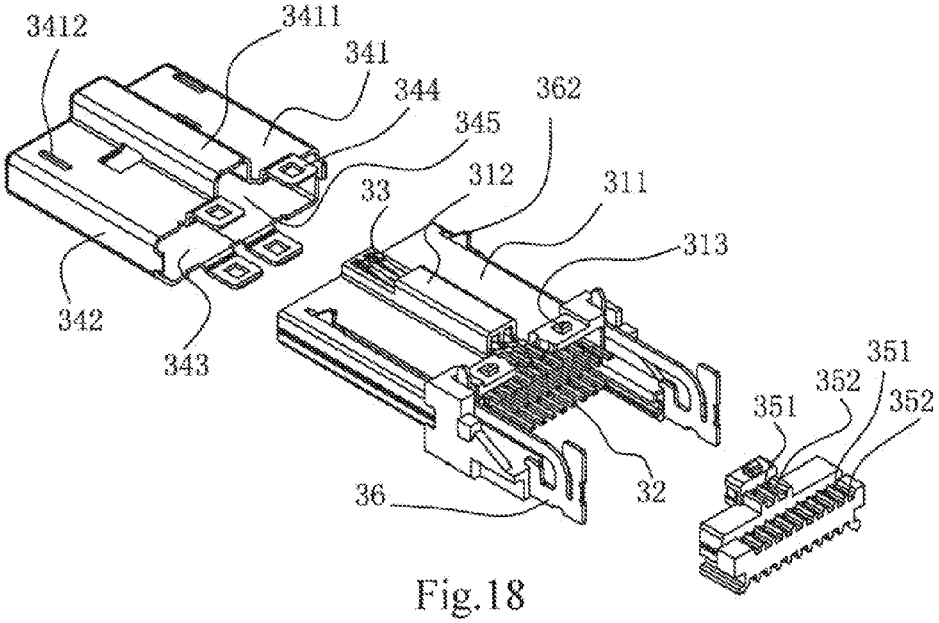
FIG. 18 is an exploded perspective view of a first embodiment of a plug electrical connector.
Figure 19:
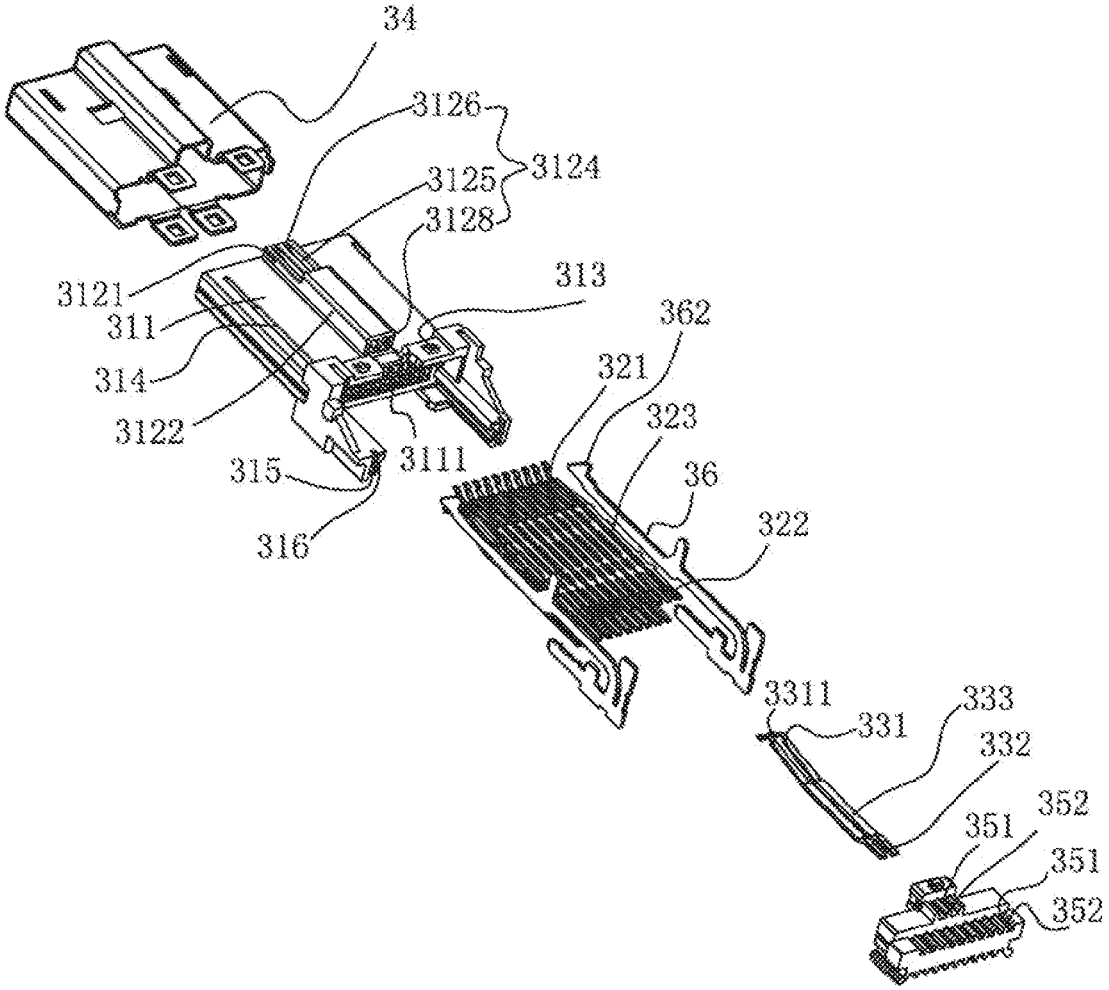
FIG. 19 is a further exploded perspective view of a first embodiment of a plug electrical connector.

Referring to FIGS. 18 and 19, the second body 31 comprises a second main body portion 311; a second protrusion 312 protruding upwardly from a top of the second main body portion 311; two cage fixing portions 313 located on a rear end of the second main body portion 311; two hook receiving grooves 314 located on two sides of a front end of the second main body portion 311 respectively; and two hook fixing grooves 315 and two retention fixing portions 316 located on two sides of a rear end of the second main body portion 311 respectively. As for the present embodiment, the cage fixing portions 313 are sloped protrusion with a lower front and a higher rear. The second protrusion 312 has a step shape with a lower front and a higher rear, and comprises a relative lower first portion 3121 located on the front and a higher second portion 3122 located on the rear, and two fourth receiving slots 3124 by which the first and second portions 3121, 3122 are communicated with each other backward and forward.

Figure 15:
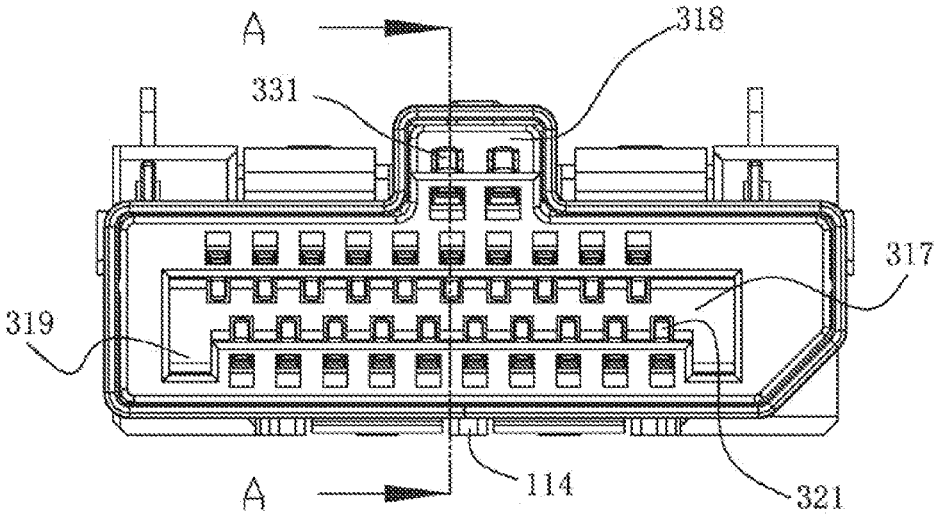
FIG. 15 is a front view showing a first embodiment of a plug electrical connector.

Referring to FIG. 15, the second main body portion 311 is provided with a third mating chamber 317 at its middle. In details, the third mating chamber 317 is recessed from the front end of the second main body portion 311. The third mating chamber 317 is provided with a plurality of third receiving slots 3111 at its upper and lower sides respectively. In addition, the third mating chamber 317 is provided with a polarizing groove 319 recessed downwardly therefrom at each of its left and right sides.

Figure 16:
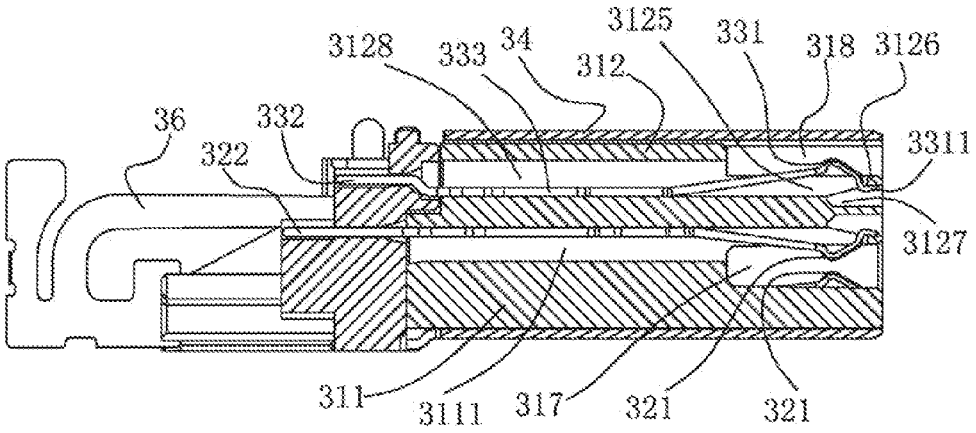
FIG. 16 is a sectional view in an A-A direction in FIG. 15.

Referring to FIG. 16, a front half part of each of the fourth receiving slots 3124 is a groove 3125 recessed downwardly from a top of the first portion 3121 of the second protrusion 312. The second protrusion 312 is provided with a blocking portion 3126 at a front edge of the groove 3125, lower side of the blocking portion 3126 is running-through backward and forward. A rear half part of each of the fourth receiving slots 3124 is a through groove 3128 connected with the groove 3125 backward and forward and communicated with the second portion 3122 of the second protrusion 312.

The plurality of third terminals 32 comprises a mating portion 321, a soldering portion 322 and a fixing portion 323 connected between the mating portion 321 and the soldering portion 322. The mating portion 321 is elastic and has an arching protrusion shape. The mating portions 321 of those third terminals 32 are inserted into the third receiving slots 3111 on upper and lower sides of the third mating chamber 317, for transmitting high definition video signals. The mating portions 321 of the third terminals 32 on the upper side of the third mating chamber 317 are offset relative to those on the lower side of the third mating chamber 317, so as to reduce the interference of signals.

Referring to FIG. 16, two fourth terminals 33 are used to transmit power required by the display device. Each of the fourth terminals 33 comprises a mating portion 331, a soldering portion 332 and a fixing portion 333 connected between the mating portion 331 and the soldering portion 332. The mating portion 331 is elastic and has an arching protrusion shape, and inserted into the groove 3125 of the fourth receiving slot 3124 of the second protrusion 312 and located on the rear end of the blocking portion 3126. The blocking portion 3126 can protect the mating portion 331 from being damaging when the receptacle electrical connector 1 is inserted. The mating portion 331 has a free end 3311 movable up and down. The free end elastically abuts against the lower side of the blocking portion 3126. The fourth receiving slots 3124 is provided with a recessed portion 3127 recessed downwardly on the bottom under the free end 3311 of the mating portion 331 of the fourth terminals 33, so as to increase the movable space of the free end 3311 of the mating portion 331. The fixing portion 333 of the fourth terminals 33 is clasped into the through groove 3128 located on the rear end of the fourth receiving slots 3124.

Referring to FIG. 18, the second shielding 34 is formed by pressing a metal plate and comprises a top plate 341, two side plates 342 bending and extending downward from the top plate 341, a bottom plate 343 formed by bending the two side plates 342 toward each other and then engaging with each other, and four body fixing portions 344 protruding from the top plate 341 and the bottom plate 343 backwardly. As for the present embodiment, the body fixing portions 344 are four holes. The top plate 341, two side plates 342 and the bottom plate 343 of the second cage 34 enclose a receiving chamber 345 in a shape with a small upper portion and a big lower portion. The top plate 341 is provided with an inverted U shaped arching portion 3411 protruded upwardly at its middle, and a hook groove 3412 at each left and right sides at its front. The hook portion 362 of the two hooks 36 extend out upward from the hook groove 3412 on two sides of the upper surface of the second cage 34 respectively. The arching portion 3411 of the second cage 34 and the second protrusion 312 of the second body 31 enclose a fourth mating chamber 318. The mating portion 331 of the fourth terminal 33 extends out upwardly from the fourth receiving slot 3124 toward the fourth mating chamber 318. The third mating chamber 317 and the fourth mating chamber 318 are spaced apart and not communicated with each other by the second body 31. The third mating chamber 317 has a width larger than that of the fourth mating chamber 318.

The second retention element 35 is provided with through holes 351 running-through backward and forward, and a plurality of soldering line channels 352 located at a rear end of these through holes. These three terminals 32 and the four terminals 33 extend out backwardly through the through holes 351, and their soldering portions 322, 332 are received into the soldering line channels 352, so as to be facilitated to solder with wires in the cable 5.

The assembly procedure of the plug electrical connector 3 is as follows: inserting the third terminals 32 and the fourth terminals 33 into the third receiving slots 3111 and the fourth receiving slots 3124 of the second body 31 from rear to front; and then mounting the second retention element 35 on the rear end of the second body 311 from rear to front; finally inserting the above formed assembly into the receiving chamber 345 from rear to front, until the body fixing portion 344 of the second cage 34 is clasped with the cage fixing portion 313 of the second body 31.

In operation, when the above receptacle electrical connector 1 and the plug electrical connector 3 are mated together, the first and second tongues 112 and 113 of the receptacle electrical connector 1 are fitted with the third and fourth mating chambers 317 and 318 of the plug electrical connector 3 respectively, such that the plurality of first terminals 12 and the plurality of third terminals 32, two second terminals 13 and two fourth terminals 33 are electrically connected, so as to realize the video signal and power transmission between the video source device and the display device. As for the present embodiment, the two second terminals 13 can provide the display device with power supply (12V, 3 A) to drive the display device. In other embodiments, the number and size of the second terminals 13 may increase to provide the display device with higher power supply.

In addition, the receptacle electrical connector 1 in accordance with the present embodiment can be mated with the standard DP type plug electrical connector (not shown, it can be regarded as a plug electrical connector 3 by omitting the second protrusion 312, the fourth terminals 33 and the arching portion 3411 of the second cage 34), so as to realize the video signal transmission between the video source device and the display device, and ensure the downward compatibility of the receptacle electrical connector 1.

As compared with the conventional connector, the plug electrical connector, the receptacle electrical connector and the electrical connector assembly in accordance with the first embodiment of the present disclosure have the following advantageous effects:

The mating portions 131 of the two second terminals 13 of the receptacle electrical connector 1 are arranged backward and forward, and one second terminal 13 with a distal 1311 closer to the front is used to connect with the negative pole of power source of the video source device, another second terminal 13 with a distal 1312 closer to the rear is used to connect with the positive pole of the power source of the video source device. By arranging like this, when the plug electrical connector 3 is disconnected with the receptacle electrical connector 1 in the display device, the plug electrical connector 3 is firstly disconnected with the distal 1312 of the second terminal 13 connected with the positive pole of the power source, and then disconnected with the distal 1311 of the second terminal 13 connected with the negative pole of the power source, such that the positive charge remained in the display device can be discharged outwardly via the second terminals 13 connected with negative pole of the power source which is disconnected lately. Therefore, the display device can be ensured to normally operate and advantageous to hot plug.

The distance between the two soldering portions 132 of the two second terminals 13 in the receptacle electrical connector 1 is larger than that between the two mating portions 131, and thusly the distance between the two mating portions 131 can be reduced, and on the other hand, two second soldering holes 22 with a relative large diameter can be advantageously formed on the circuit board 2, such that the second terminals 13 can be applied in the large-current environment. The mating portions 131 of the second terminals 13 on the receptacle electrical connector 1 have a plate shape, and are received into the second receiving slots 1131, 1132 located on the lower surface of the second tongue 113, and thusly the structures of the mating portions 131 of the second terminals 13 are easy to manufacture, at the same time, the distance between the two mating portions 131 can be reduced, so as to reduce the width occupied by the second mating chamber 1452. Therefore, the two clasp arms 1415 on the top plate 14 of the first cage 14 can be remained, so as to have the downward compatibility to the standard DP type plug.

The second protrusion 312 of the plug electrical connector 3 is provided with the two fourth receiving slots 3124, the mating portions 331 of the fourth receiving slots 3124 are elastic and have a protrusion shape, and the mating portions 331 are protruded out upwardly from the fourth receiving slots 3124 toward the fourth mating chamber 318, therefore, the mating portions 331 of the fourth terminals 33 can be protected by the second protrusion 312, and are not easily bent during the mating with the receptacle electrical connector 1.

In addition, the contacting portion 121 of the first terminals 12 on the receptacle electrical connector 1 are offset relative to the contacting portion 321 of the third terminals 32 on the plug electrical connector 3, so as to reduce the signal noise during the transmission and improve the signal transmission quality.

It should be noted that, for the clarity sake, the above first embodiment is explained with reference to the HPDP (High Power Display Port) electrical connector which is newly added the power supply function on the basis of the standard DP (Display Port) electrical connector, however, the present disclosure also can be applied into the other type electrical connector (such as HDMI electrical connector) to add the power supply function.

The second embodiment of the receptacle electrical connector as shown in FIGS. 22-26 is a receptacle electrical connector 1*a* adapted to be vertically mounted on a corresponding circuit board (not shown). The receptacle electrical connector 1*a* comprises a first body 11*a*, a plurality of first terminals 12*a* and two second terminals 13*a* mounted on the first body 11*a*, a first cage 14*a* mounted on the first body 11*a* and a first retention element 15*a* hold on the first cage 14*a* and abut against a rear end of the first body 11*a*.

The first body 11*a* comprises a first main body portion 111*a*, a first tongue 112*a* and a second tongue 113*a* extending forward from the first main body 111*a*. Each of the opposite side surfaces of the first main body portion 111*a* is provided with two first retention portions 1118*a*.

The first tongue 112*a* comprises a base 1121*a* in a plate shape and two keying ribs 1122*a* protruding downward from a left and right side edge of the base 1121*a* respectively. The two keying ribs 1122*a* of the first tongue 112*a* can prevent the other different type plugs from wrongly inserting into the receptacle electrical connector 1*a* due to. The base 1121*a* of the first tongue 112*a* comprises a first surface 1128*a* and a second surface 1129*a* opposite with each other. The first surface 1128*a* is configured to face upward and the second surface 1129*a* is configured to face downward. Each of the first and second surfaces 1128*a* and 1129*a* is provided with a plurality of first receiving slots 1123*a*. The first tongue 112*a* can be mated with a standard DP (Display Port) type plug electrical connector.

The first and second tongue 112*a* and 113*a* are configured to be parallel with each other and arranged in an upper and lower relationship. The first tongue 112*a* has a width W1 larger than that W2 of the second tongue 113*a*. Two second receiving slots 1131*a*, 1132*a* are provided in a lower surface of the second tongue 113*a*.

The first terminals 12*a* can be divided into upper and lower rows. Each of the first terminals 12*a* has a mating portion 121*a* in a plate shape and a soldering portion 122*a*. The mating portions 121*a* of the first terminals 12*a* are provided in first receiving slots 1123*a* of the first tongue 112*a*, for transmitting high definition video signals. The mating portions 121*a* of the first terminals 12*a* located on the upper surface 1128*a* of the first tongue 112*a* are offset relative to those on the lower surface 1129*a* of the first tongue 112*a*, that is, the mating portions 121*a* in an upper row are not faced to the mating portions 121*a* in a lower row, such that the distance between the mating portions 121*a* of the upper row first terminals and the lower row first terminals can be increased, thusly reducing the signal noises during the high frequency data transmission and improving the signals transmitting quality.

Each of the second terminals 13*a* comprises a mating portion 131*a* in a plate shape and a soldering portion 132. The two second terminals 13*a* are received in the two second receiving slots 1131*a*, 1132*a* respectively. One second terminal 13*a* received in the second receiving slot 1131*a* is used to connect with the negative pole of the power source, and the other second terminal 13*a* is used to connect with the positive pole of the power source. A distal of the mating portion 131*a* of the one second terminal 13*a* connected to the negative pole of the power source is located at a position closer to the front on the second tongue 113*a* compared with a distal of the mating portion 131*a* of the other second terminal 13*a* connected to the positive pole of the power source, such that the positive charge remained in the inner of the display device can be discharged via the plug electrical connector through the second terminal 13*a* connected with the negative pole of the power source which are disconnected later when hot plugging, and thusly the display device can be ensured to operate normally. The two second terminals 13*a* are used to transmit the power required by the display device, so as to save one separate power cable of the display device. In addition, the distance between the soldering portions 132*a* is larger than that of the mating portions 131*a* of the two second terminals 13*a*, such that the distance between the two corresponding soldering holes in the circuit board can be increased to suitably increase the current.

The first cage 14*a* encloses the first and second tongue 112*a* and 113*a* to form a receiving chamber 145*a*. A first mating chamber 1451*a* enclosing the first tongue 112*a* is formed around the first tongue 112*a*, in which a standard DP plug can be inserted. A second mating chamber 1452*a* enclosing the second tongue 113*a* is formed around the second tongue 113*a*. The first mating chamber 1451*a* has a width larger than that of the second mating chamber 1452*a*. The first and second mating chambers 1451*a* and 1452*a* are stacked and communicated with each other to form the first receiving chamber 145*a*. In details, the first cage 14*a* is formed by pressing a metal plate and has a shape with a small upper portion and a larger lower portion.

Figure 24:
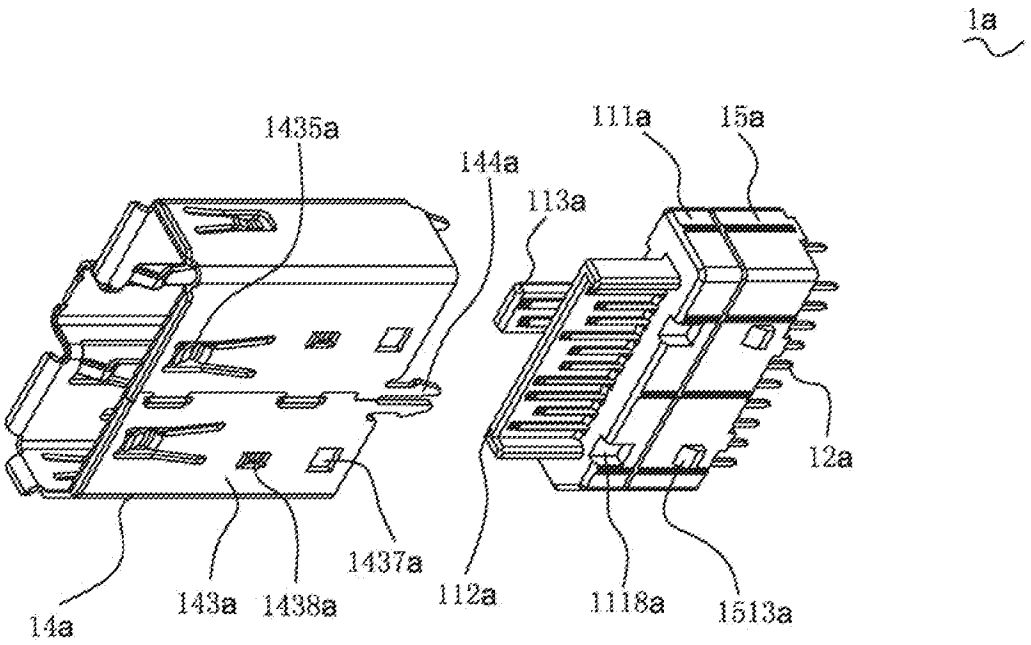
FIG. 24 is an exploded perspective view showing a second embodiment of a receptacle electrical connector.
Figure 25:
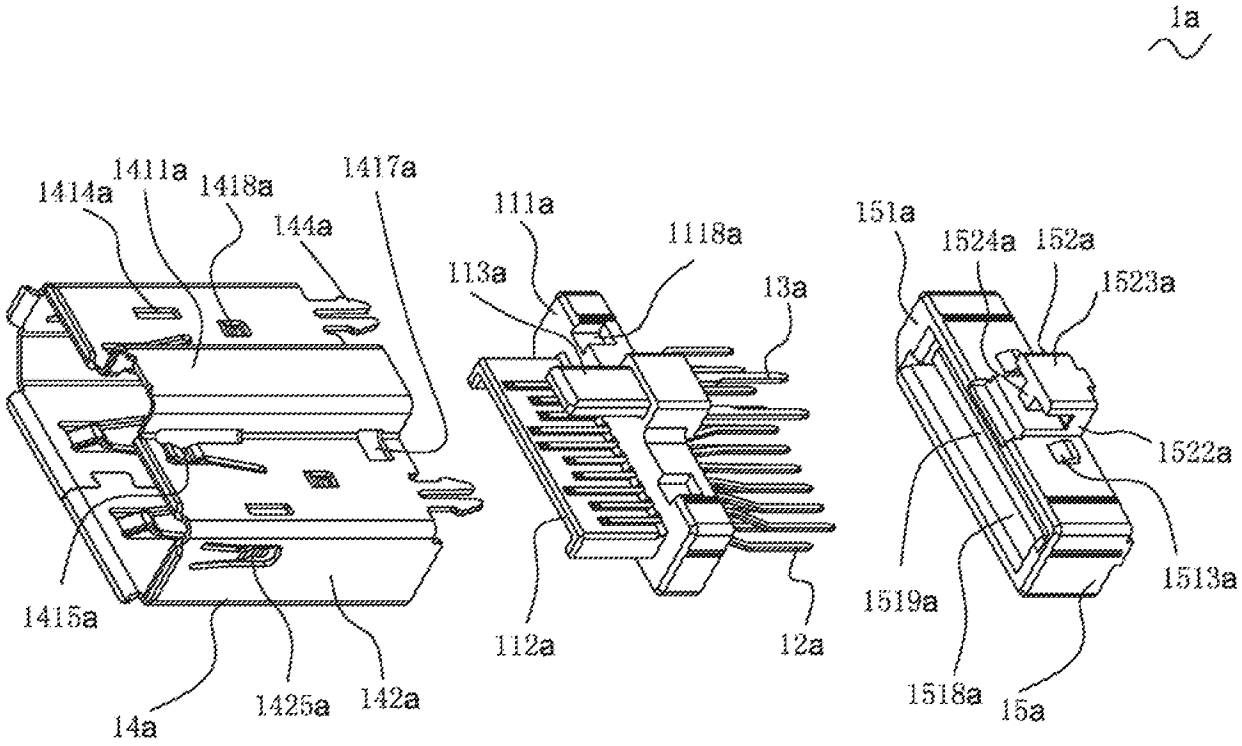
FIG. 25 is exploded perspective view of the embodiment depicted in FIG. 24.
Figure 26:
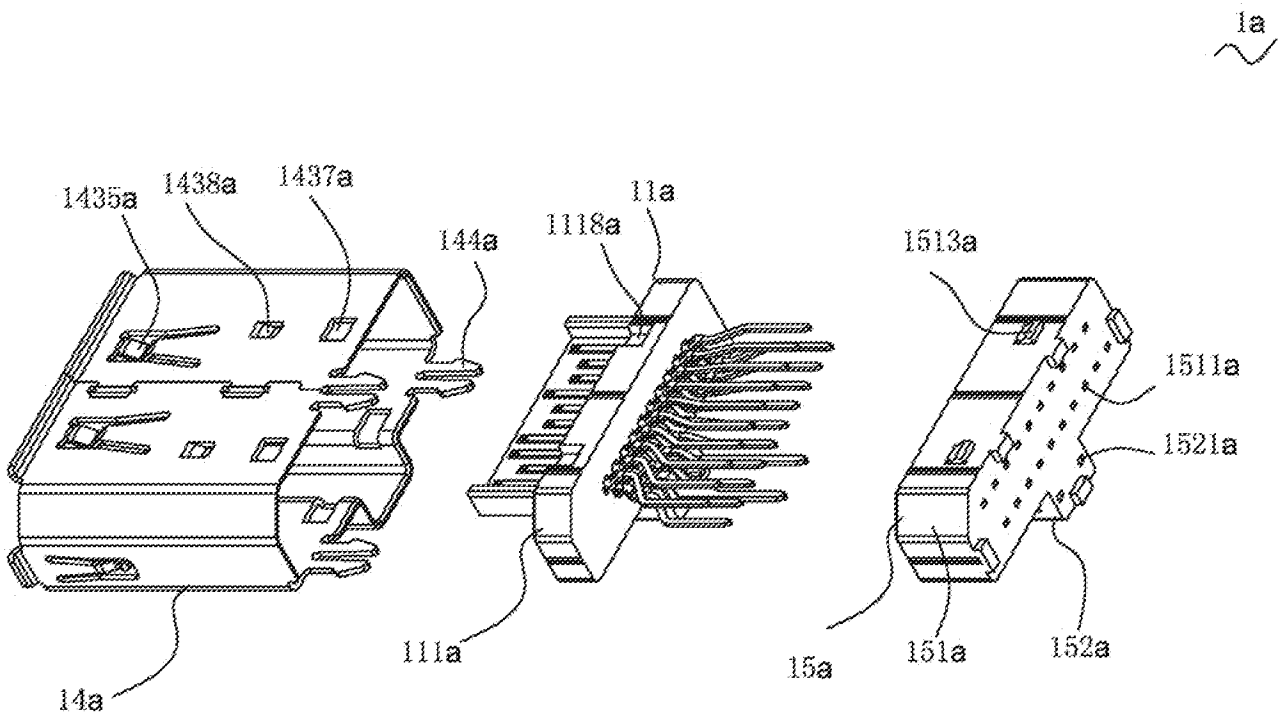
FIG. 26 is another exploded perspective view of the embodiment depicted in FIG. 24
Figure 27:
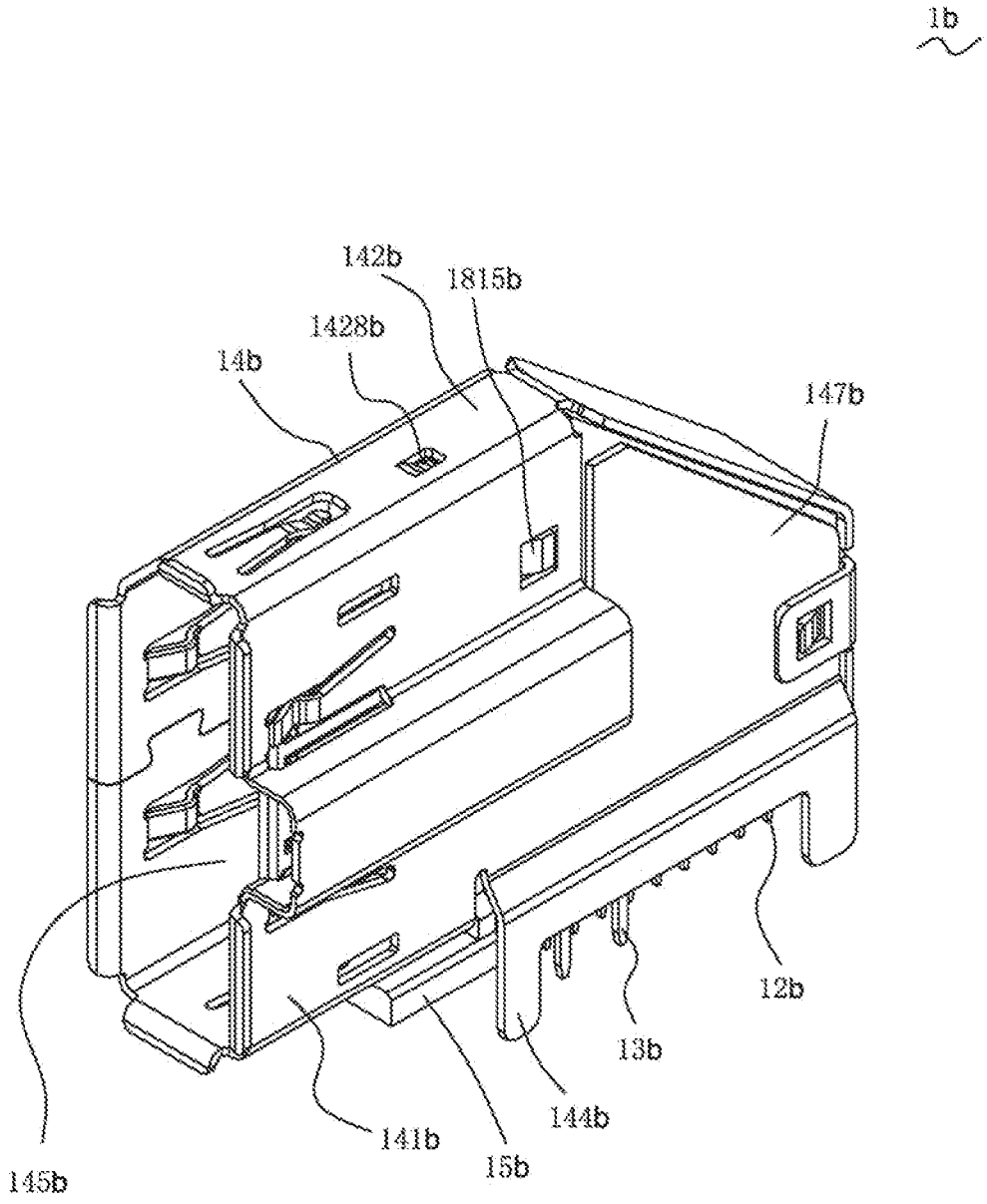
FIG. 27 is a perspective view of a third embodiment of a receptacle electrical connector.
Figure 28:
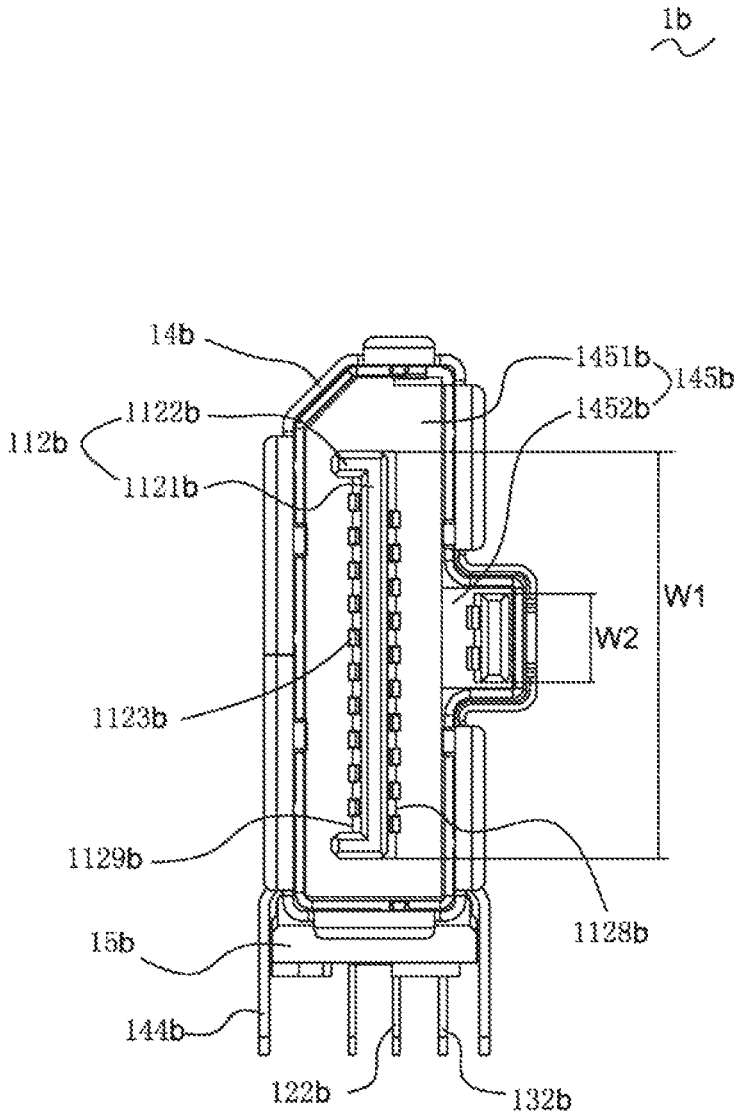
FIG. 28 is a front view of a third embodiment of a receptacle electrical connector.
Figure 29:
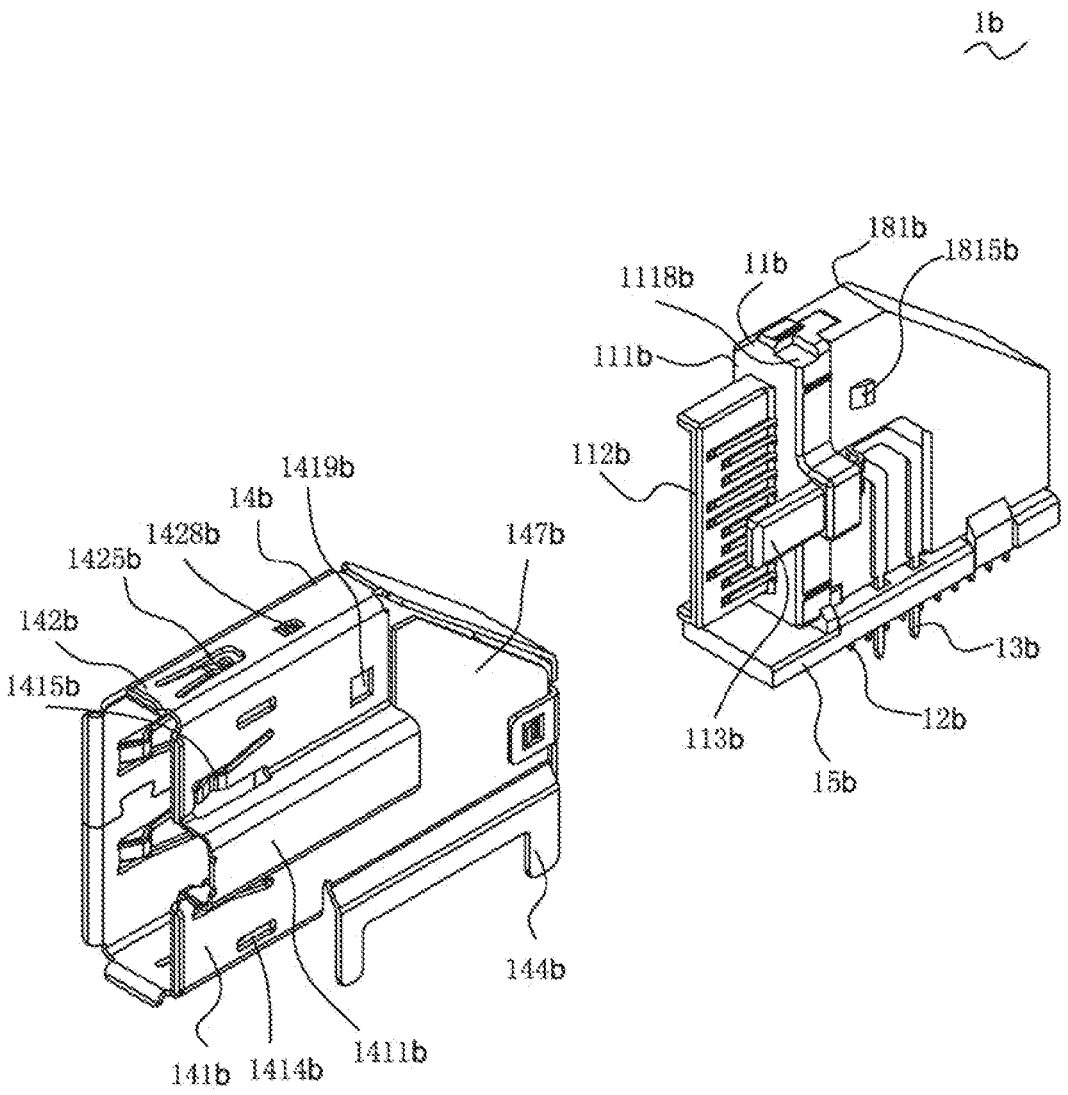
FIG. 29 is an exploded perspective view of a third embodiment of a receptacle electrical connector.

As shown in FIGS. 24 and 25, the first cage 14*a* comprises a top plate 141*a*, two side plates 142*a* bending and extending downward from left and right sides of the top plate 141*a*, a bottom plate 143*a* formed by horizontally bending and extending the two side plates 142*a* toward each other and engaging with each other, and four fixing foots 144*a* straightly extending backward from the rear ends of the top plate 141*a* and the bottom plate 143*a*. An arching portion 1411*a* in an invert U shape extends upward from a middle of the top plate 141*a*. The top plate 141*a* is provided with a hole 1414*a* on each of the left and right of the arching portion 1411*a* and a clasp portion 1417*a* on each of the left and right sides of the arching portion 1411*a*. The top plate 141*a* is provided with a limiting portion 1418*a* protruding inwardly on each front ends of the two clasp portions 1417*a*. Similarly, the bottom plate 143*a* is also provided with a clasp portion 1417*a* and two limiting portions 1418*a*. Those limiting portions 1418*a*, 1438*a* can be mated with the first retention portion 1118*a* of the first body 11*a* to orientate the first body 11*a* relative to the first cage 14*a*. The top plate 141*a* is provided with a flexible clasp arm 1415*a* extending from rear to front on each left and right of the arching portion 1411*a*. The bottom plate 143*a* is provided with a flexible clasp arm 1435*a* extending from rear to front on each of the left and right portion thereof. Each of the two side plates 142*a* is provided with a flexible clasp arm 1425*a* extending from front to rear. Those elastic arms 1414*a*, 1425*a*, 1435*a* can be clasped on the different sides and positions in different depths of the plug electrical connector to improve the engaging strength.

The first retention element 15*a* is mated with the soldering portions of the first and second terminals 12*a*, 13*a*, so as to prevent the soldering portions of those terminals from breaking and shorting out. In details, the first retention element 15*a* comprises a base 151*a* and a protrusion 152*a* extending from the upper surface of the opposite two surfaces of the base 151*a*. The base 151*a* is provided with a plurality of perforations 1511*a* for inserting the first terminals 12*a*. A groove 1518*a* in which a partition plate 1519*a* is provided is recessed backwardly from the front end of the base 151*a*. The two rows of first terminals 12*a* are inserted and received into the groove 1518*a* and arranged on the two sides of the partition plate 1519*a*. The base 151*a* is provided with two clasp portions 1513*a* on each of the upper and lower surfaces thereof, such that the clasp portions can be mated with the clasp portions 1417*a*, 1737*a* on the first cage 14*a* to mount the first retention element 15*a* onto the first cage 14*a* and abut the first retention element 15*a* against the rear end of the first body 11*a*.

As depicted, a holding portion 1513*a* is a holding protrusion which protrudes outwardly from the base 151*a* with a slope at its front end. The clasp portions 1417*a*, 1437*a* are openings in the first cage 14*a*. In the other embodiment, the holding portion 1513*a* may be a holding groove recessed inwardly from the base 151*a* instead, and the clasp portions 1417*a*, 1437*a* are holding elastic sheets (not shown) protruding toward the inner of the first receiving chamber 145*a* instead.

The protrusion 152*a* is provided with two second perforations 1521*a* for inserting the second terminals 13*a*. The protrusion 152*a* comprises a vertical wall 1522*a* extending vertically from the rear end of the upper surface of the base 151*a*, a top plate 1523*a* extending forwardly from the top end of the vertical wall 1522*a*, and a partition plate 1524*a* extending vertically from the bottom of the top plate 1523*a*. The vertical wall 1522*a* is provided with a second perforation 1521*a* on each of the two sides of the partition plate 1524*a*.

The assembly procedure of the receptacle electrical connector 1*a* is as follows: firstly inserting the first and second terminals 12*a* and 13*a* into the first body 11*a* in a direction of from rear to front; and then covering the first cage 14*a* onto the first body 11*a* in a direction of from front to rear; and finally aligning the first retention element 15*a* with the soldering portions of those terminals and inserting the first retention element 15*a* in a direction of from rear to front, such that the first retention element 15*a* is fixed on the first cage 14*a* and abut against the rear end of the first body 11*a*.

It should be noted that although the number of the above second terminals 13*a* is two, it can be three or four or the other number larger than two in the other possible embodiment, so as to improve the supplied power.

Figure 20:
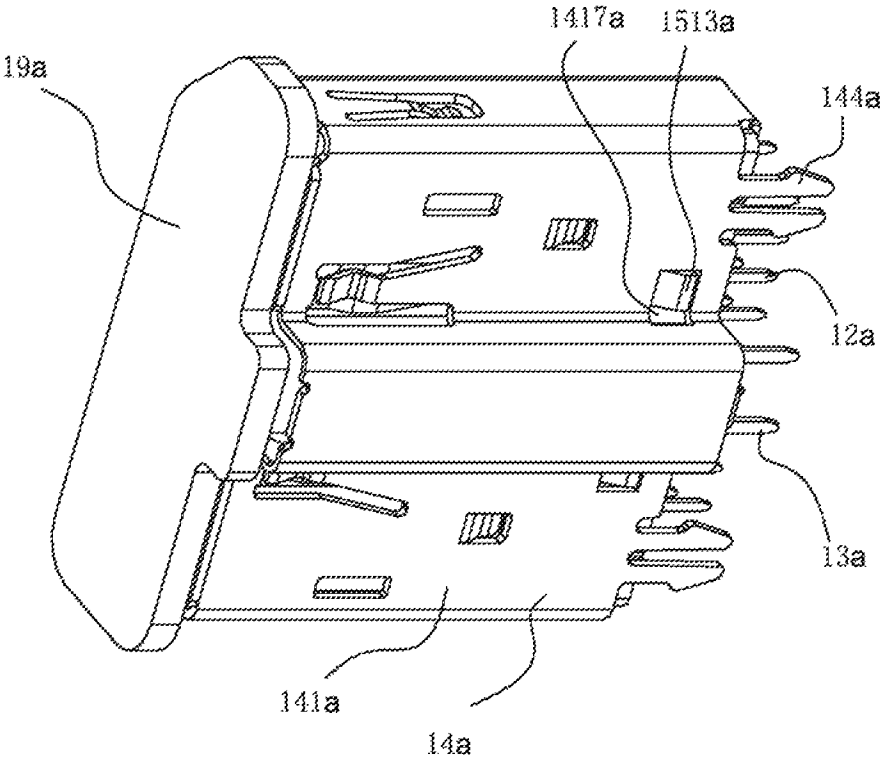
FIG. 20 is a perspective view showing a second embodiment of a receptacle electrical connector and a sealed cap fitted with each other.
Figure 21:
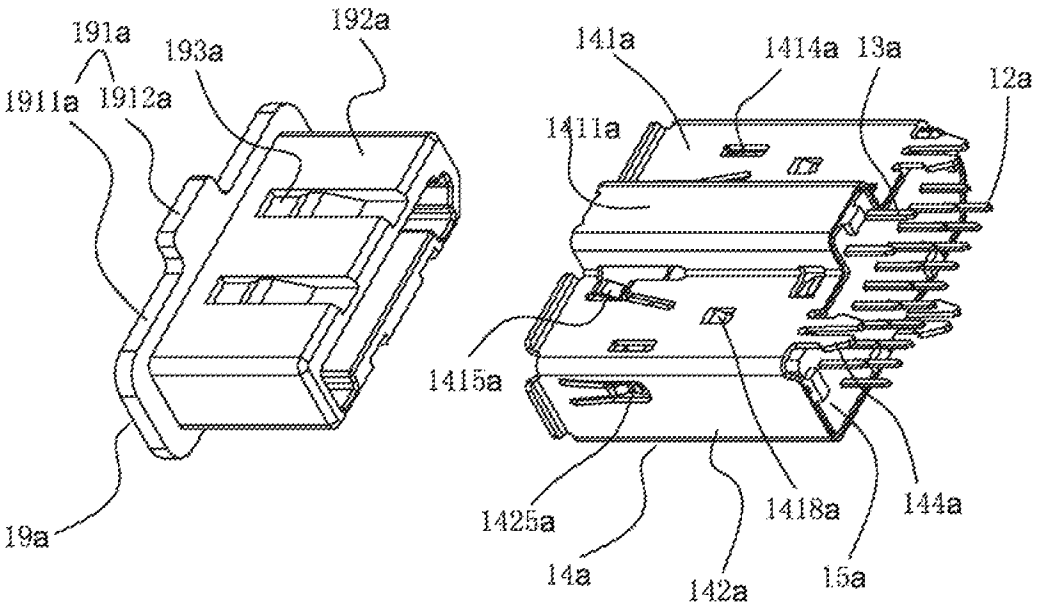
FIG. 21 is an exploded perspective view showing a second embodiment of a receptacle electrical connector and a sealed cap.
Figure 22:
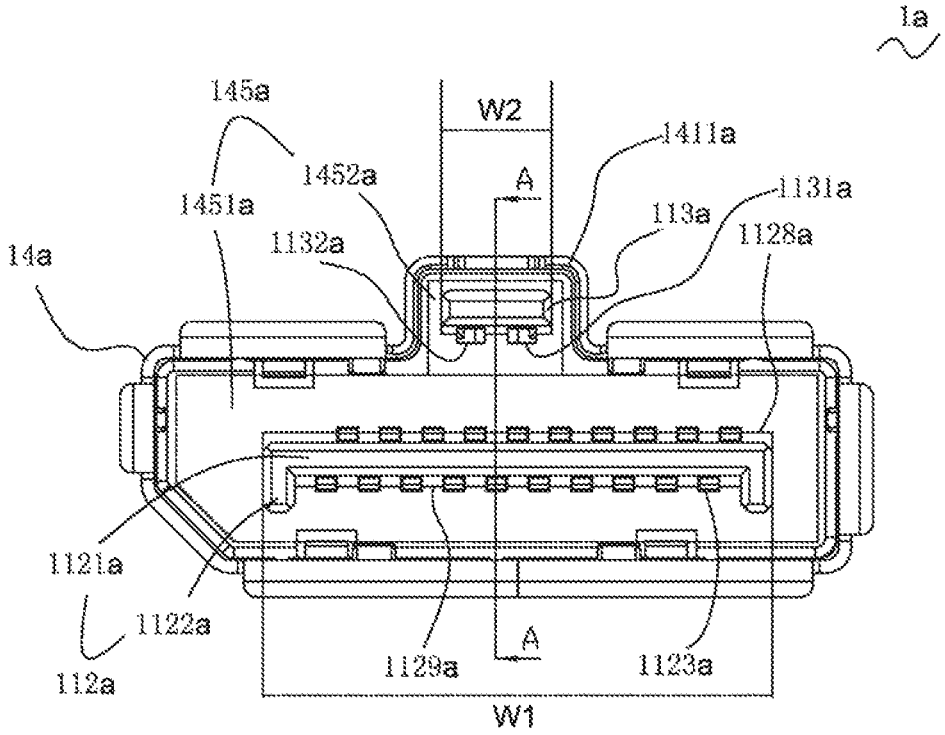
FIG. 22 is a front view of a second embodiment of a receptacle electrical connector.
Figure 23:
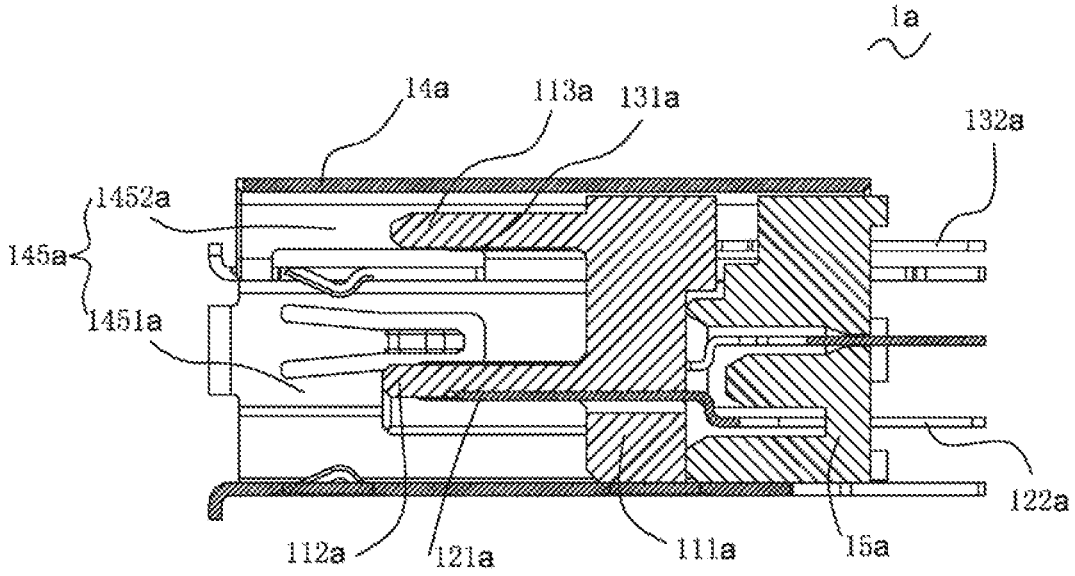
FIG. 23 is a sectional view in an A-A direction in FIG. 22.

Referring to FIGS. 20 and 21, the receptacle electrical connector 1*a* further comprises a sealed cap 19*a* which has a panel 191*a* and an extension 192*a* extending backwardly from the panel 191*a*. The extension 192*a* is provided with a plurality of buckle portions 193*a* at its periphery. The shape of the panel 191*a* is corresponding to the opening shape of the first receiving chamber 145*a*. The panel 191*a* has a base 1911*a* for sealing the first mating chamber 1451*a*, and a protrusion 1912*a* for sealing the second mating chamber 1452*a*. The buckle portions 193*a* can be engaged with the flexible clasp arms 1415*a*, 1435*a* in the first cage 14*a* when the sealing cap 19*a* is inserted into the first receiving chamber 145*a*, such that the opening of the first receiving chamber 145*a* is sealed by the panel 191*a*.

As compared with the conventional connector, in addition to the advantageous effects of the first embodiment, the receptacle electrical connector 1*a* in accordance with the second embodiment of the present disclosure has the following advantageous effects: the combination between the first body 11*a* and the first cage 14*a* can be enhanced since the first retention element 15*a* is mounted on the first cage 14*a* and abut against the rear end of the first body 11*a*, such that the terminals can be prevented from bending.

A third embodiment of the receptacle electrical connector is shown in FIGS. 27-31 and includes a receptacle electrical connector 1*b* adapted to be side-mounted on a corresponding circuit board (not shown). The receptacle electrical connector 1*b* comprises a first body 11*b*, a plurality of first terminals 12*b* and two second terminals 13*b* mounted on the first body 11*b*, a terminal protecting seat 181*b* mounted on a rear end of the first body 11*b*, a first cage 14*b* mounted on an outside of the first body 11*b* and the terminal protecting seat 181*b*, and a first retention element 15*b* mounted under the first cage 14*b* and combined with the first body 11*b* and the terminal protecting seat 181*b*.

The first body 11*b* comprises a first main body portion 111*b*, a first tongue 112*b* and a second tongue 113*b* extending forward from the first main body 111*b*. The first main body portion 111*b* of the first body 11*b* is provided with a front retention portion 1118*b*. The first main body portion 111*b* of the first body 11*b* is also provided with a first retention portion 1119*b* on two ends of the rear portion thereof. In addition, a first clasp portion 1116*b* extends downwardly from the first main body portion 111*b* of the first body 11*b*.

The first tongue 112*b* comprises a base 1121*b* in a plate shape and two keying ribs 1122*b* protruding toward left side from two side edges of top and bottom of the base 1121*c* respectively. The base 1121*b* of the first tongue 112*b* comprises a first surface 1128*b* and a second surface 1129*b* opposite with each other. The first surface 1128*b* is configured to face rightward and the second surface 1129*b* is configured to face leftward. Each of the first and second surfaces 1128*b* and 1129*b* is provided with a plurality of first receiving slots 1123*b*. The first tongue 112*b* can be mated with a standard DP (Display Port) type plug electrical connector.

The first and second tongue 112*b* and 113*b* are configured to be parallel with each other and arranged in a left side and right side relationship. The first tongue 112*b* has a width W1 larger than that W2 of the second tongue 113*b*.

Two second receiving slots 1131*b*, 1132*b* are provided in a surface facing leftward of the second tongue 113*b*.

The first terminals 12*b* can be divided into upper and lower rows which are inserted into the first body 11*b*. Each of the first terminals 12*b* has a mating portion 121*b* in a plate shape and a soldering portion 122*b*. The mating portions

121*b* of the first terminals 12*b* are provided in first receiving slots 1123*b* of the first tongue 112*b*, for transmitting high definition video signals. The mating portions 121*b* of the first terminals 12*b* located on the first surface 1128*b* of the first tongue 112*b* are offset relative to those on the second surface 1129*b* of the first tongue 112*b*, that is, the mating portions 121*b* on a left side are not faced with the mating portions 121*b* on a right side.

The two second terminals 13*b* are inserted into the two second receiving slots 1131*b*, 1132*b* of the first body 11*b*. Each of the second terminals 13*b* comprises a mating portion 131*b* in a plate shape and a soldering portion 132*b*. One second terminal 13*b* received in the corresponding second receiving slot 1131*b* is used to connect with the negative pole of the power source, and the other second terminal is used to connect with the positive pole of the power source. A distal of the mating portion 131*b* of the one second terminal 13*b* connected to the negative pole of the power source is located at a position closer to the front compared with a distal of the mating portion 131*b* of the other second terminal 13*b* connected to the positive pole of the power source. The two second terminals 13*b* are used to transmit the power required by the display device, so as to save one separate power cable of the display device. In addition, the distance between the two soldering portions 132*b* is larger than that between the two mating portions 131*b* of the two second terminals 13*b*.

Figure 30:
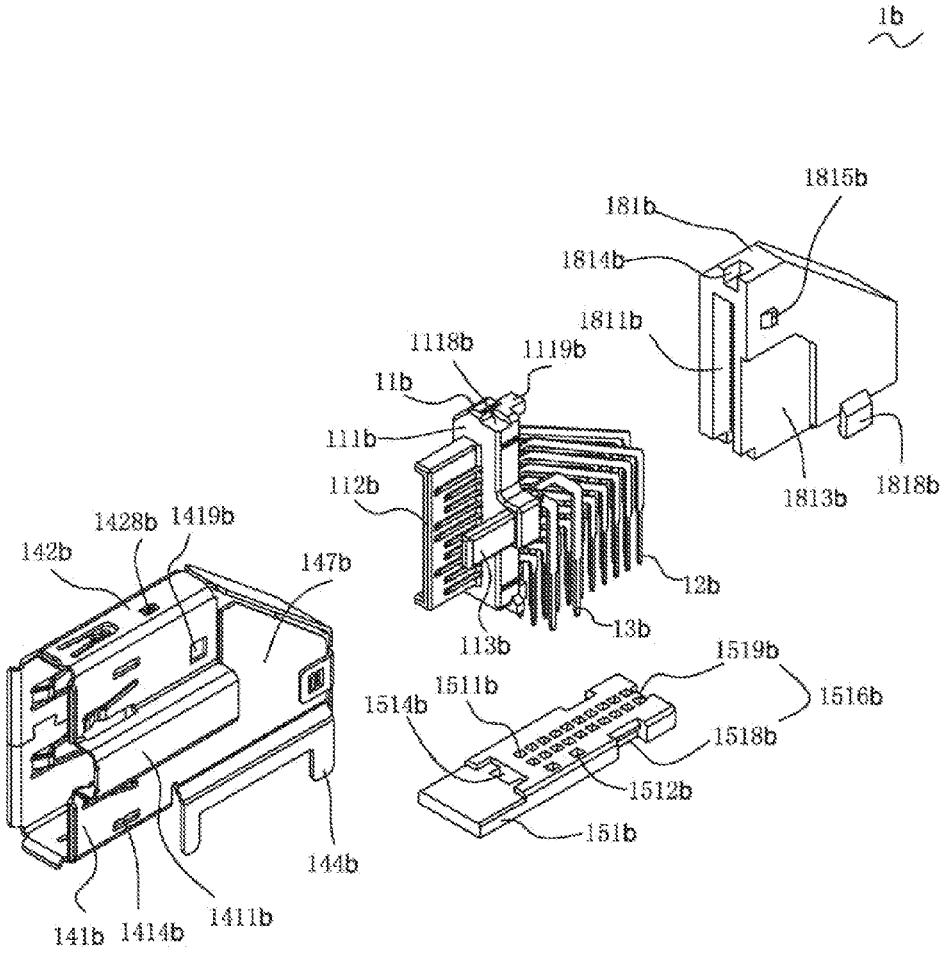
FIG. 30 is a further exploded perspective view of a third embodiment of a receptacle electrical connector.
Figure 31:
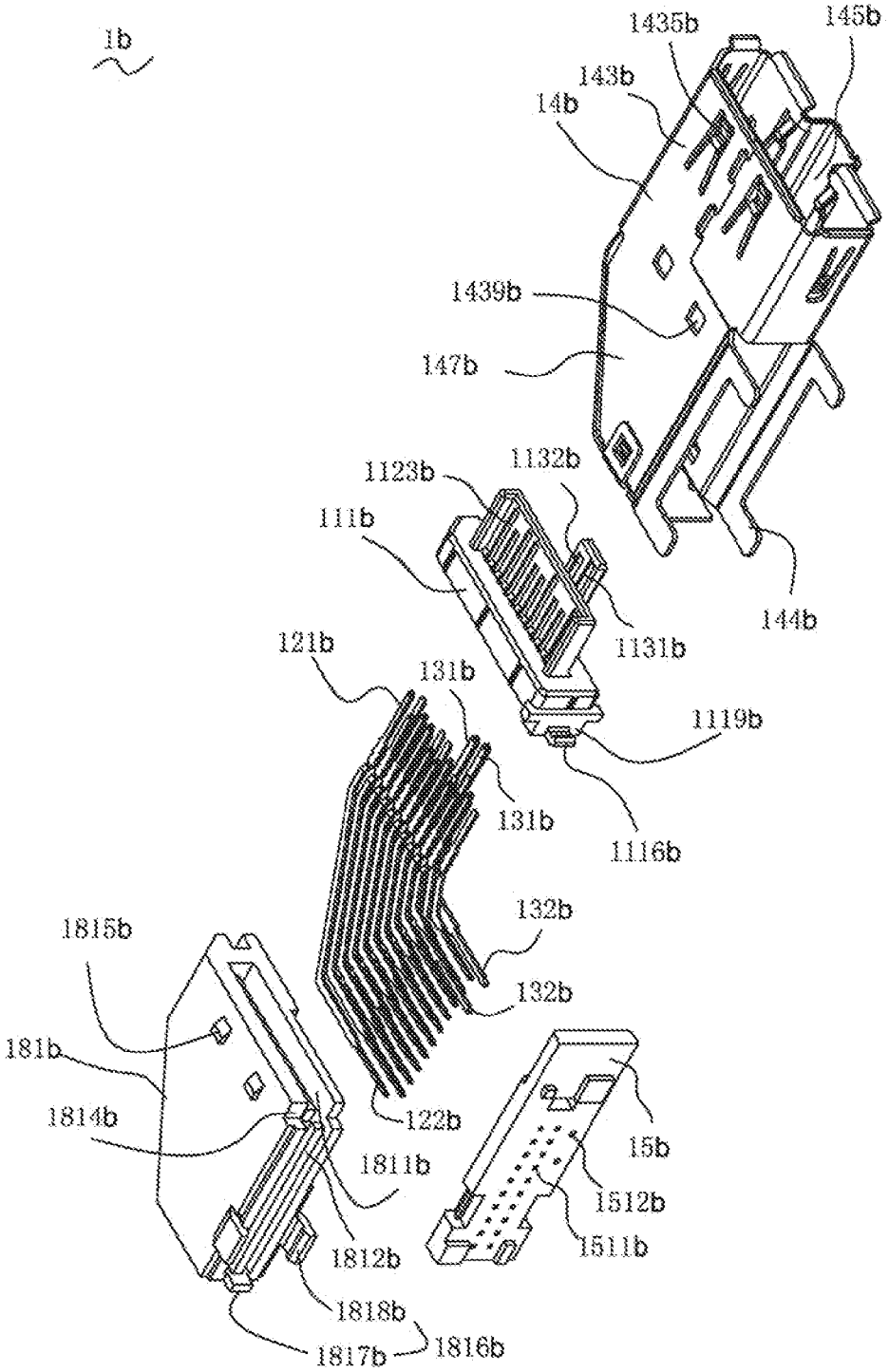
FIG. 31 is another exploded perspective view of a third embodiment of a receptacle electrical connector.
Figure 32:
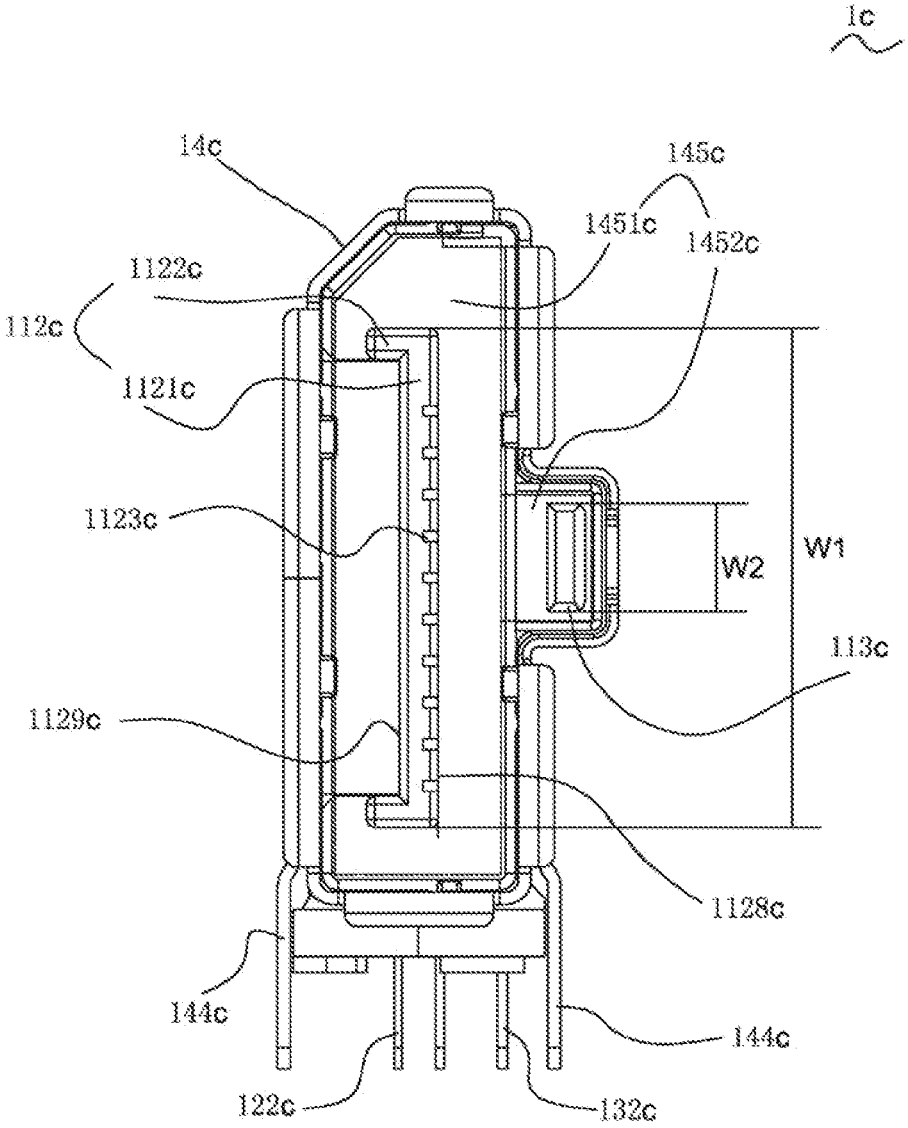
FIG. 32 is a front view of a fourth embodiment of a receptacle electrical connector.
Figure 33:
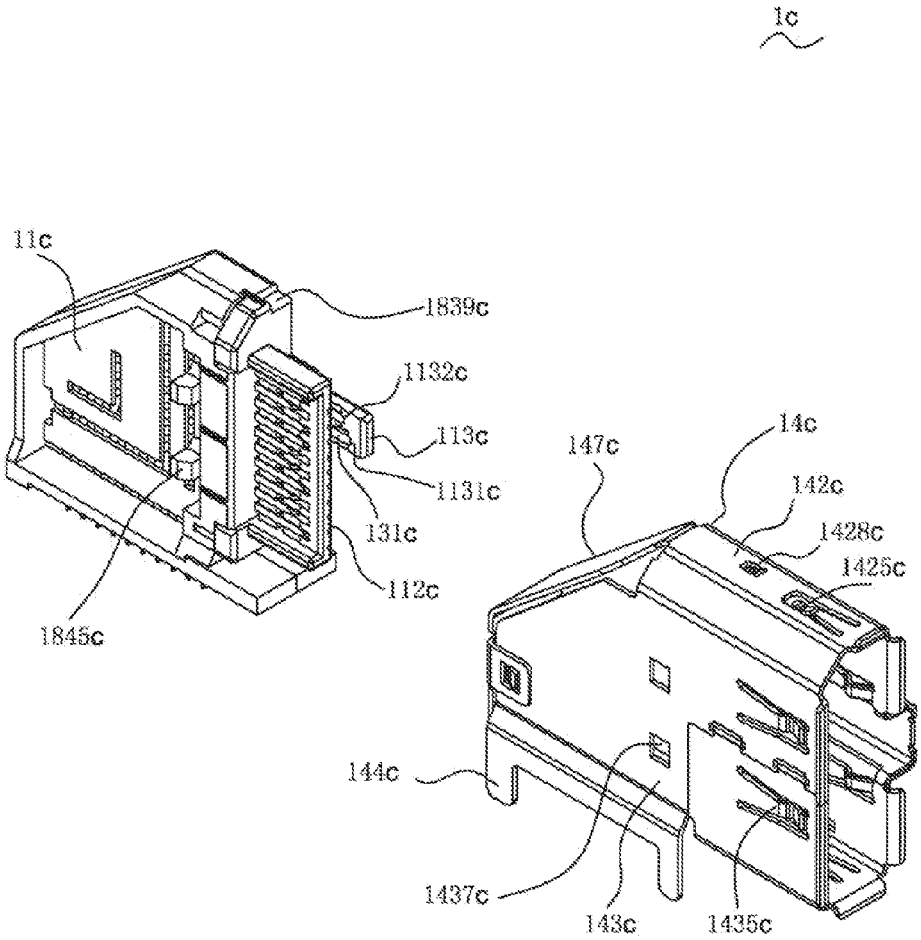
FIG. 33 is exploded perspective view of a fourth embodiment of a receptacle electrical connector.
Figure 34:
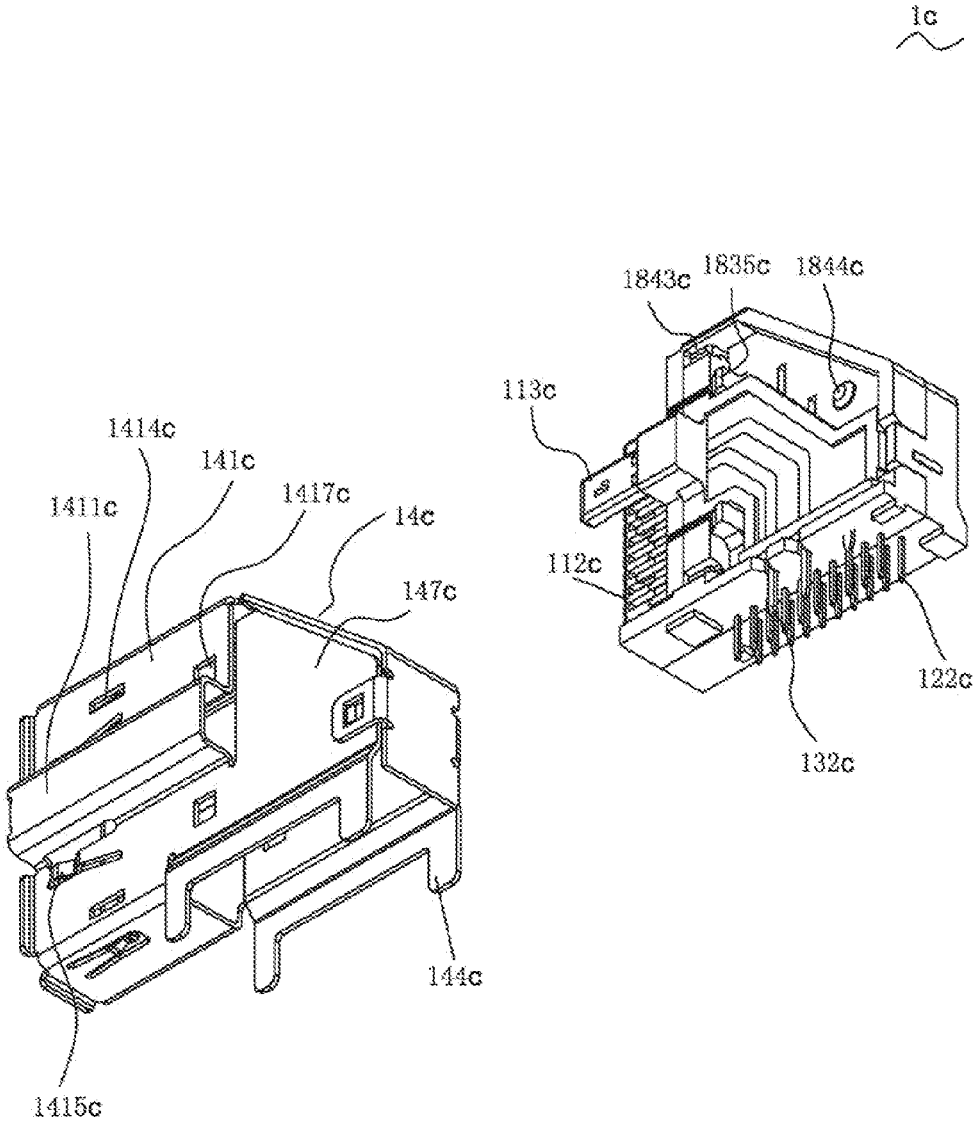
FIG. 34 is an exploded perspective views of a fourth embodiment of a receptacle electrical connector.
Figure 35:
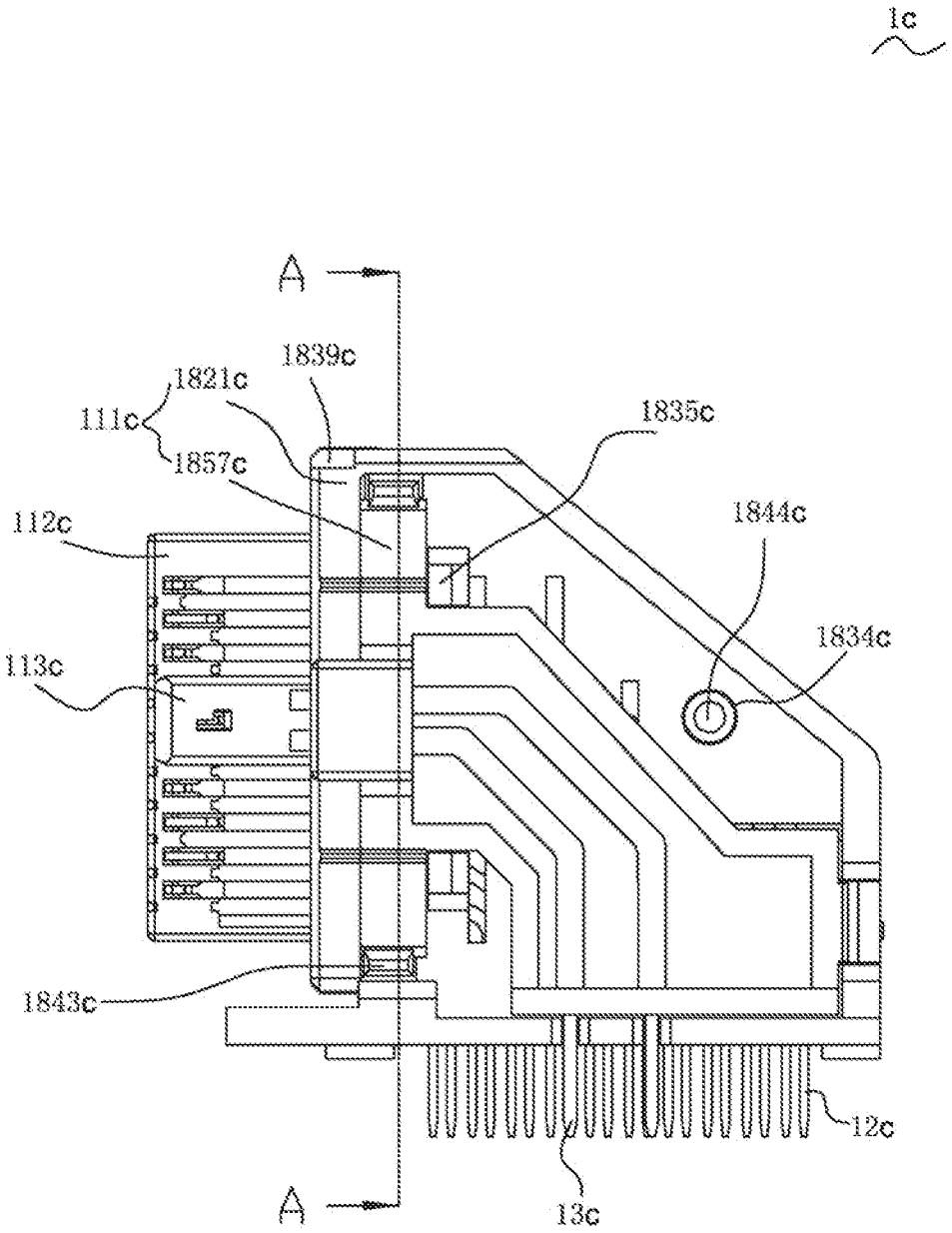
FIG. 35 is a side view showing a combination of a first body and terminals in a fourth embodiment of a receptacle electrical connector.
Figure 36:
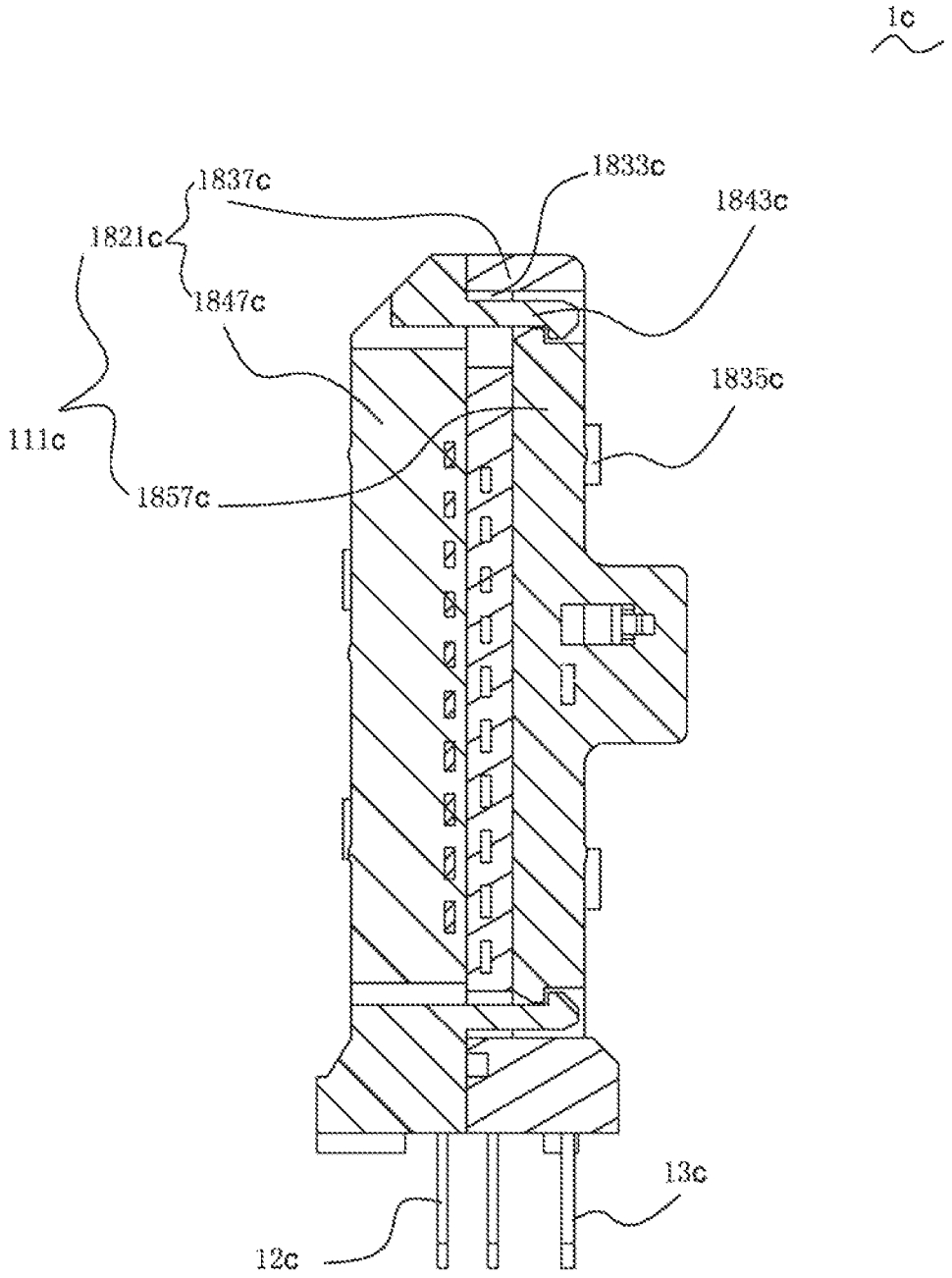
FIG. 36 is a sectional view in an A-A direction in FIG. 35.

As shown in FIGS. 30 and 31, the terminal protecting seat 181*b* is mounted on a rear end of the first body 11*b*, and provided with a receiving slot 1811*b* recessed in a middle of the terminal protecting seat 181*b* and a partition wall 1812*b* located in the receiving slot 1811*b*. The receiving slot 1811*b* is divided into left and right parts by the partition wall 1812*b* for receiving the two rows of first terminals 12*b*. The terminal protecting seat 181*b* is provided with a groove 1813*b* on the right side thereof for receiving the second terminals 13*b*. The terminal protecting seat 181*b* is also provided with a first combining portion 1814*b* on each of the top and bottom ends on a front thereof for mating with the two first retention portions 1119*b* of the first body 11*b*, such that the terminal protecting seat 181*b* is fixed on the rear end of the first body 11*b*. In addition, the terminal protecting seat 181*b* is provided with two clasp portions 1815*b* on each of left and right sides thereof. The terminal protecting seat 181*b* is also provided with a first buckle portion 1816*b* under the rear end thereof. The first buckle portion 1816*b* comprises two opposite buckles 1818*b* extending downwardly from the left and right sides closer to the rear end thereof respectively, and a limiting block 1817*b* extending downwardly from the rear end thereof.

The first cage 14*b* encloses the first and second tongue 112*b* and 113*b* to form a receiving chamber 145*b*. A first mating chamber 1451*b* enclosing the first tongue 112*b* is formed around the first tongue 112*b*, in which a standard DP plug can be inserted. A second mating chamber 1452*b* enclosing the second tongue 113*b* is formed around the second tongue 113*b*. The first mating chamber 1451*b* has a width larger than that of the second mating chamber 1452*b*. The first and second mating chambers 1451*b* and 1452*b* are stacked and communicated with each other to form the first receiving chamber 145*b*. In details, the first cage 14*b* is formed by pressing a metal plate and has a shape with a small upper portion and a larger lower portion.

The first cage 14*b* comprises a right side plate 141*b*, a top plate 142*b* and a bottom plate 142*b* bending and extending leftward in a horizontal direction from top and bottom of the right side plate 141*b* respectively, a left side plate 143*b* formed by further vertically bending and extending the top plate 142*b* and the bottom plate 142*b* toward each other and then engaging with each other, and an extension 147*b* formed by extending backwardly and combining the right side plate 141*b*, left side plate 143*b* and the top plate 142*b*. The extension 147*b* covers the rear ends of the first body 11*b* and the terminal protecting seat 181*b*.

An arching portion 1411*b* in an invert U shape protrudes rightward from a middle of the right side plate 141*b*. The right side plate 141*b* is provided with a hole 1414*b* on each of the upper and lower portions of the arching portion 1411*b*. The arching portion 1411*b* is provided with a mounting portion 1419*b* on each side thereof. Similarly, the right side plate 143*b* is also provided with two mounting portions 11439*b*. Those mounting portions 1419*b*, 1439*b* can be mated with the clasp portions 1815*b* of the terminal protecting seat 181*b*, for fixing the terminal protecting seat 181*b* onto the first cage 14*b*. In addition, the top plate 142*b* is provided with a limiting portion 1428*b* which is mated with the front retention portion 1118*b* of the first body 11*b* to orientate the first body 11*b* at the rear end of the first cage 14*b*.

In addition, the right side plate 141*b* is provided with a flexible clasp arm 1415*b* extending from rear to front on each upper and lower sides of the arching portion 1411*b*. The left side plate 143*b* is provided with a flexible clasp arm 1435*b* extending from rear to front on each of the upper and lower portions thereof. Each of the top and bottom plates 142*b* is provided with a flexible clasp arm 1425*b* extending from front to rear.

The first retention element 15*b* and the terminal protecting seat 181*b* are mated with the first and second terminals 12*b*, 13*b*, so as to prevent the soldering portions of those terminals from bending. In details, the first retention element 15*a* is mounted under the first body 11*b* and the terminal protecting seat 181*b*, and comprises a base 151*b*. The base 151*b* is provided with a plurality of first perforations 1511*b* for inserting the first terminals 12*b*, two second perforations 1512*b* for inserting the second terminals 13*b*. The first retention element 15*a* is also provided with a first mounting portion 1514*b* for mating with the first clasp portion 1116*b* of the first body 11*b*, and a second buckle portion 1516*b* for mating with the first buckle portion 1816*b* of the terminal protecting seat 181*b*. In details, the first mounting portion 1514*b* is a hole. The second buckle portion 1516*b* comprises two snap grooves 1518*b* located at a position closer to the rear end and mated with the two buckles 1818*b* of the first buckle portion 1816*b*, and a retention groove 1519*b* located on the rear end and mated with the limiting block 1817*b* of the first buckle portion 1816*b*.

The assembly procedure of the receptacle electrical connector 1*b* is as follows: firstly inserting the first and second terminals 12*b* and 13*b* into the first body 11*b* in a direction of from rear to front; and then inserting the terminal protecting seat 181*b* on the rear end of the first body 11*b* in a direction of from rear to front; and aligning the first retention element 15*b* with the soldering portions of those terminals and inserting the first retention element 15*b* in a direction of from lower to upper, and combining the first retention element 15*b* with the first body 11*b* and the terminal protecting seat 181*b*, finally, covering the first cage 14*b* onto the above parts in a direction of from front to rear.

As compared with the conventional connector, in addition to the advantageous effects of the first embodiment, the receptacle electrical connector 1*b* in accordance with the third embodiment of the present disclosure has the following advantageous effects: the terminals 12*b*, 13*b* can be ensured to extend longer and not easily bend when side-mounting by mounting the terminal protecting seat 181*b* on the rear end of the first body 11*b*.

A fourth embodiment of the receptacle electrical connector is shown in FIGS. 32-38 and includes a receptacle electrical connector 1*c* adapted to be side-mounted on a corresponding circuit board (not shown). The receptacle electrical connector 1*c* comprises a first body 11*c*, a plurality of first terminals 12*c* and two second terminals 13*c* mounted on the first body 11*c*, a first cage 14*c* mounted on an outside of the first body 11*c*.

The first body 11*c* comprises a first main body portion 111*c*, a first tongue 112*c* and a second tongue 113*c* extending forward from the first main body 111*c*. The first tongue 112*c* comprises a base 1121*c* in a plate shape and two keying ribs 1122*c* protruding toward left side from two side edges of top and bottom of the base 1121*c* respectively. The base 1121*c* of the first tongue 112*c* comprises a first surface 1128*c* and a second surface 1129*c* opposite with each other. The first surface 1128*c* is configured to face rightward and the second surface 1129*c* is configured to face leftward. Each of the first and second surfaces 1128*c* and 1129*c* is provided with a plurality of first receiving slots 1123*c*.

The first and second tongue 112*c* and 113*c* are configured to be parallel with each other and arranged in a left side and right side relationship. The first tongue 112*c* has a width W1 larger than that W2 of the second tongue 113*c*. Two second receiving slots 1131*c*, 1132*c* are provided in a surface facing leftward of the second tongue 113*c*.

Each of the first terminals 12*c* has a mating portion 121*c* in a plate shape and a soldering portion 122*c*. The mating portions 121*c* of the first terminals 12*c* are provided in first receiving slots 1123*c* of the first tongue 112*c*, for transmitting high definition video signals. The mating portions 121*c* of the first terminals 12*c* located on the first surface 1128*c* of the first tongue 112*c* are offset relative to those on the second surface 1129*c* of the first tongue 112*c*, that is, the mating portions 121*c* are not faced with each other in a left side and right side direction.

Each of the second terminals 13*c* comprises a mating portion 131*c* in a plate shape and a soldering portion 132*c*. The two second conductive electrical terminals 13*c* are received into the two receiving slots 1131*c*, 1132*c* respectively. One second terminal 13*c* received in the corresponding second receiving slot 1131*c* is used to connect with the negative pole of the power source, and the other second terminal 13*c* is used to connect with the positive pole of the power source. A distal of the mating portion 131*c* of the one second terminals 13*c* connected to the negative pole of the power source is located at a position closer to the front compared with a distal of the mating portion 131*c* of the other second terminals 13*c* connected to the positive pole of the power source. The two second terminals 13*c* are used to transmit the power required by the display device, so as to save one separate power cable of the display device. In addition, the distance between the two soldering portions 132*c* is larger than that between the two mating portions 131*c* of the two second terminals 13*c*.

In the present embodiment, the main body portion 111*c* of the first body 11*c* comprises a first body assembly 1821*c* and a second body 1857*c* coupling with each other. The first tongue 112*c* extends forward from the first body assembly 1821*c*, and the second tongue 113*c* extends forward from the second body 1857*c*. The first terminal 12*c* is partly insert-molded in the first body assembly 1821*c*.

A receiving slot 1838*c* in which two hooks 1843*c* are provided is formed in the first body assembly 1821*c*. The second body 1857*c* is provided with two snap grooves 1859*c* which are clasped with the two hooks 1843*c*, such that the second body 1857*c* is received into the receiving slot 1838*c*.

Figure 37:
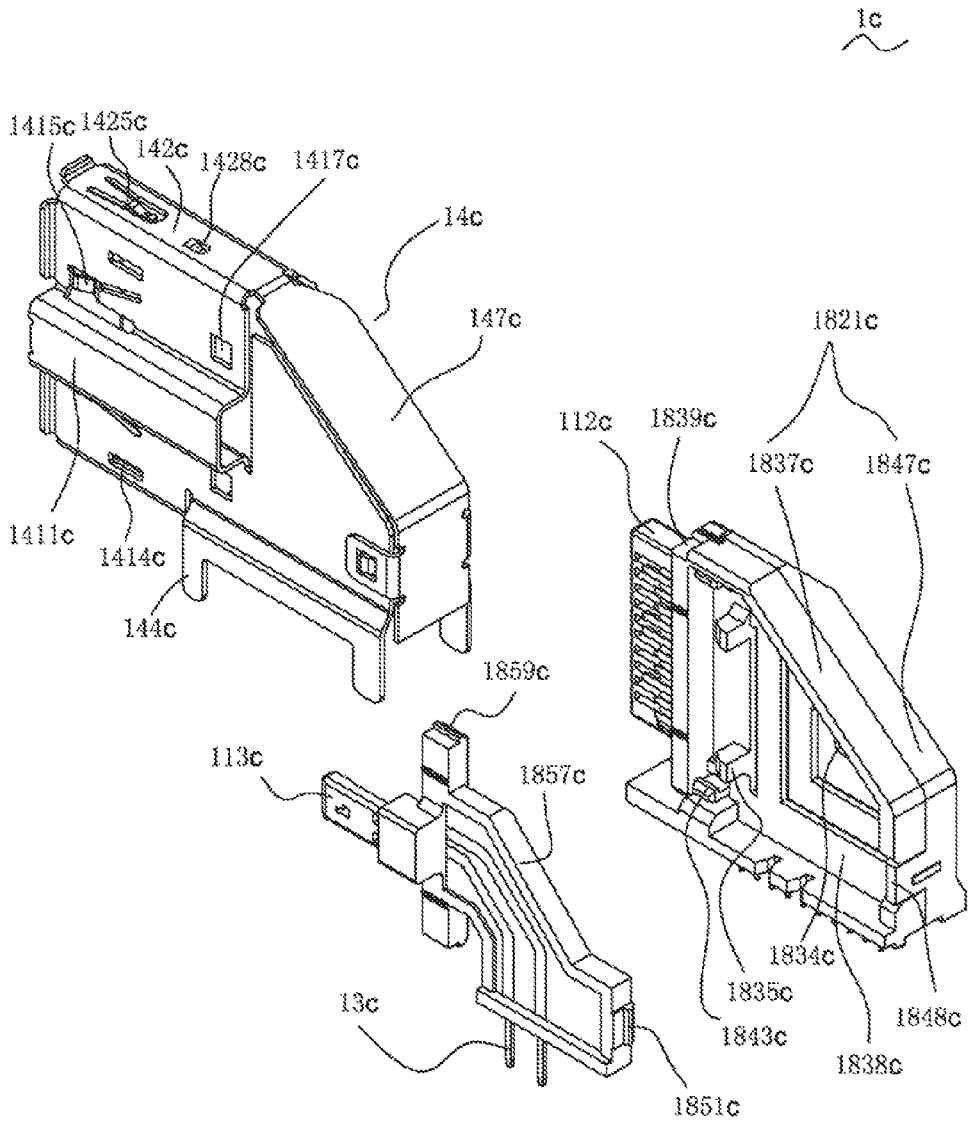
FIG. 37 is a further exploded perspective view of a fourth embodiment of a receptacle electrical connector.
Figure 38:
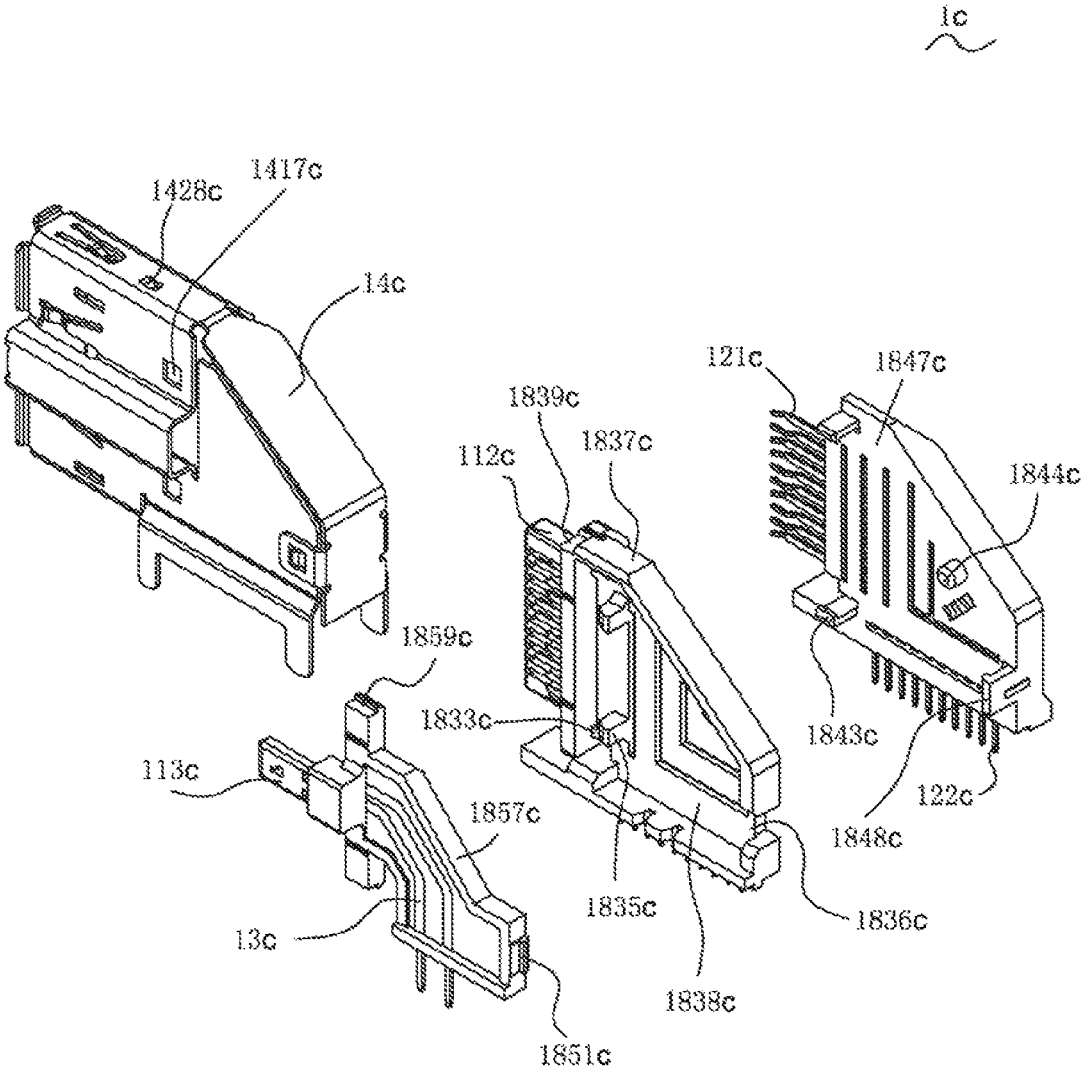
FIG. 38 is a further exploded perspective view on the basis of FIG. 37.
Figure 39:
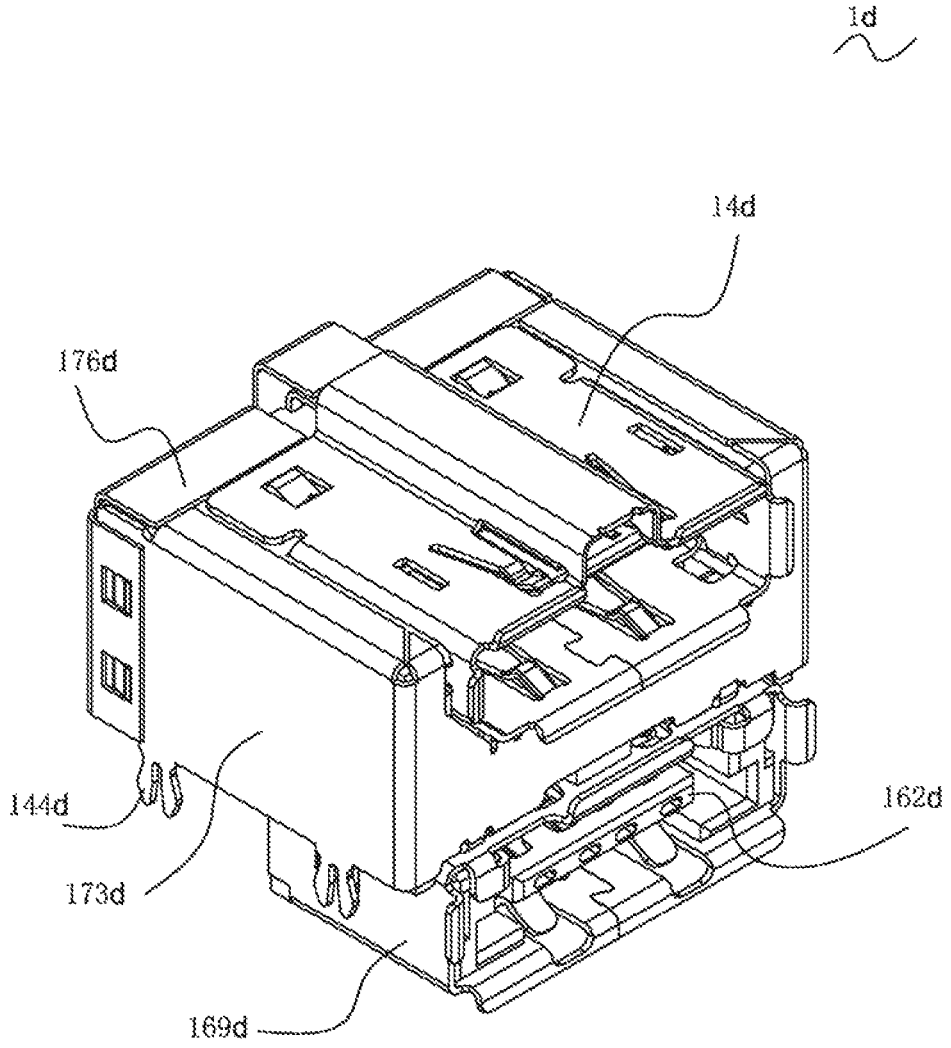
FIG. 39 is a perspective view of a fifth embodiment of a receptacle electrical connector.

The first body assembly 1821*c* can be configured in many different structures, in the present embodiment, as shown in FIGS. 37 and 38, the first body assembly 1821*c* comprises a first body 1837*c* and a third body 1847*c* coupled with each other. The first tongue 112*c* extends forward from the first body 1837*c*. The plurality of first terminals 12*c* are divided into a first row of first terminals which are partly insert-molded in the first body 1837*c*, and a second row of first terminals which are partly insert-molded in the third body 1847*c*, the mating portions 121*c* of the first row are inserted-molded into the first receiving slots 1123*c* in the first surface 1128*c* of the first tongue 112*c*, the mating portions 121*c* of the second row are inserted into the first receiving slots 1123*c* in the second surface 1129*c* of the first tongue 112*c*. A second retention portion 1839*c* is provided at the top of the first body assembly 1821*c*.

As for the embodiment shown in FIG. 38, two hooks 1843*c* are provided in the third body 1847*c*. The above receiving slot 1838*c* in which perforations 1833 for inserting the two hooks 1843*c* are provided is formed in the first body 1837*c*. The third body 1847*c* is provided with a retention portion 1844*c*, and the first body 1837*c* is provided with a retention coupling portion 1834*c* which is coupled with the retention portion 1844*c* to realize the relative fixation between the first body 1837*c* and the third body 1847*c*. The above second retention portion 1839*c* is provided at the top of the first body 1837*c*.

In addition, the third body 1847*c* is further provided with a third hook 1848*c*. The first body 1837*c* is provided with a notch 1836*c* for avoiding interference with the third hook 1848*c*. The second body 1857*c* is also provided with a third snap groove 1851*c* for mating with the third hook 1848*c* on the rear end of the second body. Own to the above structure, the connection between the second body 1857*c* and the first body assembly 1821*c* is more reliable.

The first cage 14*c* encloses the first and second tongue 112*c* and 113*c* to form a first receiving chamber 145*c*. A first mating chamber 1451*c* enclosing the first tongue 112*c* is formed around the first tongue 112*c*, in which a standard DP plug can be inserted. A second mating chamber 1452*c* enclosing the second tongue 113*c* is formed around the second tongue 113*c*. The first mating chamber 1451*c* has a width larger than that of the second mating chamber 1452*c*. The first and second mating chambers 1451*c* and 1452*c* are stacked and communicated with each other to form the first receiving chamber 145*c*. In details, the first cage 14*c* is formed by pressing a metal plate and has a shape with a small upper portion and a larger lower portion.

The first cage 14*c* comprises a right side plate 141*c*, a top plate 142*c* and a bottom plate 142*c* bending and extending leftward in a horizontal direction from top and bottom of the right side plate 141*c* respectively, a left side plate 143*c* formed by further vertically bending and extending the top plate 142*c* and the bottom plate 142*c* toward each other and then engaging with each other, and an extension 147*c* formed by extending backwardly and combining the right side plate 141*c*, left side plate 143*c* and the top plate 142*c*. The extension 147*c* covers the rear ends of the first body 11*c* and has four fixing foots 144*c* extending downward.

An arching portion 1411*c* in an invert U shape protrudes rightward from a middle of the right side plate 141*c*. The right side plate 141*c* is provided with a hole 1414*c* on each of the upper and lower sides of the arching portion 1411*c*. The arching portion 1411*c* is provided with a mounting portion 1417*c* on each side thereof. Similarly, the right side plate 143*c* is also provided with two mounting portions 1437*c*. Those mounting portions 1417*c*, 1437*c* can be mated with the clasp portions 1835*c*, 1845*c* of the first body 11*c*, for fixing the first body 11*c* onto the first cage 14*c*. In addition, the top plate 142*c* is provided with a limiting portion 1428*c* which can be mated with the second retention portion 1839*c* of the first body 11*c* to orientate the first body 11*c* at the rear end of the first cage 14*c*.

In addition, the right side plate 141*c* is provided with a flexible clasp arm 1415*c* extending from rear to front on each upper and lower sides of the arching portion 1411*c*. The left side plate 143*c* is provided with a flexible clasp arm 1435*c* extending from rear to front on each of the upper and lower portion thereof. Each of the top and bottom plates 142*c* is provided with a flexible clasp arm 1425*c* extending from front to rear. Those elastic arms 1414*c*, 1425*c*, 1435*c* can be clasped on the different sides and positions in different depths of the mating electrical connector to improve the engaging strength.

The assembly procedure of the receptacle electrical connector 1*c* is as follows: firstly molding the first body 1837*c*, the second body 1857*c* and the third body 1847*c* on the periphery of the two rows first terminals 12*c* and the second terminals 13*c* respectively by using the insert-molded technology; then assembling the first body 1837*c* and the third body 1847*c* to form a first body assembly 1821*c*; and then assembling the first body assembly 1821*c* and the second body 1857*c* to form the first main body portion 111*c* of the first body 11*c*; and finally, covering the first cage 14*c* onto the first body 11*c* in a direction of from front to rear.

As compared with the conventional connector, in addition to the advantageous effects of the first embodiment, the receptacle electrical connector 1*c* in accordance with the fourth embodiment of the present disclosure has the following advantageous effects: the terminals 12*c*, 13*c* can be ensured to extend longer and not easily bend and suitable to be side-mounted, this is because the first main body portion 111*c* of the first body 11*c* is divided into the first body 1837*c*, the second body 1857*c* and the third body 1847*c* which can be coupled and assembled together, and the above terminals 12*c*, 13*c* can be fixed on the above different bodies 1837*c*, 1847*c*, 1857*c* by using the insert-molded technology.

A fifth embodiment of the receptacle electrical connector is shown in FIGS. 39-45 and comprises a HPDP (High Power Display Port) receptacle opening with power supply on the upper side, and an ESATA receptacle opening on the lower side. The receptacle electrical connector 1*d* comprises a first body 11*d*; a plurality of first terminals 12*d*, two second terminals 13*d* and a plurality of fifth terminals 167*d* mounted on the first body 11*d*; a first cage 14*d*, a third cage 169*d*, an outer cage 173*d*, and a rear cage 176*d* mounted on the first body 11*d*; a first retention element 15*d* mounted on a bottom of the rear end of the first body 11*d*; and a spacer element assembly 178*d* mounted among the terminals.

Figure 41:
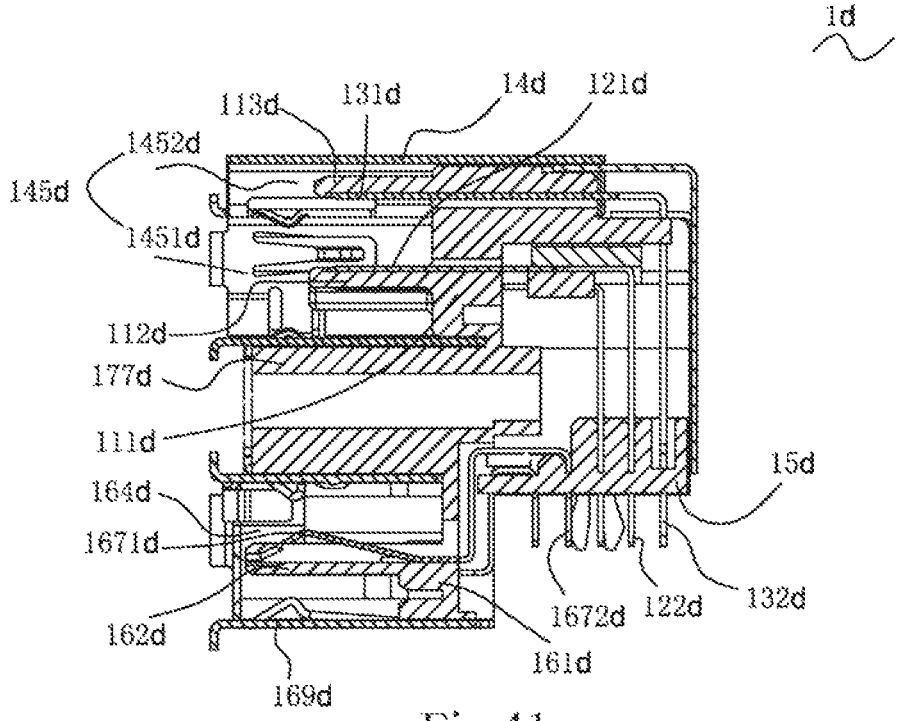
FIG. 41 is a section view in an A-A direction in FIG. 40.

As shown in FIG. 41, the first body 11*d* comprises a first main body portion 111*d*, a first tongue 112*d* and a second tongue 113*d* extending forward from the first main body 111*d*, a supporting portion 177*d* extending forwardly from the first main body portion 111*d*, a third main body portion 161*d* extending downwardly from the supporting portion 177*d*, and a third tongue 162*d* extending forwardly from the third main body portion 161*d*. The first main body portion 111*d* has a clasp portion 1119*d* protruding upward from the top thereof. The supporting portion 177*d* comprises two opposite side walls 1772*d* and a partition wall 1773*d* connected between the bottoms of the two side walls 1772*d*.

Figure 40:
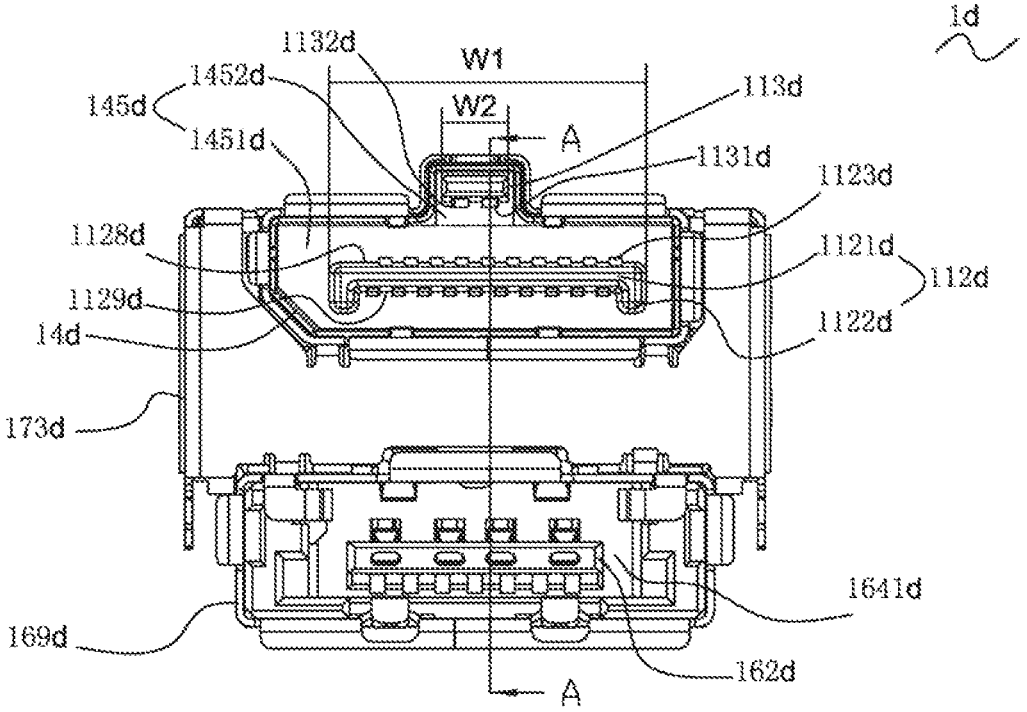
FIG. 40 is a front view of a fifth embodiment of a receptacle electrical connector.

As shown in FIG. 40, the first tongue 112*d* comprises a base 1121*d* in a plate shape and two keying ribs 1122*d* protruding downward from left and right side edges of the base 1121*d* respectively. The base 1121*d* of the first tongue 112*d* comprises a first surface 1128*d* and a second surface 1129*d* opposite with each other. The first surface 1128*d* is configured to face upward and the second surface 1129*d* is configured to face downward. Each of the first and second surfaces 1128*d* and 1129*d* is provided with a plurality of first receiving slots 1123*d*. The first tongue 112*d* can be mated with a standard DP (Display Port) type plug electrical connector.

The first and second tongue 112*d* and 113*d* are configured to be parallel with each other and arranged in an upper and lower relationship. The first tongue 112*d* has a width W1 larger than that W2 of the second tongue 113*d*. Two second receiving slots 1131*d*, 1132*d* are provided in the lower surface of the second tongue 113*d*.

A plurality of fifth receiving slots 1621*d* are provided in at least one surface of the third tongue 162*d*. In the present embodiment, the third tongue 162*d* can be mated with the standard ESATA plug electrical connector.

As shown in FIGS. 40 and 41, the first terminals 12*d* can be divided into upper and lower rows. Each of the first terminals 12*d* has a mating portion 121*d* in a plate shape and a soldering portion 122*d*. The mating portions 121*d* of the first terminals 12*d* are provided in first receiving slots 1123*d* of the first tongue 112*d*, for transmitting high definition video signals. The mating portions 121*d* of the first terminals 12*d* located on the upper surface 1128*d* of the first tongue 112*d* are offset relative to those on the lower surface 1129*d* of the first tongue 112*d*, that is, the mating portions 121*d* in the upper row are not faced or aligned with those in the lower row.

Figure 44:
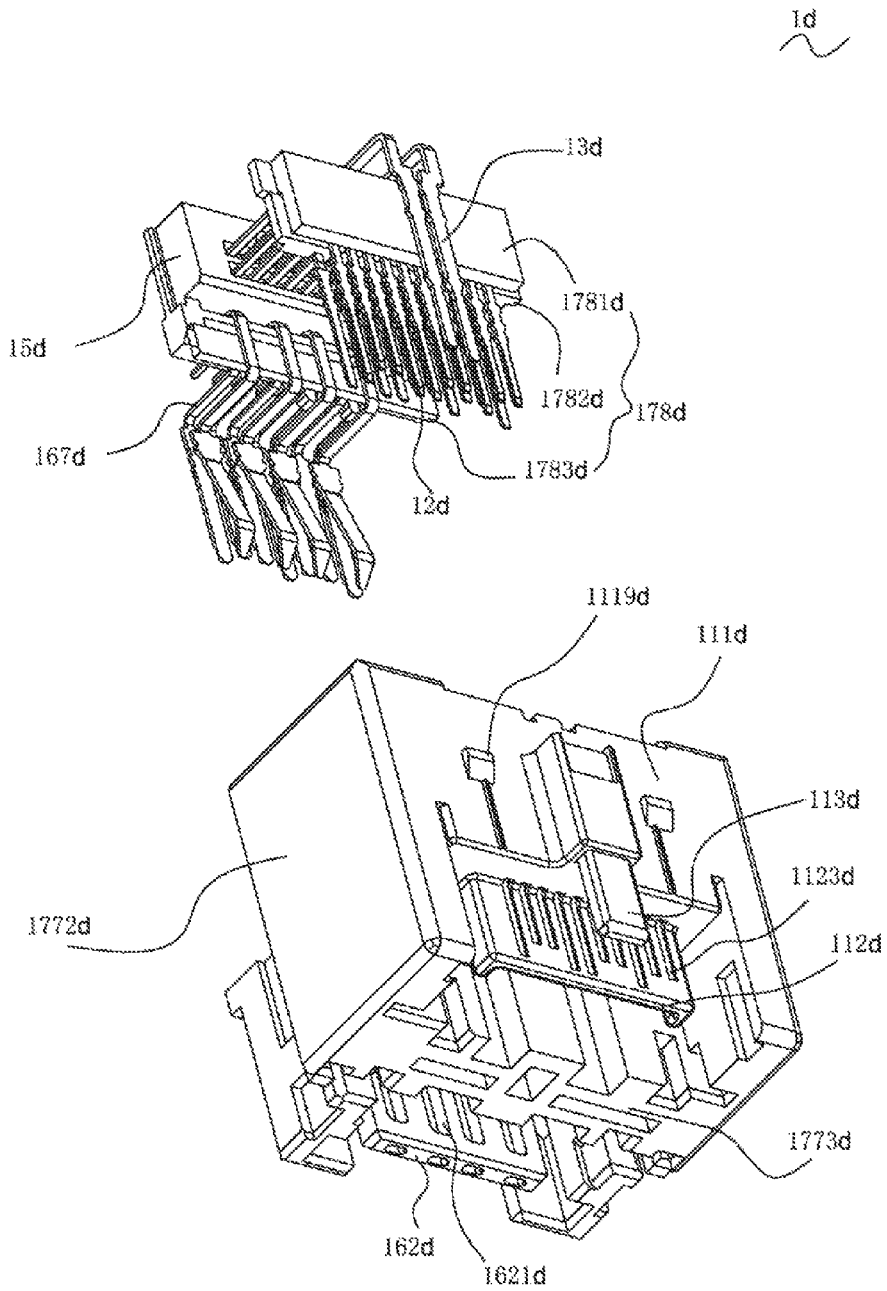
FIG. 44 is an exploded perspective view of a fifth embodiment of a receptacle electrical connector after removing a cage.

Please also see FIG. 44, each of the second terminals 13*d* comprises a mating portion 131*d* in a plate shape and a soldering portion 132*d*. One second terminal 13*d* is used to connect with the negative pole of the power source, and the other second terminal 13*d* is used to connect with the positive pole of the power source. A distal of the mating portion 131*d* of the one second terminal 13*d* connected to the negative pole of the power source is located at a position closer to the front compared with a distal of the mating portion 131*d* of the other second terminal 13*d* connected to the positive pole of the power source. The two second terminals 13*d* are used to transmit the power required by the display device, so as to save one separate power cable of the display device. In addition, the distance between the two soldering portions 132*d* is larger than that between the two mating portions 131*d* of the two second terminals 13*d*.

Figure 45:
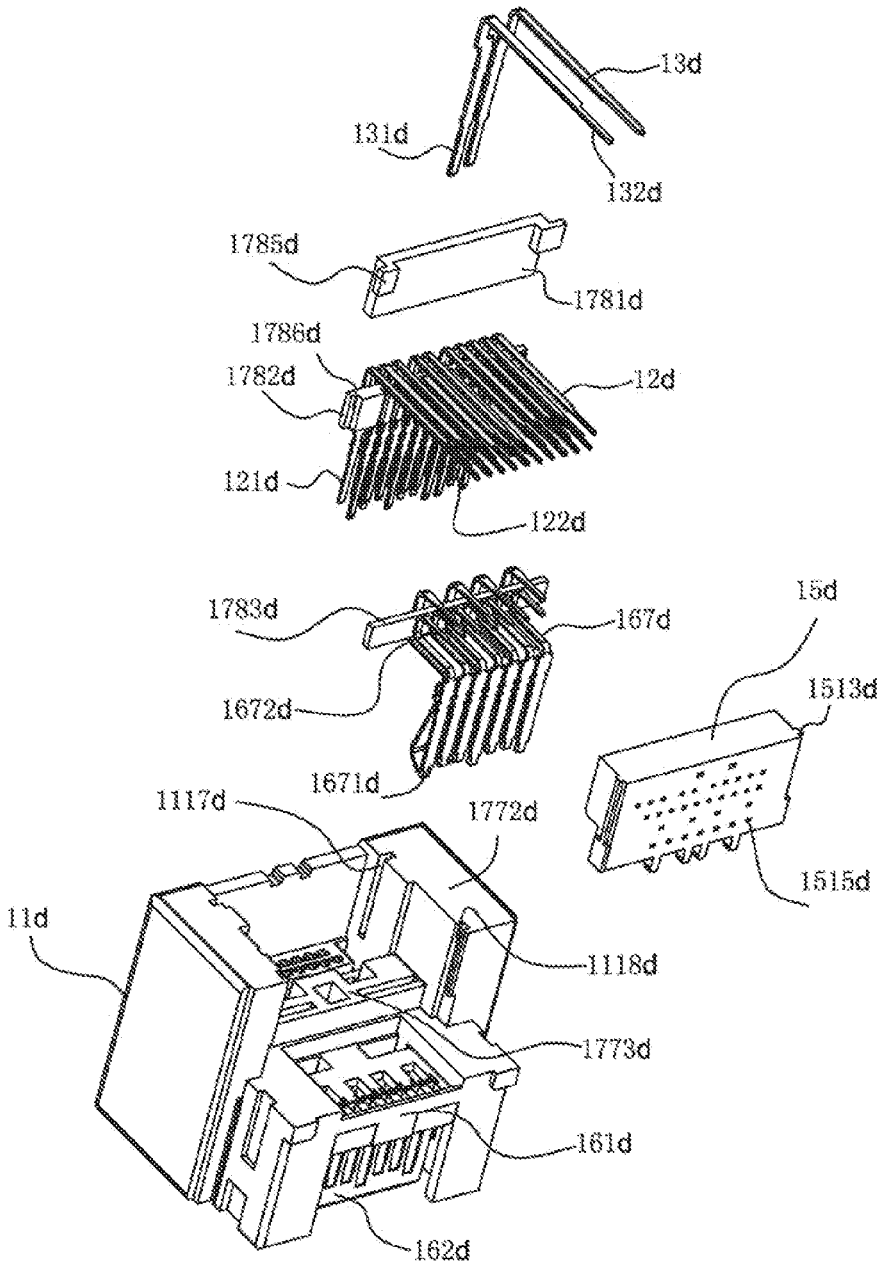
FIG. 45 is a further exploded perspective view on the basis of FIG. 44.
Figure 46:
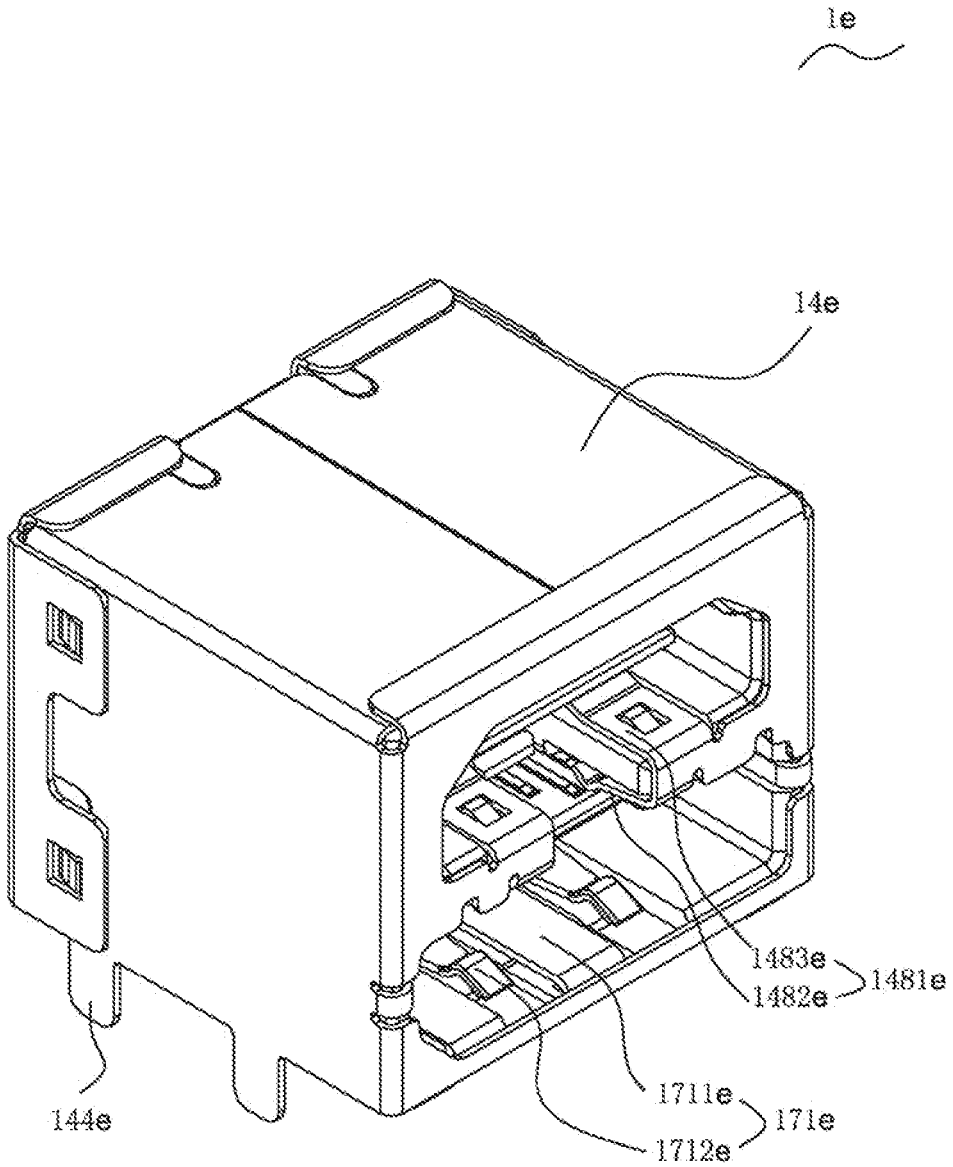
FIG. 46 is a perspective view of a sixth embodiment of a receptacle electrical connector.

As shown in FIG. 45, the fifth terminals 167*d* are divided into upper and lower rows. Each of the fifth terminals 167*d* comprises a mating portion 1671*d* and a soldering portion 1672*d*. The mating portions 1671*d* of the upper row of fifth terminals 167*d* are elastic and have an arc shape, the mating portions 1671*d* of the lower row of fifth terminals 167*d* have a plate shape.

Figure 42:
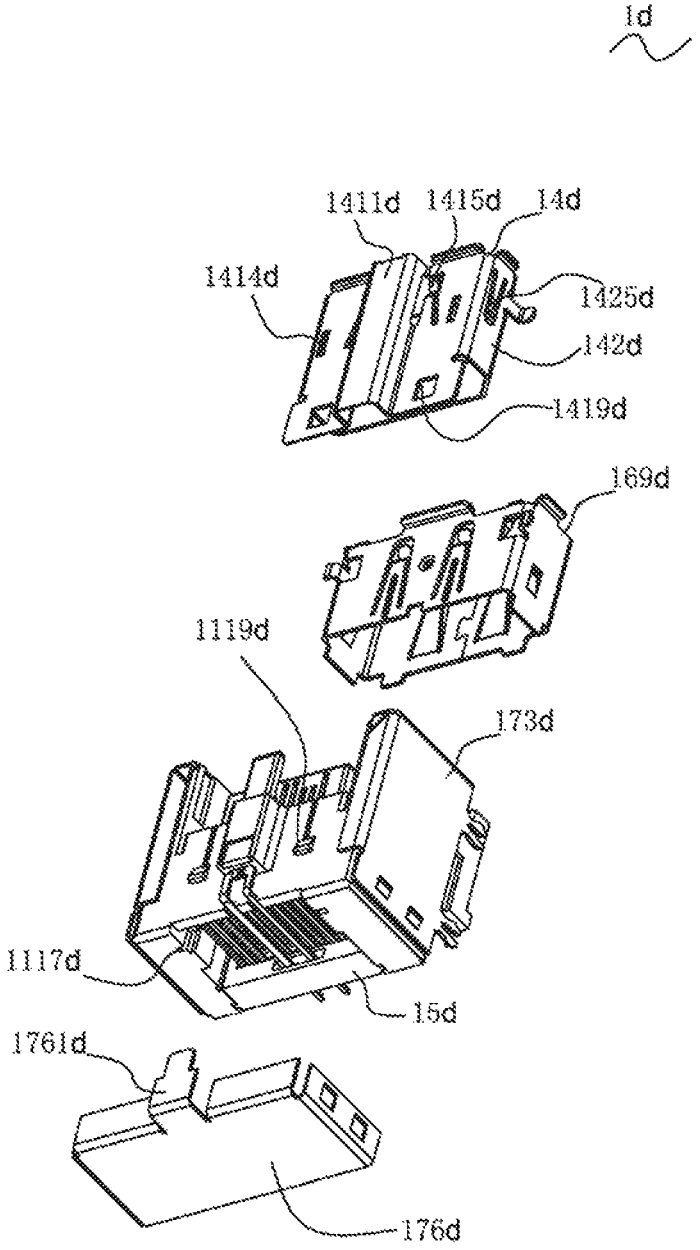
FIG. 42 is an exploded perspective view of a fifth embodiment of a receptacle electrical connector.
Figure 43:
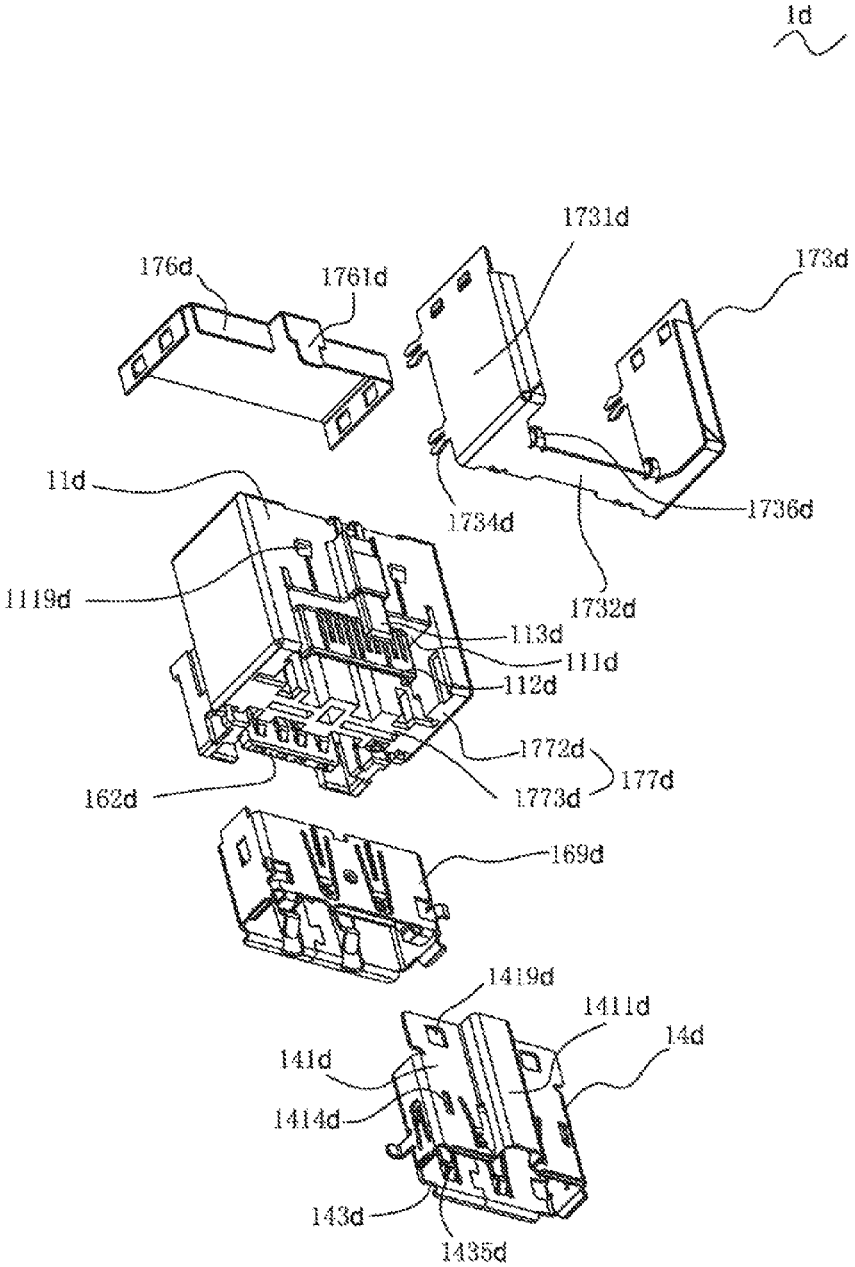
FIG. 43 is a further exploded perspective view on the basis of FIG. 42.

As shown in FIG. 40, the first cage 14*d* encloses the first and second tongue 112*d* and 113*d* to form a first receiving chamber 145*d*. A first mating chamber 1451*d* enclosing the first tongue 112*d* is formed around the first tongue 112*d*, in which a standard DP plug can be inserted. A second mating chamber 1452*d* enclosing the second tongue 113*d* is formed around the second tongue 113*d*. The first mating chamber 1451*d* has a width larger than that of the second mating chamber 1452*d*. The first and second mating chambers 1451*d* and 1452*d* are stacked and communicated with each other to form the first receiving chamber 145*d*. In details, as shown in FIGS. 42 and 43, the first cage 14*d* is formed by pressing a metal plate and has a shape with a small upper portion and a larger lower portion. The first cage 14*d* comprises a top plate 141*d*, two side plates 142*d* bending and extending downward from left and right sides of the top plate 141*d*, a bottom plate 143*d* formed by horizontally bending and extending the two side plates 142*d* toward each other and then engaging with each other. An arching portion 1411*d* in an invert U shape extends upward from a middle of the top plate 141*d*. The top plate 141*d* is provided with a mounting portion 1419*d* corresponding to the clasp portion 1119*d* in the body 11*d* at the rear end of the top plate, such that the first cage 14*d* can be fixed on the first body 11*d*. The top plate 141*d* is provided with a hole 1414*d* on each of left and right sides of the arching portion 1411*d*. The top plate 141*d* is also provided with a flexible clasp arm 1415*d* extending from rear to front on each left and right sides of the arching portion 1411*d*. The bottom plate 143*d* is provided with a flexible clasp arm 1435*d* extending from rear to front on each of the left and right portions thereof. Each of the two side plates 142*d* is provided with a flexible clasp arm 1425*d* extending from front to rear. Those elastic arms 1415*d*, 1425*d*, 1435*d* can be clasped on the different sides and positions in different depths of the plug electrical connector to improve the engaging strength.

As shown in FIGS. 40 and 41, the third cage 169*d* encloses the third tongue 162*d* to form a third receiving chamber 164*d*. The third receiving chamber 164*d* comprises a fifth mating chamber 1641*d* enclosing the third tongue 162*d* for inserting a standard ESATA plug into the fifth mating chamber 1641*d*.

The outer cage 173*d* is mounted on the two side walls 1772*d* and a partition wall 1773*d* of the supporting portion 177*d*, and comprises two opposite side plates 1731*d*, a front plate 1732*d* connected the lower portions of the front ends of the two side plates 1731*d* and a plurality of fixing foots 1734*d* extending downward from the two side plates 1731*d*. The two side plates 1731*d* cover the outer of the two side walls 1772*d* of the supporting portion 177*d*, and the front plate 1732*d* covers the front end of the partition wall 1773*d* of the supporting portion 177*d*. Two clasp arms 1736*d* is bending and extending backwardly from the upper and lower sides of the front plate 1732*d* respectively, so as to clasp the front end of the partition wall 1773*d* of the supporting portion 177*d*. In addition, the two upper clasp arms 1736*d* can abut against the bottom plate 143*d* of the first cage 14*d* located above the supporting portion 177*d*, and the two lower clasp arms 1736*d* can abut against the top portion of the third cage 169*d* located below the supporting portion 177*d*. Therefore, the three cages 14*d*, 169*d*, 173*d* can be electrically connected together, and then connected with the grounded circuit on the circuit board (not shown) via fixing foots 1734*d*, so as to realize the grounding of the three cages 14*d*, 169*d*, 173*d*.

As shown in FIG. 43, the back cage 176*d* clasps the rear end of the out cage 173*d*, in which the rear ends of the first terminals 12*d*, the second terminals 13*d* and the fifth terminals 167 are received. The back cage 176*d* is provided with a brim 1761*d* on the top end thereof. The front end of the brim 1761*d* is joined with the rear end of the arching portion 1411*d* of the first cage 14*d*, so as to cover the two second terminals 13*d*.

As shown in FIG. 44, the spacer element assembly 178*d* comprises a first spacer element 1781*d*, a second spacer element 1782*d* and a third spacer element 1783*d*. The first spacer element 1781*d* is provided between the second terminals 13*d* and the upper row of first terminals 12*d*, the second spacer element 1782*d* is provided between the two rows of first terminals 12*d*, the third spacer element 1783*d* is provided between the two rows of fifth terminals 167*d*. The first spacer element 1781*d* is provided with a flange 1785*d* on each of left and right sides thereof, and the second spacer element 1782*d* is also provided with a flange 1786*d* on each of left and right sides thereof. Those flanges 1785*d*, 1786*d* are mounted into a sliding groove 1117*d* located on the rear end of the first body 11*d*.

The first retention element 15*d* is mated with the first terminals 12*d*, the second terminals 13*d* and the fifth terminals 167*d*, so as to prevent the soldering portions of those terminals from bending. In details, as shown in FIG. 45, the first retention element 15*d* is provided with a plurality of perforations 1515*d* for inserting the soldering portions of the first terminals 12*d*, the second terminals 13*d* and the fifth terminals 167*d*. The first retention element 15*d* is also provided with a holding portion 1513*d* on each side thereof, to be fixed on the mounting portion 1118*d* on the rear end of the first body 11*d*.

The assembly procedure of the receptacle electrical connector 1*d* is as follows: inserting the above terminals 12*d*, 13*d*, 167*d* and the above spacer elements 1781*d*, 1782*d*, 1783*d* into the first body 11*d* in a direction of from rear to front; and aligning the first retention element 15*d* with the soldering portions 122*d*, 132*d*, 1672*d* of those terminals and inserting the first retention element 15*d* into the mounting portion 1118*d* of the first body 11*d* in a direction of from lower to upper; inserting the outer cage 173*d* into the first body 11*d* in a direction of from front to rear, and then fixing the back cage 176*d* on the rear end of the outer cage 173*d*, and finally inserting the first cage 14*d* and the third cage 169*d* onto the first body 11*d* in a direction of from front to rear.

As compared with the conventional connector, the receptacle electrical connector 1*d* in accordance with the third embodiment has the following advantageous effect: the structure strength of the first cage 14*d* can be enhanced to avoid breaking and distortion by the supporting portion 177*d* extending from the first body 11*d* and supporting the bottom and two sides of the first cage 14*d*. In addition, another receptacle opening is added to provide a connector with more function by providing the third main body portion 161*d*, the third tongue 162*d*, the fifth terminals 167*d* and the third cage 169*d*.

A sixth embodiment of the receptacle electrical connector is shown in FIGS. 46-51 and comprises a HPDP (High Power Display Port) receptacle opening with power supply, and an HDMI receptacle opening with power supply. The two receptacle openings are partly overlapped, so as to share power transmission.

The receptacle electrical connector 1*e* comprises a first body 11*e*; a plurality of first terminals 12*e*, two second terminals 13*e* and a plurality of fifth terminals 167*e* mounted on the first body 11*e*; two elastic clasp elements 171*e* and two holding portions 172*e* mounted on the first body 11*e*; a first cage 14*e* mounted on the first body 11*e*; and a first retention element 15*e* mounted on a bottom of the rear end of the first body 11*d*.

Figure 49:
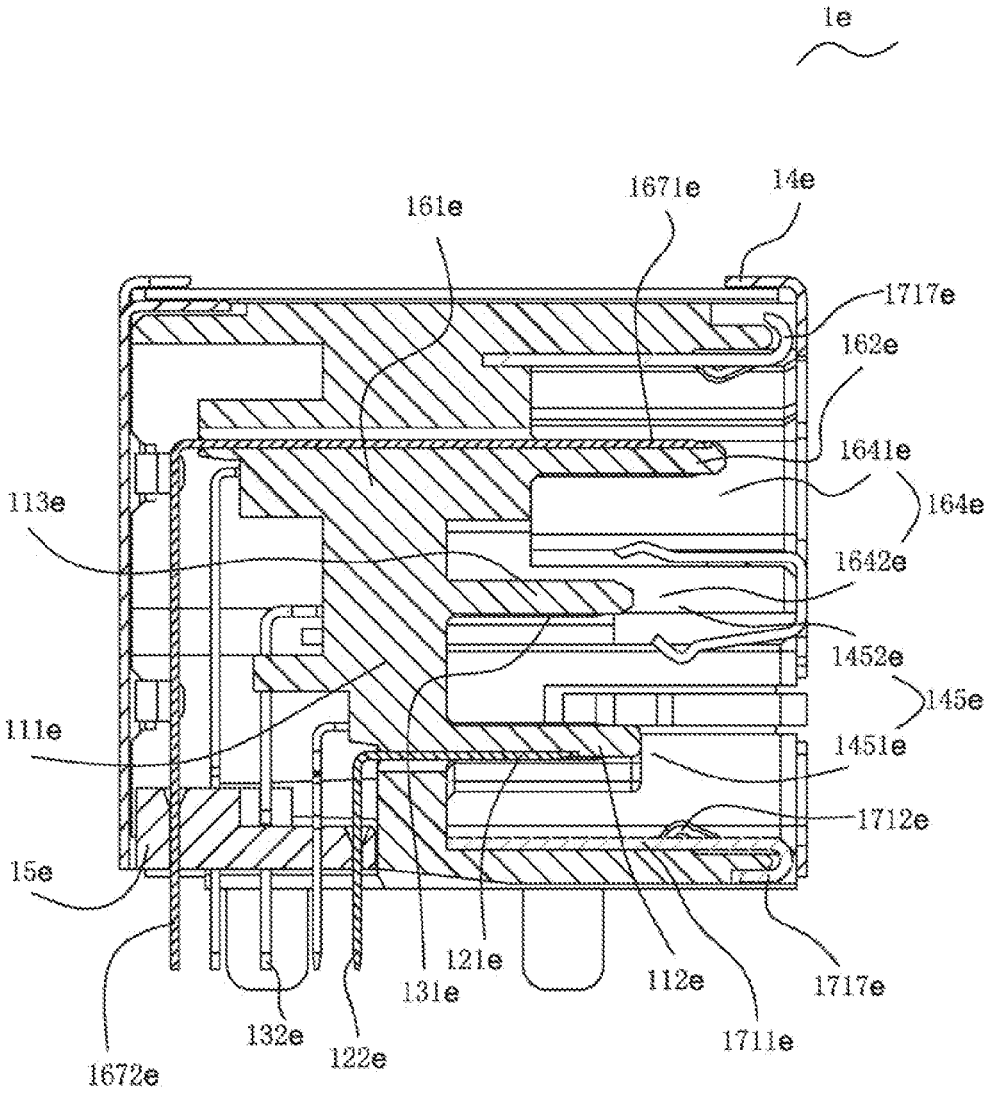
FIG. 49 is a sectional view in an A-A direction in FIG. 3.

As shown in FIG. 49, the first body 11*e* comprises a first main body portion 111*e*; a first tongue 112*e* and a second tongue 113*e* extending forward from the first main body 111*e*; a third main body portion 161*e* extending upwardly from the first main body portion 111*e*; and a third tongue 162*e* extending forwardly from the third main body portion 161*e*.

Figure 48:
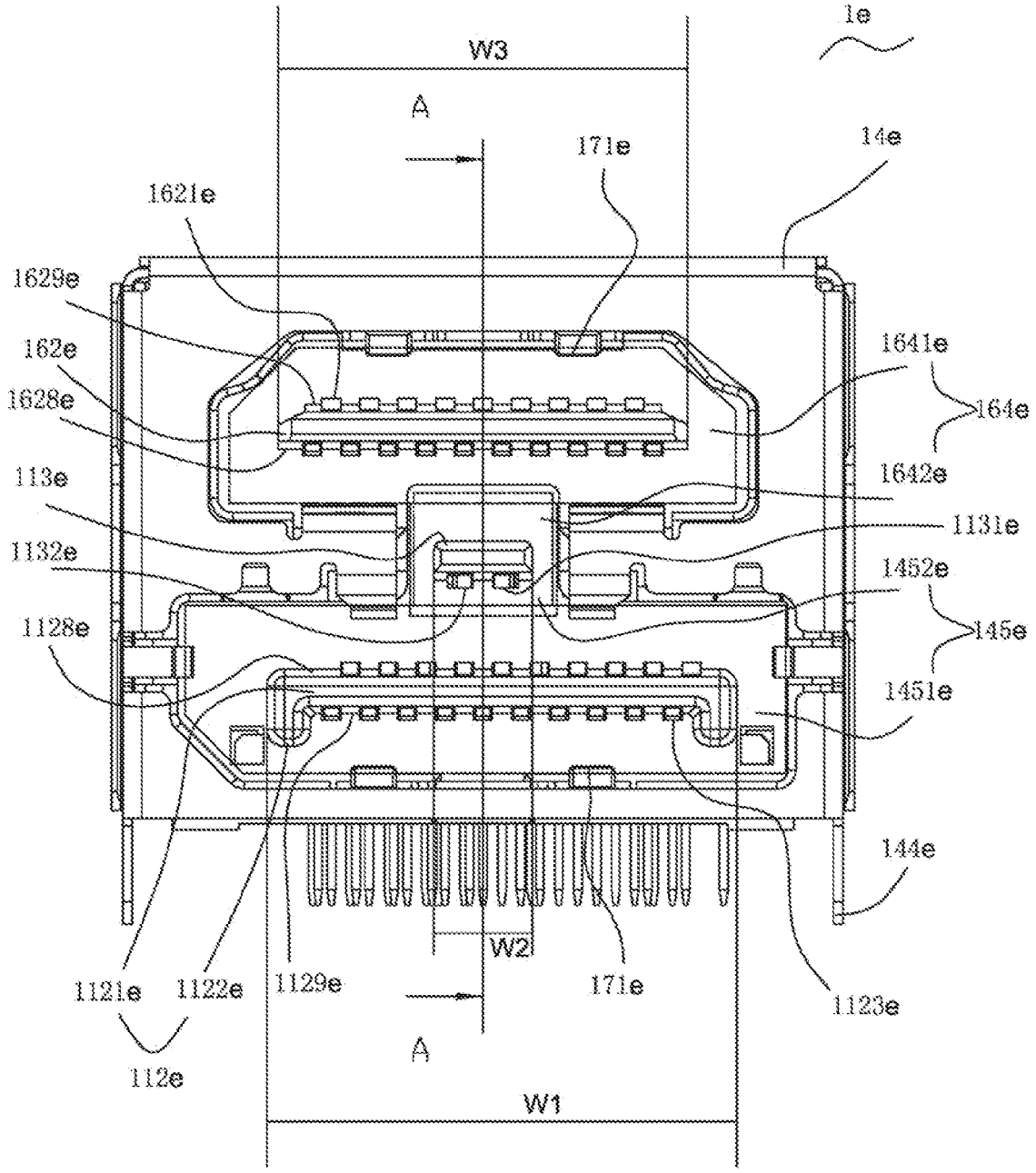
FIG. 48 is a front view of a sixth embodiment of a receptacle electrical connector.

As shown in FIG. 48, the first body 11*e* is provided with a first receiving chamber 145*e* recessed therein. The first receiving chamber 145*e* has a shape with a small upper portion and a large lower portion, and comprises a first mating chamber 1451*e* and a second mating chamber 1452*e* stacked and communicated with each other in an upper and lower direction. The first tongue 112*e* is located within the first mating chamber 1451*e* in which a standard DP (Display Port) is inserted. The second tongue 113*e* is located within the second mating chamber 1452*e*. The second mating chamber 1452*e* is located above the first mating chamber 1451*e* and has a much smaller width than that of the first mating chamber 1451*e*.

Similarly, the first body 11*e* is provided with a third receiving chamber 164*e* recessed therein. The third receiving chamber 164*e* has a shape with a large upper portion and a small lower portion, and comprises a fifth mating chamber 1641*e* and a sixth mating chamber 1642*e* stacked and communicated with each other in an upper and lower direction. The third tongue 162*e* is located within the fifth mating chamber 1641*e* in which a standard HDMI plug can be inserted. The inserted depth of the fifth mating chamber 1641*e* is different from that of the first mating chamber 1451*e*. The second tongue 113*e* is located within the sixth mating chamber 1642*e*. The sixth mating chamber 1642*e* is located under the fifth mating chamber 1641*e*, and has a much smaller width than that of the fifth mating chamber 1641*e*. The sixth mating chamber 1642*e* is overlapped with the second mating chamber 1452*e* around the second tongue 113*e*, such that the third receiving chamber 164*e* is partly overlapped with the first receiving chamber 145*e* to share the second tongue 113*e*.

The first tongue 112*e* comprises a base 1121*e* in a plate shape and two keying ribs 1122*e* protruding downwardly from left and right side edges of the base 1121*e* respectively. The base 1121*e* of the first tongue 112*e* comprises a first surface 1128*e* and a second surface 1129*e* opposite with each other. The first surface 1128*e* is configured to face upward and the second surface 1129*e* is configured to face downward. Each of the first and second surfaces 1128*e* and 1129*e* is provided with a plurality of first receiving slots 1123*e*. The first tongue 112*e* can be mated with a standard DP (Display Port) type plug electrical connector.

The first and second tongue 112*e* and 113*e* are configured to be parallel with each other and arranged in an upper and lower relationship. The first tongue 112*e* has a width W1 larger than that W2 of the second tongue 113*e*. Two second receiving slots 1131*e*, 1132*e* are provided in the lower surface of the second tongue 113*e*.

The third tongue 162*e* comprises a first surface 1628*e* and a second surface 1629*e* opposite with each other. The first surface 1628*e* is configured to face upward and the second surface 1629*e* is configured to face downward. Each of the first and second surfaces 1628*e* and 1629*e* is provided with a plurality of fifth receiving slots 1621*e*. The third tongue 162*e* can be mated with a standard HDMI type plug electrical connector.

Each of the first terminals 12*e* has a mating portion 121*e* in a plate shape and a soldering portion 122*e*. The mating portions 121*e* of the first terminals 12*e* are provided in first receiving slots 1123*e* of the first tongue 112*e*, for transmitting high definition video signals. The mating portions 121*e* of the first terminals 12*e* located on the upper surface 1128*e* of the first tongue 112*e* are offset relative to those on the lower surface 1129*e* of the first tongue 112*e*, that is, the mating portions 121*e* in an upper row are not faced or aligned with the mating portions 121*e* in a lower row.

Each of the second terminals 13*e* comprises a mating portion 131*e* in a plate shape and a soldering portion 132*e*. One second terminal 13*e* is used to connect with the negative pole of the power source, and the other terminal 13*e* is used to connect with the positive pole of the power source. A distal of the mating portion 131*e* of the one second terminal 13*e* connected to the negative pole of the power source is located at a position closer to the front compared with a distal of the mating portion 131*e* of the other second terminal 13*e* connected to the positive pole of the power source. The two second terminals 13*e* are used to transmit the power required by the display device, so as to save one separate power cable of the display device. In addition, the distance between the two soldering portions 132*e* is larger than that between the two mating portions 131*e* of the two second terminals 13*e*.

Each of the fifth terminals 167*e* comprises a mating portion 1671*e* in a plate shape and a soldering portion 1672*e*. The mating portions 1671*e* of the fifth terminals 167*e* are provided in the fifth receiving slots 1621*e* of the third tongue 162*e*, for transmitting high definition video signals. The mating portions 1671*e* of the first terminals 167*e* located on the upper surface 1628*e* of the third tongue 162*e* are offset relative to those on the lower surface 1629*e* of the third tongue 162*e*, such that the distance between the mating portions 1671*e* of the upper row of fifth terminals 167*e* and those of the lower row of fifth terminals 167*e* can be increased, thereby the signal interference during the high frequency data transmission can be reduced to improve the signal transmission quality.

The two elastic clasp elements 171*e* are mounted on the bottom of the first receiving chamber 145*e* and the top of the third receiving chamber 164*e* respectively. Each of the elastic clasp elements 171*e* has a mounting portion 1711*e* and two flexible clasp arms 1712*e* mounted on the first body 11*e*. In details, the mounting portion 1711*e* comprises a locking unit 1715*e* and two clasping units 1716*e*. The locking unit 1715*e* has a hook 1717*e* on its front end for clasping the groove 1117*e* in the first body 11*e*, and the clasping units 1716*e* are arranged on the rear end of the flexible clasp arms 1712*e* and have clasping portions 1718*e* for being inserted into the first body 11*e*.

Figure 47:
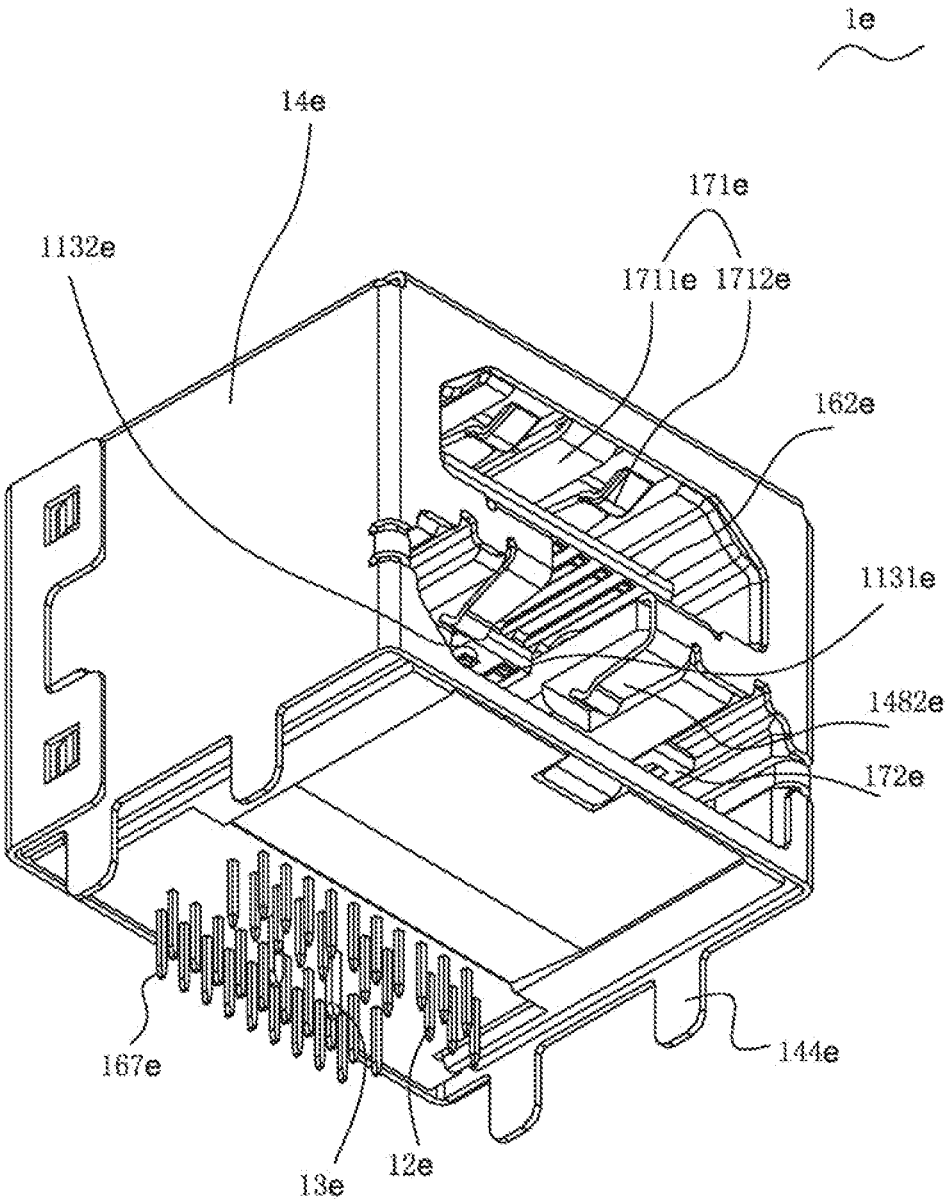
FIG. 47 is a perspective view of a sixth embodiment of a receptacle electrical connector in another view angle.
Figure 51:
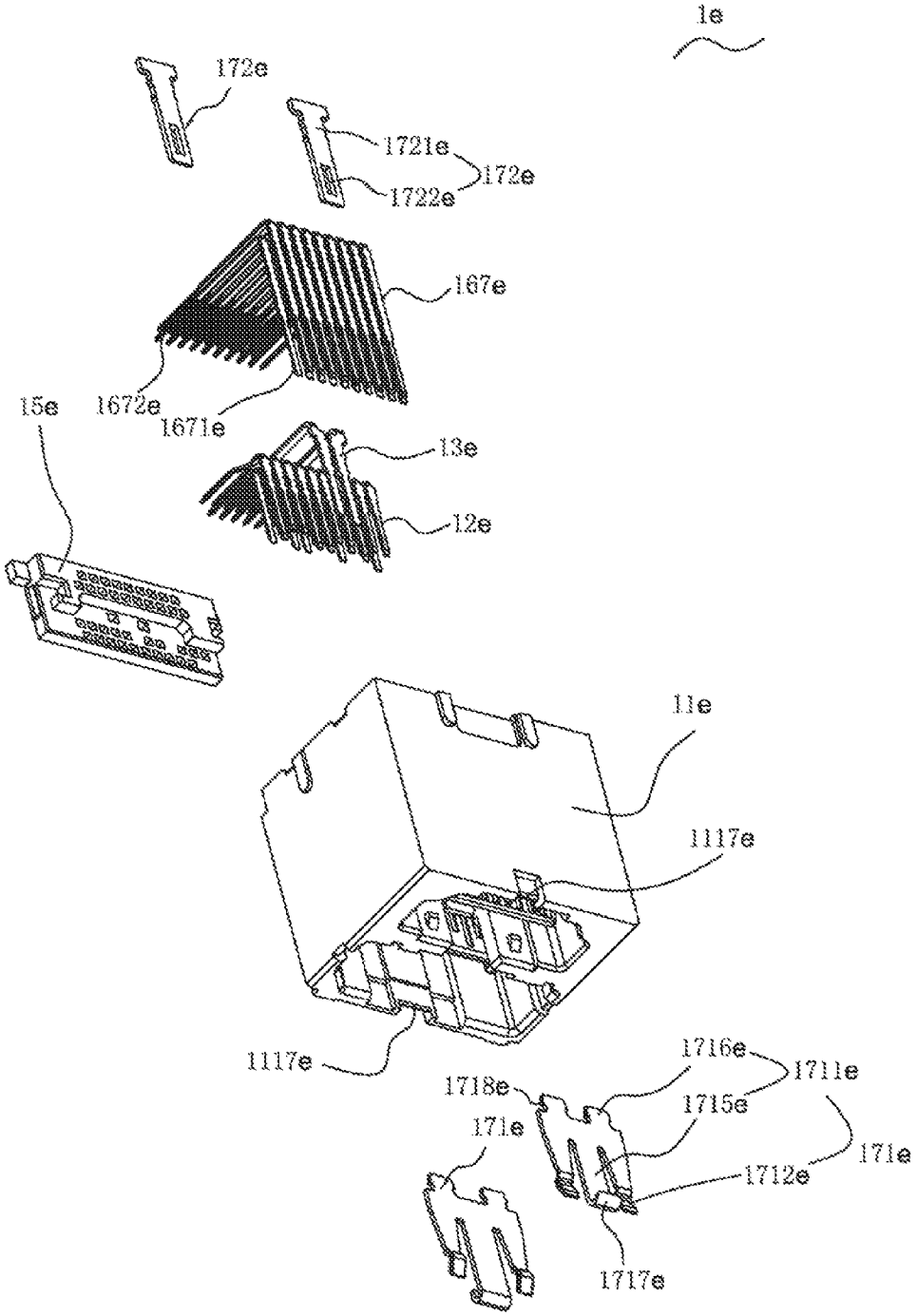
FIG. 51 is a further exploded perspective view of a sixth embodiment of a receptacle electrical connector, and wherein a first cage is omitted.

The two holding portions 172*e* are mounted on the top of the first mating chamber 1451*e* in the first receiving 145*e* (please see FIGS. 47 and 51). Each of the holding portions 172*e* is provided with a holding portion 1721*e* on its rear end for being fixed onto the first body 11*e*, and each of the holding portions 172*e* is provided with a holding hole 1722*e* on its front end for fitting with the hooks in the mating electrical connector.

Figure 50:
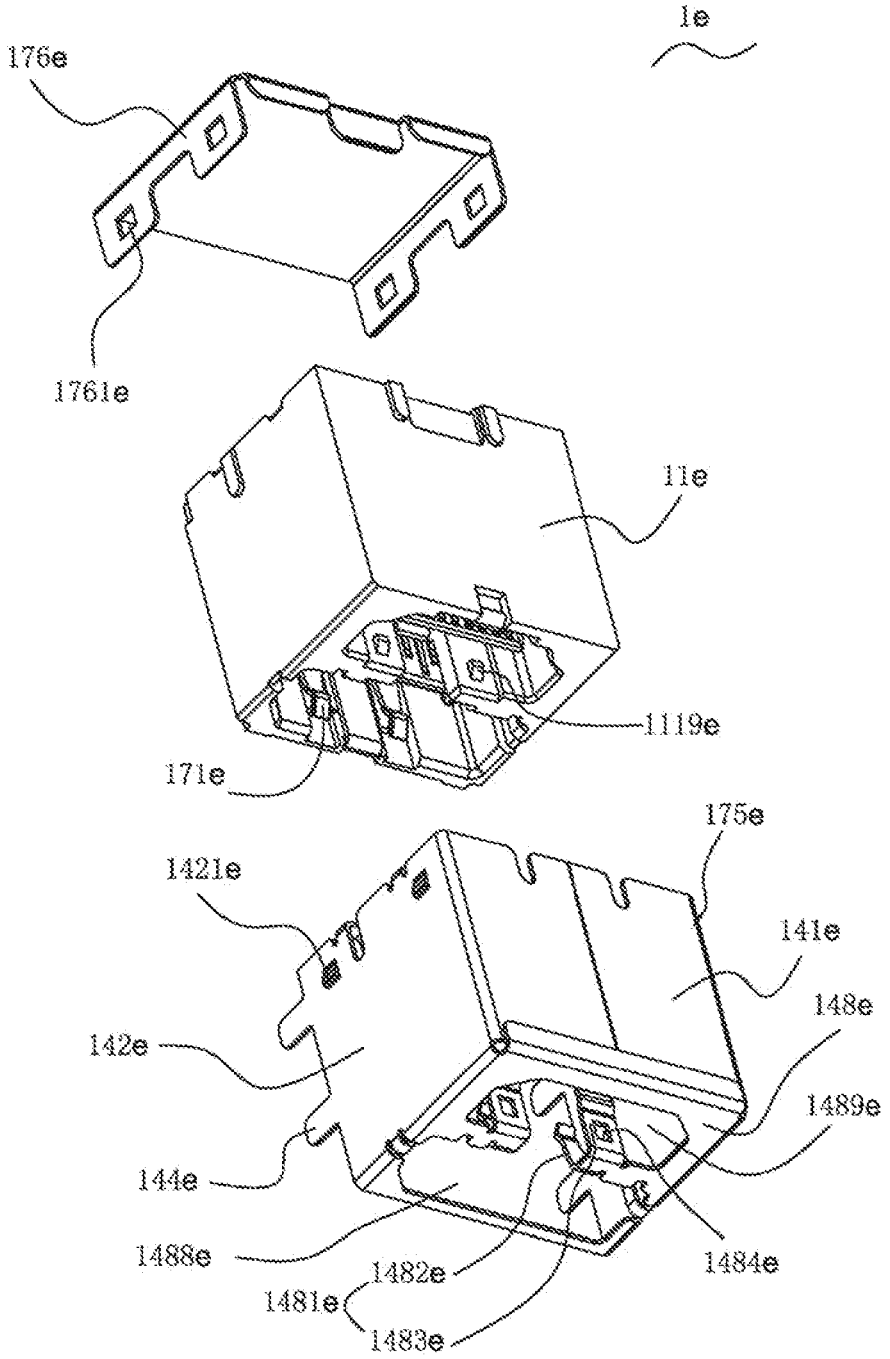
FIG. 50 is an exploded perspective view of a sixth embodiment of a receptacle electrical connector.

As shown in FIG. 50, the first cage 14*e* is formed by pressing a metal plate and formed by a front shielding element 175*e* and a rear shielding element 175*e* clasped with each other. The first cage 14*e* is mounted on the periphery of the first body 11*e* and encloses the first tongue 112*e*, the second tongue 113*e* and the third tongue 162*e* of the first body 11*e* to achieve electromagnetic shielding. The first cage 14*e* comprises a top plate 141*e*, two side plates 142*e* bending and extending downward from left and right sides of the top plate 141*e*, a front plate 148*e* connected to the front ends of the two side plates 142*e*; and four fixing foots 144*e* protruding downwardly from the two side plates 142. The two side plates 142 are provided with a buckle portion 1421*e* on its rear end for buckling on the buckle portion 1761*e* of the rear shielding element 176*e*. The front plate 148*e* is provided with a first opening 1488*e* and a third opening 1489*e* which are communicated with each other and corresponding with the first receiving chamber 145*e* and the third receiving chamber 164*e* respectively. The middle of the front plate 148*e* is provided with two U-shaped portions 1481*e* extending toward the inner of the first and third receiving chambers 145*e* and 164*e*. Each of the U-shaped portions 1481*e* has two flexible clasp arms 1482*e*, 1483*e* extending inwardly in a direction of from front to rear from the top of the first receiving chamber 145*e* and the bottom of the third receiving chamber 164*e* respectively. Each side plate 142*e* is provided with two flexible clasp arm 1425*e* extending and bending inwardly in a direction of from front to rear from the first opening 1488*e* at the side of the first receiving chamber 145*e*. Those flexible clasp arms 1712*e*, 1482*e*, 1483*e*, 1425*e* can be clasped on the different sides and positions in different depths of the plug electrical connector in the first receiving chamber 145*e*/the third receiving chamber 164*e* to improve the engaging strength.

The first retention element 15*e* is mated with the soldering portions of the first terminals 12*e*, the second terminals 13*e* and the fifth terminals 167*e*, so as to prevent the terminals from bending and shorting out.

Figure 52:
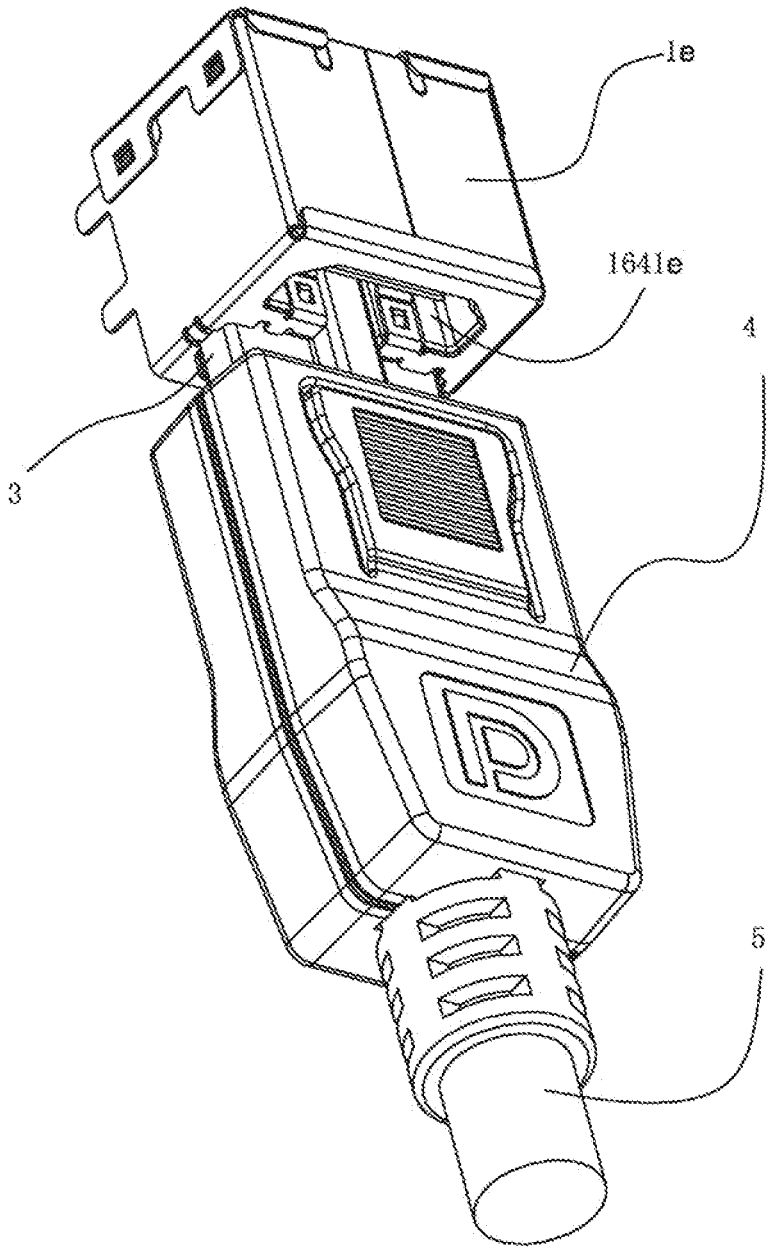
FIG. 52 is a perspective view showing a sixth embodiment of a receptacle electrical connector mating with a first cable connector, and wherein a plug electrical connector in accordance with a first embodiment is provided in a front of the first cable connector.
Figure 53:
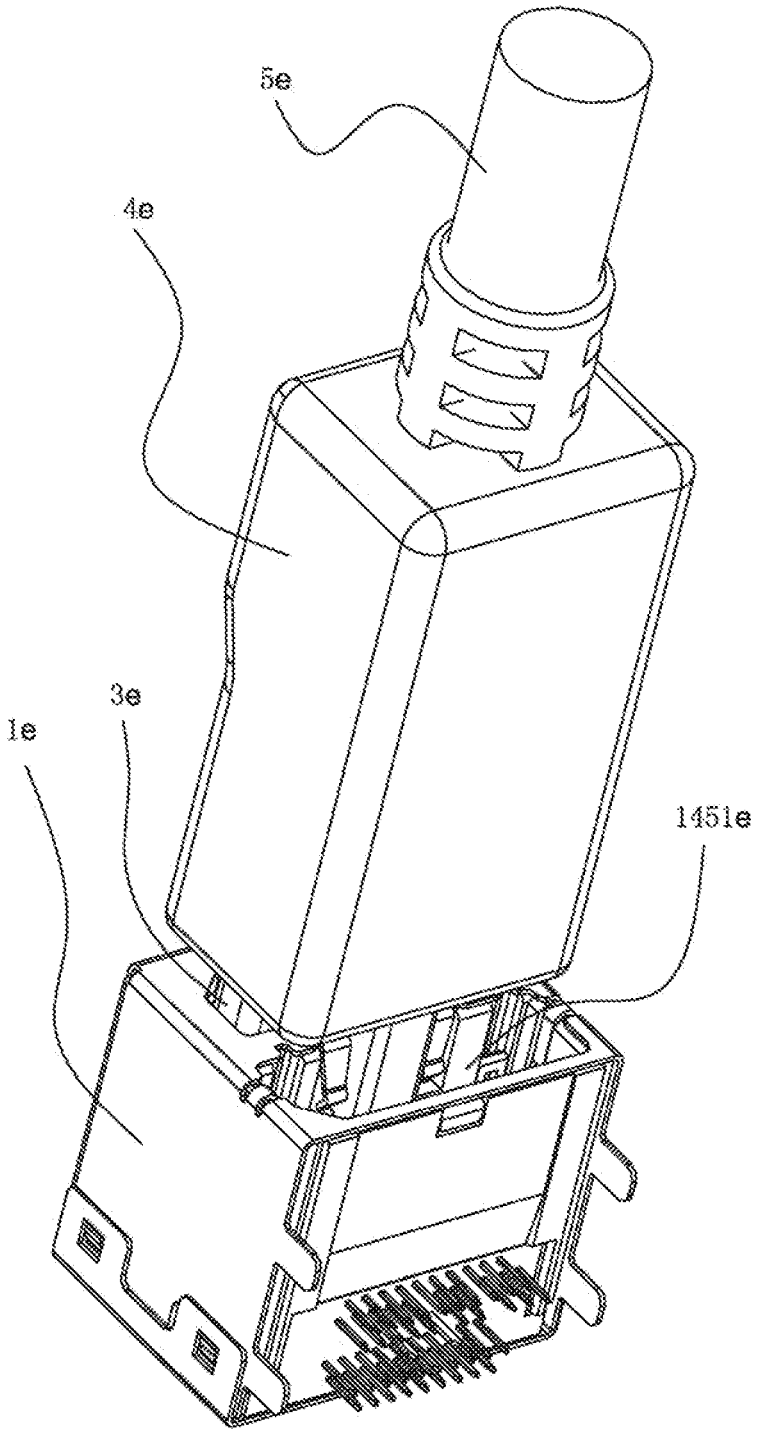
FIG. 53 is a perspective view showing a sixth embodiment of a receptacle electrical connector mating with a second cable connector, and wherein a plug electrical connector in accordance with a second embodiment is provided in a front of the second cable connector.
Figure 56:
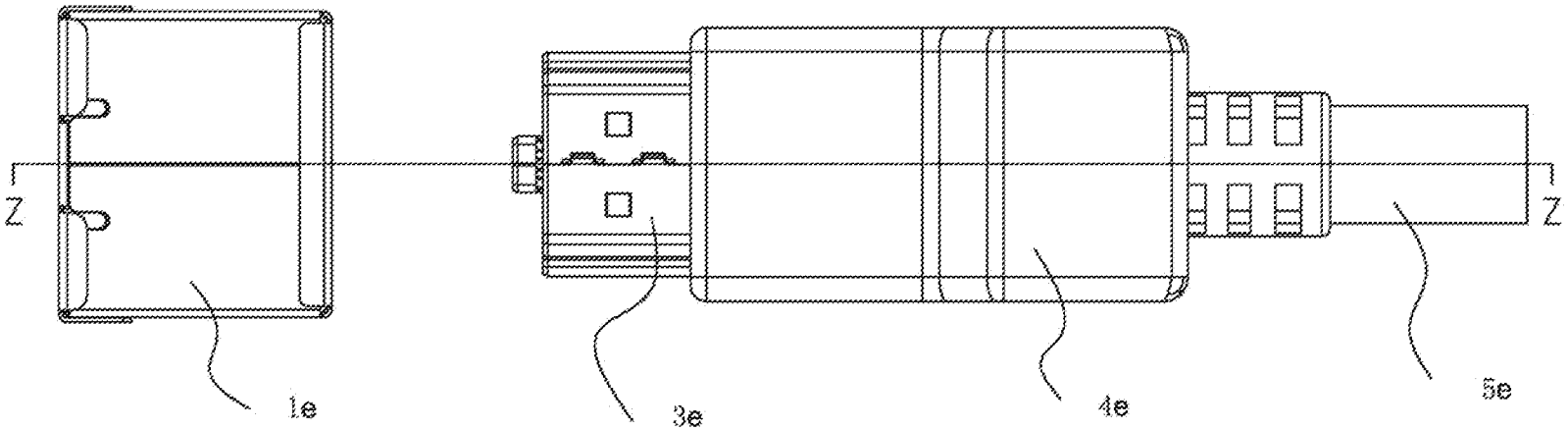
FIG. 56 is an exploded perspective view showing a sixth embodiment of a receptacle electrical connector and a second cable connector.
Figure 57:
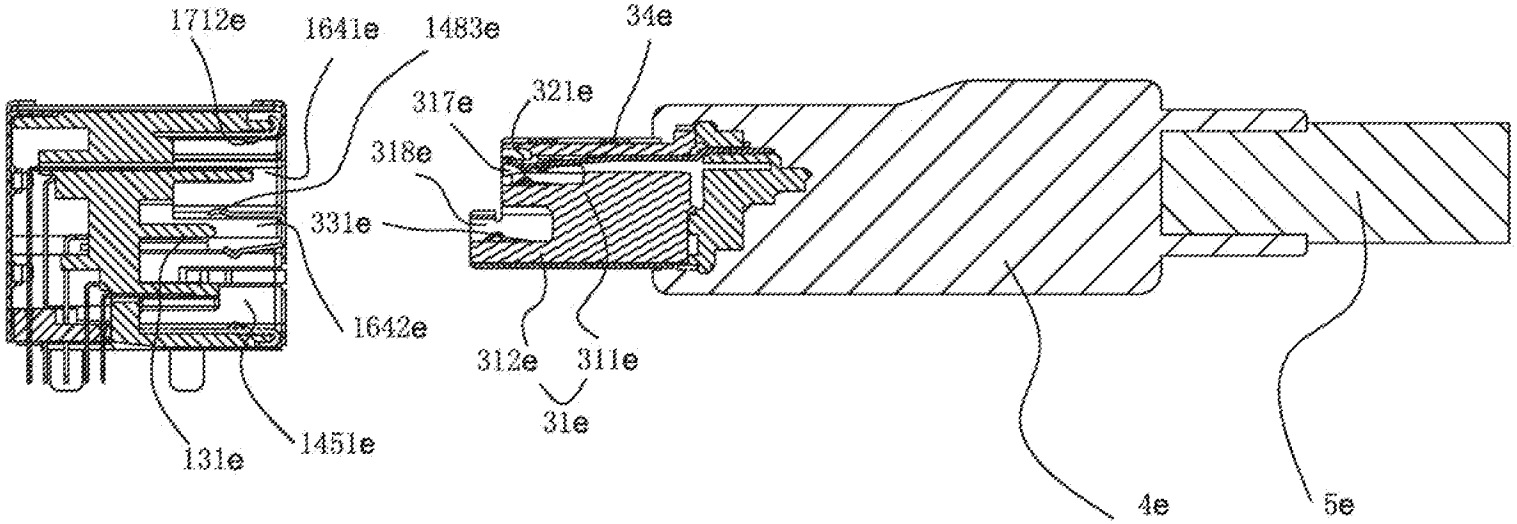
FIG. 57 is a sectional view in a Z-Z direction in FIG. 56.
Figure 58:
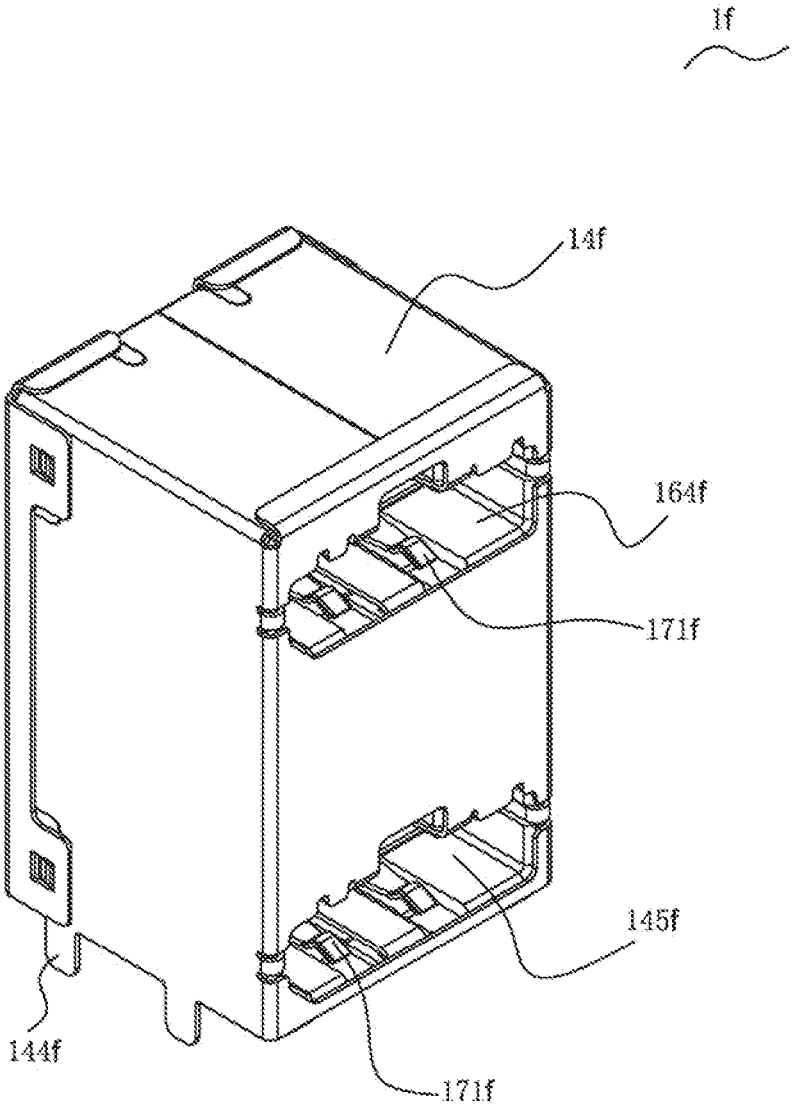
FIG. 58 is a perspective view of a seventh embodiment of a receptacle electrical connector.

As shown in FIG. 52, the first cable connector with power supply and satisfied the DP signal transmission standard can be inserted into the first receiving chamber 145*e* of the receptacle electrical connector 1*e*. The first cable connector comprises a first plug electrical connector 3 (i.e. the plug electrical connector in the first embodiment), an insulated housing 4 and a cable 5 connected with the first plug electrical connector 3. At this time, the fifth mating chamber 1461*e* in the third receiving chamber 164*e* is available and the sixth mating chamber 1462 is occupied.

As shown in FIGS. 53-57, the second cable connector with power supply and satisfied the HDMI signal transmission standard can be inserted into the third receiving chamber 164*e* of the receptacle electrical connector 1*e*. The second cable connector comprises a second plug electrical connector 3*e* (i.e. the plug electrical connector in the second embodiment), an insulated housing 4*e* and a cable 5*e* connected with the second plug electrical connector 3*e*. At this time, the first mating chamber 1451*e* in the first receiving chamber 145*e* is available and the second mating chamber 1452*e* is occupied.

The second plug electrical connector 3*e* comprises a second body 31*e*, a plurality of third terminals 32*e* mounted on the second body 31*e* and two fourth terminals 33*e* for transmitting power and a second cage 34*e*.

The second body 31*e* comprises a second main body portion 311*e* and a second protrusion 312*e* protruding from the top of the second main body portion 311*e*. The second main body portion 311*e* is provided with a third mating chamber 317*e* at its middle. The third mating chamber 317*e* is provided with a plurality of third receiving slots 3111*e* on its upper and lower sides, and the second protrusion 312*e* is provided with two fourth receiving slots 3124*e* on its lower surface.

A plurality of third terminals 32*e* are arranged into the plurality of third receiving slots 3111*e* respectively. Each of third terminals 32*e* comprises a mating portion 321*e* and a soldering portion (not shown in FIGs). The mating portions 321*e* are elastic protrusions. The mating portions 321*e* of the third terminals 32*e* located on the upper side of the third mating chamber 317*e* are offset relative to those on the lower side of the third mating chamber 317*e*.

Two fourth terminals 33*e* for transmitting power are arranged into two fourth receiving slots 3124*e* respectively. Each of the fourth terminals 33*e* comprises a mating portion 331*e* and a soldering portion (not shown in FIGs). The mating portions 331*e* are elastic protrusions.

The second cage 34*e* encloses the periphery of the second body 31*e* and is formed with a fourth mating chamber 318*e* together with the second protrusion 312*e*. The mating portions 331*e* of the fourth terminals 33*e* are protruded downwardly toward the fourth mating chamber 318*e* from the fourth receiving slots 3124*e*. The front edge of the fourth mating chamber 318*e* is protruded forwardly relative to the front edge of the third mating chamber 317*e* (please see FIGS. 54 and 56), such that the fourth mating chamber 318*e* can be mated with the second tongue 113*e* located at a deeper position in the receptacle electrical connector 1*e*.

The fourth cage 34*e* elastically abuts against the flexible clasp arms 1712*e* of the elastic clasp element 171*e* and the flexible clasp arm 1483*e* of the U-shaped portion 1481*e* of the first cage 14*e*, and the mating portions of the third terminals 32*e* and the fourth terminals 33*e* elastically abut against the mating portions 13*e* of the fifth terminals 167*e* and the second terminals 13*e*, when the second cable connector is inserted into the third receiving chamber 164*e* in the receptacle electrical connector 1*e*.

The assembly procedure of the receptacle electrical connector 1*e* is as follows: inserting the first terminals 12*e*, the second terminals 13*e* and the fifth terminals 167*e* into the first body 11*e* in a direction of from rear to front; and aligning the first retention element 15*e* with the soldering portions of those terminals 12*e*, 13*e*, 167*e* and inserting the first retention element 15*e* in a direction of from lower to upper; inserting the two holding portions 172*e* into the first body 11*e* in a direction of from rear to front, and then inserting the two elastic elements 171*e* into the first body 11*e* in a direction of from front to rear; and finally mounting the front shielding element 175*e* and the rear shielding element 176*e* into the first body 11*e*.

As compared with the conventional connector, the receptacle electrical connector 1*e* and the plug electrical connector 3*e* (the second embodiment of the plug electrical connector) in accordance with the sixth embodiment has the following advantageous effects: the first receiving chamber 145*e* and the third receiving chamber 164*e* are recessed from the first body 11*e*, and the power supplying portions of the first and second receiving chambers are overlapped, and thusly the receiving chambers as above have an improved strength, are not easily broken and deformed, and the second tongue 113 thereof can provide power to the plug electrical connector with two different kinds of transmission standard. The fourth mating chamber 318*e* can be suitably mated with the second tongue 113*e* located on the relative deep position in the receptacle electrical connector 1*e*, since the front edge of the fourth mating chamber 318*e* is protruded forwardly relative to that of the third mating chamber 317*e*.

Figure 60:
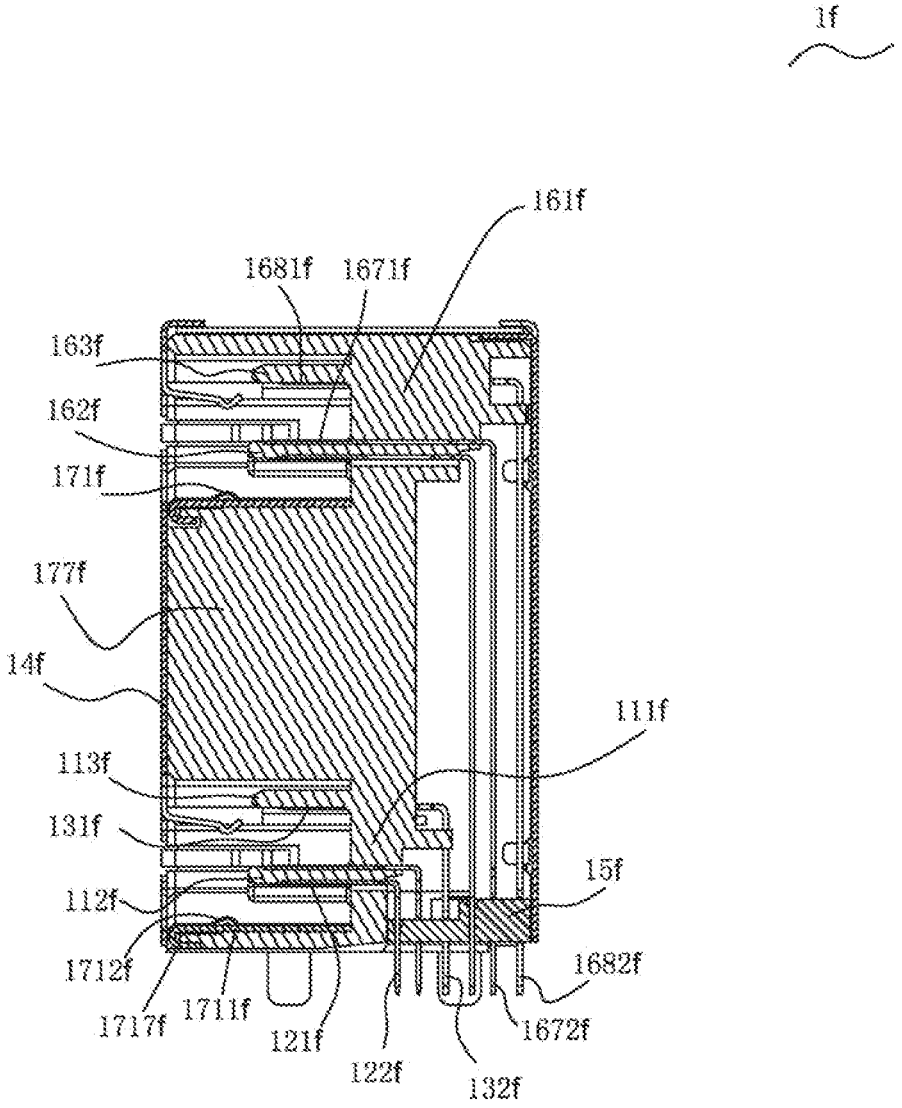
FIG. 60 is a sectional view in an A-A direction in FIG. 59.
Figure 61:
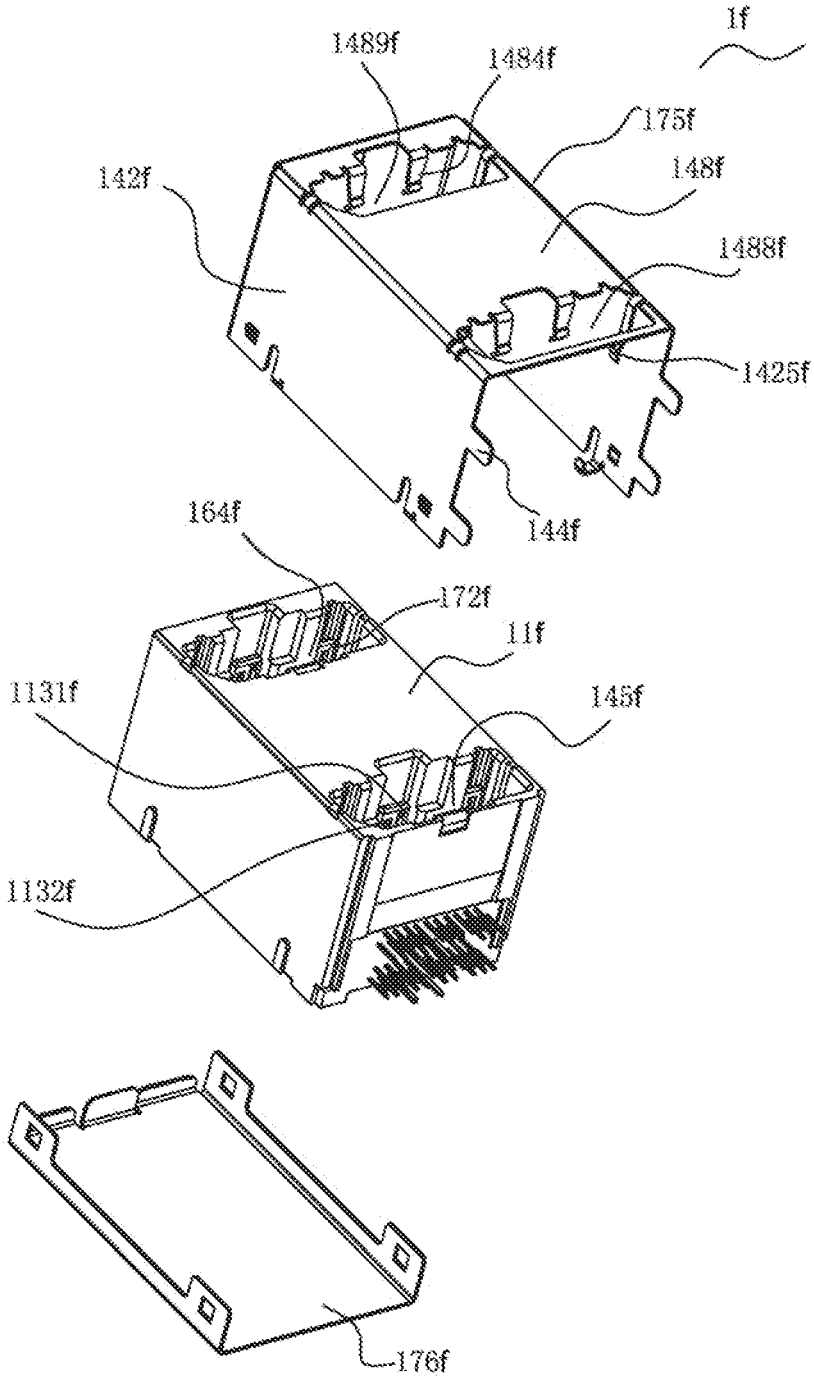
FIG. 61 is an exploded perspective view of a seventh embodiment of a receptacle electrical connector.
Figure 62:
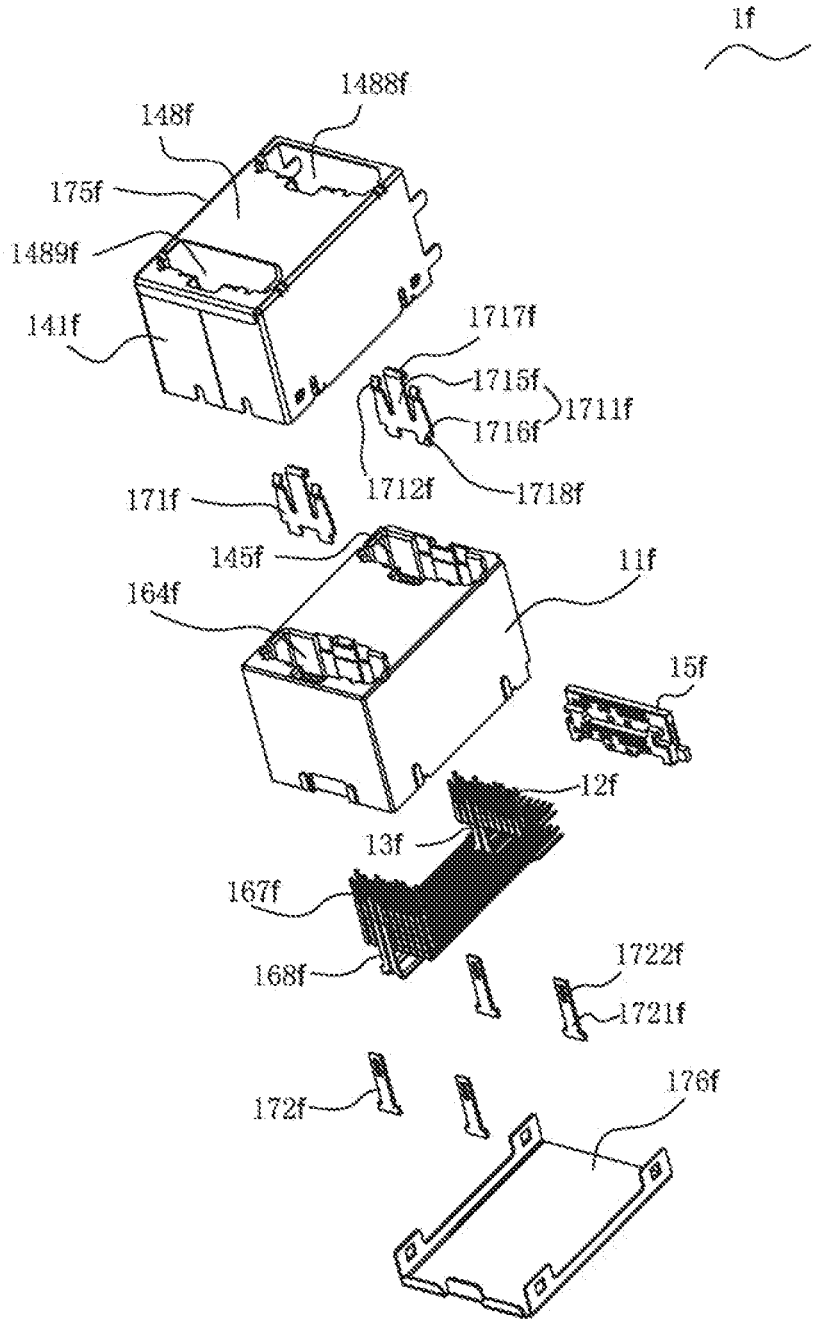
FIG. 62 is a further exploded perspective view of a seventh embodiment of a receptacle electrical connector.

A seventh embodiment of the receptacle electrical connector is shown in FIGS. 58-62 and comprises two stacked HPDP (High Power Display Port) receptacle openings with additional power supply. As shown in FIG. 62, the receptacle electrical connector if comprises a first body 11*f*; a plurality of first terminals 12*f*, two second terminals 13*f*, a plurality of fifth terminals 167*f* and two sixth terminals 168*f* mounted on the first body 11*f*; two elastic clasp elements 171*f* and four holding portions 172*f* mounted on the first body 11*f*; a first cage 14*f* mounted on the first body 11*f*; and a first retention element 15*f* mounted on a bottom of the rear end of the first body 11*f*.

As shown in FIG. 60, the first body 11*f* comprises a first main body portion 111*f*; a first tongue 112*f* and a second tongue 113*f* extending forward from the first main body

111*f*; a third main body portion 161*f* extending upwardly from the first main body portion 111*f* (in the other embodiment, the third main body portion may horizontally extend or downwardly extend from the first main body portion); a third tongue 162*f* and a fourth tong 163*f* extending forwardly from the third main body portion 161*f*; and a spacer portion 177*f* located between the first main body portion 111*f* and the third main body portion 161*f*.

Figure 59:
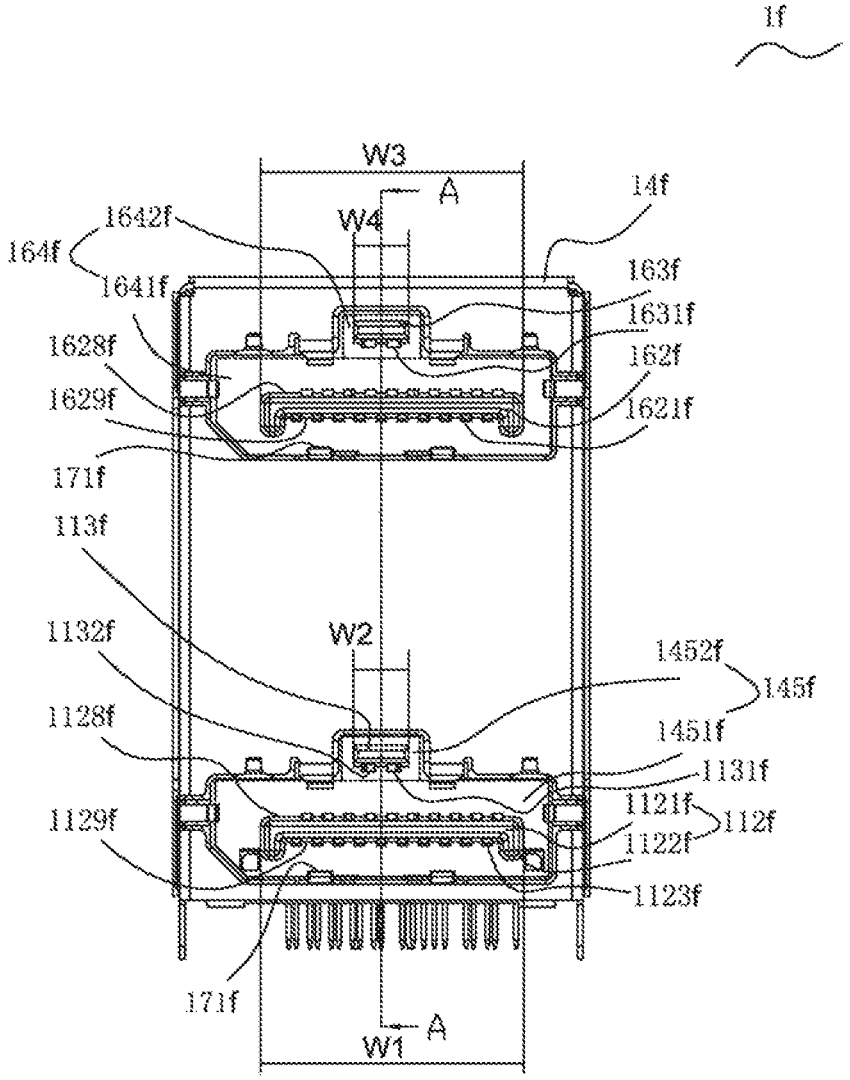
FIG. 59 is a front view of a seventh embodiment of a receptacle electrical connector.

Please also see FIG. 59, the first body 11*f* is provided with a first receiving chamber 145*e* recessed therein. The first receiving chamber 145*f* (HPDP interface) has a shape with a small upper portion and a large lower portion, and comprises a first mating chamber 1451*f* and a second mating chamber 1452*f* stacked and communicated with each other in an upper and lower direction. The first tongue 112*f* is located within the first mating chamber 1451*f* in which a standard DP (Display Port) is inserted. The first tongue 112*f* comprises a base 1121*f* in a plate shape and two keying ribs 1122*f* protruding downwardly from left and right side edges of the base 1121*f* respectively. The second tongue 113*f* is located within the second mating chamber 1452*f*. The second mating chamber 1452*f* is located above the first mating chamber 1451*f* and has a much smaller width than that of the first mating chamber 1451*f*.

Similarly, the first body 11*f* is provided with a third receiving chamber 164*f* recessed therein. The third receiving chamber 164*f* (also is HPDP interface) has an shape with a small upper portion and a large lower portion, and comprises a fifth mating chamber 1641*f* and a sixth mating chamber 1642*f* stacked and communicated with each other in an upper and lower direction. The third tongue 162*f* is located within the fifth mating chamber 1641*f* in which a standard DP plug can be inserted. The fourth tongue 163*f* is located within the sixth mating chamber 1642*f*. The sixth mating chamber 1642*f* is located above the fifth mating chamber 1641*f*, and has a much smaller width than that of the fifth mating chamber 1641*f*. The third receiving chamber 164*f* is separated from the first receiving chamber 145*f* by the spacer portion 177*f*.

The base 1121*f* of the first tongue 112*f* comprises a first surface 1128*f* and a second surface 1129*f* opposite with each other. The first surface 1128*f* is configured to face upward and the second surface 1129*f* is configured to face downward. Each of the first and second surfaces 1128*f* and 1129*f* is provided with a plurality of first receiving slots 1123*f*.

The first and second tongue 112*f* and 113*f* are configured to be parallel with each other and arranged in an upper and lower relationship. The first tongue 112*f* has a width W1 larger than that W2 of the second tongue 113*f*. Two second receiving slots 1131*f*, 1132*f* are provided in the lower surface of the second tongue 113*f*.

Similarly to the first and second tongues 112*f* and 113*f*, the third tongue 162*f* also comprises a first surface 1628*f* and a second surface 1629*f* opposite with each other. Each of the first and second surfaces 1628*f* and 1629*f* is provided with a plurality of fifth receiving slots 1621*f*. The third tongue 162*f* can be mated with a standard DP type plug electrical connector.

The fourth and third tongue 163*f* and 162*f* are configured to be parallel with each other and arranged in an upper and lower relationship. The third tongue 162*f* has a width W3 larger than that W4 of the fourth tongue 163*f*. Two sixth receiving slots 1631*f* are provided in the lower surface of the fourth tongue 163*f*.

Each of the first terminals 12*f* has a mating portion 121*f* in a plate shape and a soldering portion 122*f*. The mating portions 121*f* of the first terminals 12*f* are received in first receiving slots 1123*f* of the first tongue 112*f*, for transmitting high definition video signals. The mating portions 121*f* of the first terminals 12*f* located on the upper surface 1128*f* of the first tongue 112*f* are offset relative to those on the lower surface 1129*f* of the first tongue 112*f*, that is, the mating portions 121*f* in an upper row are not faced or aligned with those in a lower row.

Referring to FIGS. 61 and 62, each of the second terminals 13*f* comprises a mating portion 131*f* in a plate shape and a soldering portion 132*f*. One second terminal 13*f* received in one second receiving slot 1131*f* is used to connect with the negative pole of the power source, and the other second terminal 13*f* received into the other second receiving slot 1132*f* is used to connect with the positive pole of the power source. A distal of the mating portion 131*f* of the one second terminals 13*f* connected to the negative pole of the power source is located at a position closer to the front of the second tongue 113*f*, compared with a distal of the mating portion 131*f* of the other second terminals 13*f* connected to the positive pole of the power source. The two second terminals 13*f* are used to transmit the power required by the display device, so as to save one separate power cable of the display device. In addition, the distance between the two soldering portions 132*f* is larger than that between the two mating portions 131*f* of the two second terminals 13*f*.

As shown in FIG. 60, each of the fifth terminals 167*f* has the similar structure and function as compared with the first terminals 12*f*, and comprises a mating portion 1671*f* in a plate shape and a soldering portion 1672*f*. The mating portions 1671*f* of the fifth terminals 167*f* are received in the fifth receiving slots 1621*f* of the third tongue 162*f*, for transmitting high definition video signals. The mating portions 1671*f* of the first terminals 167*f* located on the upper surface 1628*f* of the third tongue 162*f* are offset relative to those on the lower surface 1629*f* of the third tongue 162*f* in an upper and lower direction, that is, the mating portions 1671*f* in an upper row are not faced or aligned with those in a lower row.

Each of the sixth terminals 168*f* has the similar structure and function as compared with the second terminals 13*f*, and comprises a mating portion 1681*f* in a plate shape and a soldering portion 1682*f*. One second terminal 168*f* is used to connect with the negative pole of the power source, and the other second terminal 168*f* is used to connect with the positive pole of the power source. A distal of the mating portion 1681*f* of the one sixth terminals 168*f* connected to the negative pole of the power source is located on a position closer to the front of the fourth tongue 163*f*, compared with a distal of the mating portion 1681*f* of the other sixth terminals 168*f* connected to the positive pole of the power source.

Referring to FIGS. 60 and 62, the two elastic clasp elements 171*f* are mounted on the bottoms of the first receiving chamber 145*f* and third receiving chamber 164*f* respectively. Each of the elastic clasp elements 171*f* has a mounting portion 1711*f* and two flexible clasp arms 1712*f* mounted on the first body 11*f*. In details, the mounting portion 1711*f* comprises a locking unit 1715*f* and two clasping units 1716*f*. The front end of the locking unit 1715*f* has a hook 1717*f* for clasping the first body 11*f*, and the rear end of the clasping units 1716*f* are provided with a clasping portion 1718*f* for being inserted into the first body 11*f*.

Referring to FIGS. 61 and 62, two holding portions 172*f* are mounted on the top of the first mating chamber 1451*f* in the first receiving chamber 145*f*, and two holding portions 172*f* are mounted on the top of the fifth mating chamber 1641*f* in the third receiving chamber 164*f*. Rear end of each holding portion 172*f* is provided with a holding portion 1721*f* for being fixed onto the first body 11*f*, and front end of each holding portion 172*f* is provided with a holding hole 1722*f* for fitting with the hooks (not shown in FIGs) in the mating electrical connector.

Referring to FIGS. 61 and 62, the first cage 14*f* is formed by pressing a metal plate and formed by a front shielding element 175*f* and a rear shielding element 176*f* clasped with each other. The front shielding element 175*f* comprises a top plate 141*f*, two side plates 142*f* bending and extending downward from left and right sides of the top plate 141*f*, a front plate 148*f* connected to the front ends of the top plate 141*f* and the two side plates 142*f*; and four fixing foots 144*f* protruding downwardly from the two side plates 142*f*. The front plate 148*f* is provided with a first opening 1488*f* and a second opening 1489*f* corresponding with the first receiving chamber 145*f* and the third receiving chamber 164*f* respectively. The front plate 148*f* is provided with two flexible clasp arms 1484*f* extending inwardly in a direction of from front to rear at the tops of the first receiving chamber 145*f* and the third receiving chamber 164*f* respectively. Each of two side plates 142*f* is provided with a flexible clasp arm 1425*f* extending and bending inwardly in a direction of from front to rear from the first opening 1488*f* at the side of the first receiving chamber 145*f*. The first cage 14*f* encloses the first tongue 112*f*, the second tongue 113*f*, the third tongue 162*f* and the fourth tongue 163*f* to achieve electromagnetic shielding.

Those flexible clasp arms 1712*f*, 1484*f*, 1425*f* can be clasped on the different sides and positions in different depths of the plug electrical connector in the first receiving chamber 145*f*/the third receiving chamber 164*f* to improve the engaging strength.

The first retention element 15*f* is mated with the first terminals 12*f*, the second terminals 13*f*, the fifth terminals 167*f* and the sixth terminals 168*f*, so as to prevent the soldering portions of the terminals from bending.

The assembly procedure of the receptacle electrical connector if is as follows: inserting the first terminals 12*f*, the second terminals 13*f*, the fifth terminals 167*f* and the sixth terminals 168*f* into the first body 11*f* in a direction of from rear to front; and aligning the first retention element 15*f* with the soldering portions of those terminals and inserting the first retention element 15*f* in a direction of from lower to upper; inserting the four holding portions 172*f* into the first body 11*f* in a direction of from rear to front, and then inserting the two elastic elements 171*f* into the first body 11*f* in a direction of from rear to front; and finally mounting the front shielding element 175*f* and the rear shielding element 176*f* into the first body 11*f*.

It should be noted that although one receptacle electrical connector 1 is provided with two HPDP receptacle openings in the above embodiment, the receptacle electrical connector 1 may be provided with one or three or more than three HPDP receptacle openings.

Figure 63:
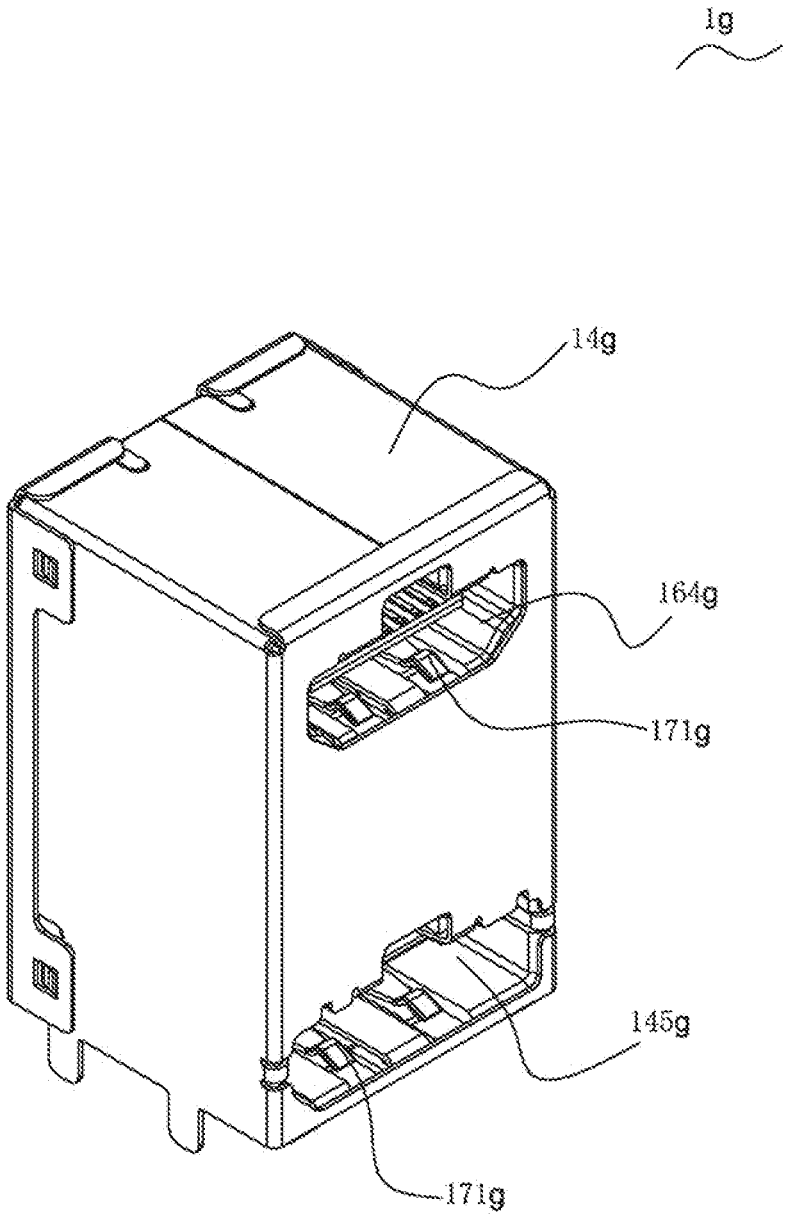
FIG. 63 is a perspective view of an eighth embodiment of a receptacle electrical connector.
Figure 64:
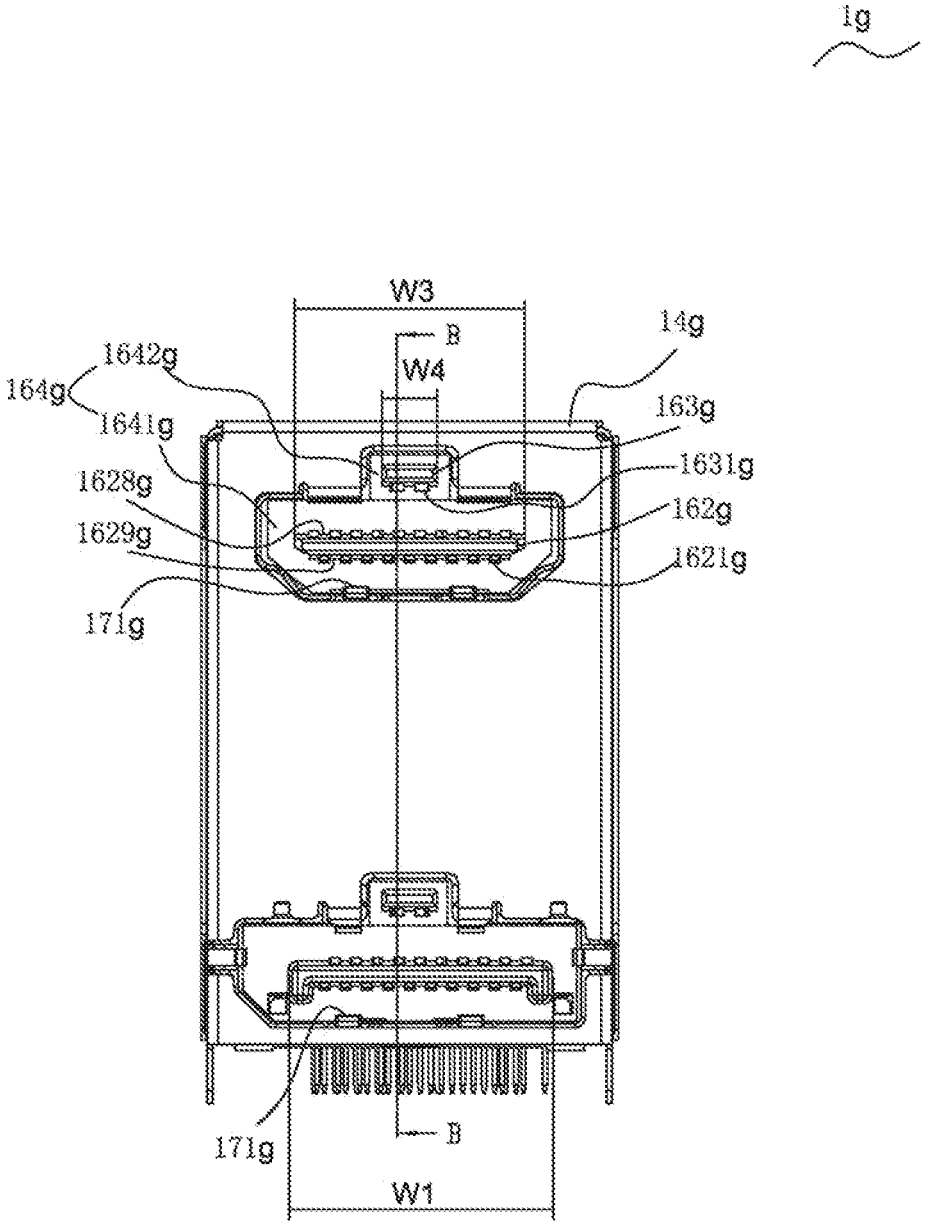
FIG. 64 is a front view of an eighth embodiment of a receptacle electrical connector.
Figure 65:
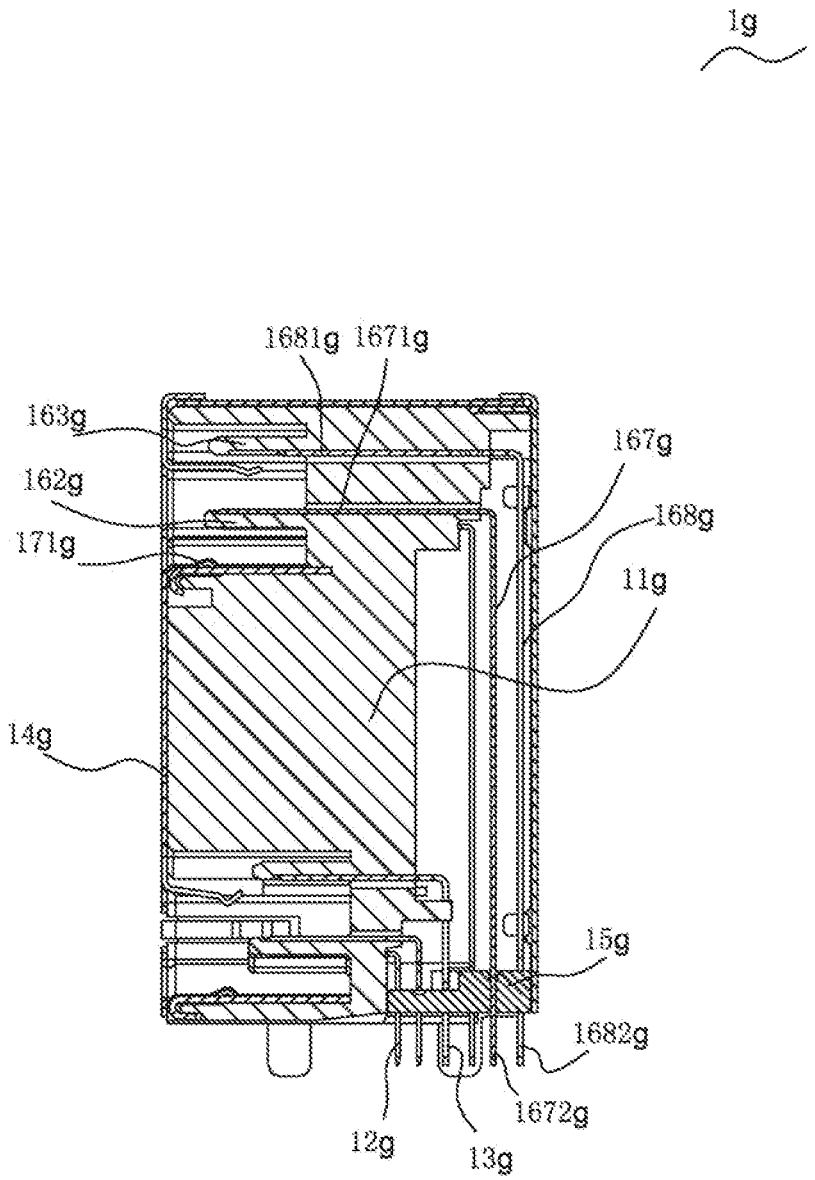
FIG. 65 is a sectional view in a B-B direction in FIG. 64.

An eighth embodiment of the receptacle electrical connector 1*g* as shown in FIGS. 63-65 and comprises a first body 11*g*; a plurality of first terminals 12*g*, two second terminals 13*g*, a plurality of fifth terminals 167*g* and two sixth terminals 168*g* mounted on the first body 11*g*; two elastic clasp elements 171*g* and two holding elements mounted on the first body 11*g*; a first cage 14*g* covering the first body 11*g*; and a first retention element 15*g* mounted on a bottom of the rear end of the first body 11*g*.

The structure of the receptacle electrical connector 1*g* is generally similar to that of the above seventh embodiment except that there is an HDMI receptacle opening (corresponding to the third receiving chamber 164*g*) with additional power supply on the upper of the receptacle electrical connector 1*g*. The structure of the HPDP receptacle opening (corresponding to the first receiving chamber 145*g*) on the lower of the receptacle electrical connector 1*g* is the same as that mentioned in the above embodiment, and thusly the description thereof is omitted.

Figure 66:
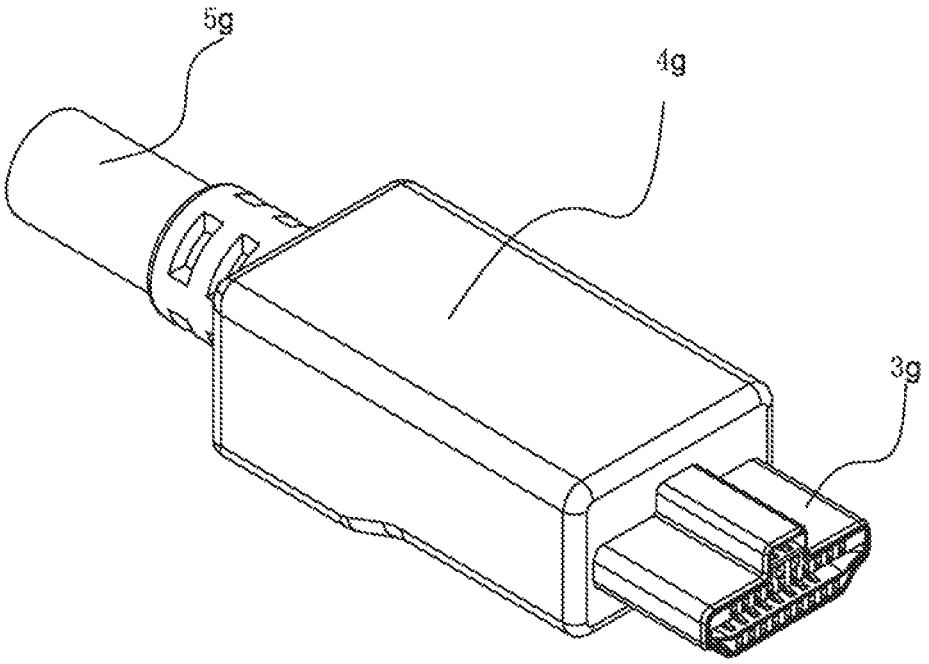
FIG. 66 is a perspective view of a third cable connector adapted to mate with a third receiving slot in an eighth embodiment of a receptacle electrical connector, and wherein, a plug electrical connector in accordance with a third embodiment is provided in a front of the third cable connector.

As shown in FIG. 64, the first body 11*g* is provided with a third receiving chamber 164*g* recessed therein. The third receiving chamber 164*g* has a shape with a small upper portion and a large lower portion, for receiving a third cable connector with an additional power supply and satisfied with the HDMI transport protocols (as shown in FIG. 66). The third receiving chamber 164*g* comprises a fifth mating chamber 1641*g* and a sixth mating chamber 1642*g* stacked and communicated with each other in an upper and lower direction. The third tongue 162*g* is located within the fifth mating chamber 1641*g* in which a standard HDMI type plug can be inserted. The fourth tongue 163*g* is located within the sixth mating chamber 1642*g*. The sixth mating chamber 1642*g* is located above the fifth mating chamber 1641*g*, and has a much smaller width than that of the fifth mating chamber 1641*g*. The third tongue 162*g* also comprises a first surface 1628*g* and a second surface 1629*g* opposite with each other. The first surface 1628*g* is configured to face upward and the second surface 1629*g* is configured to face downward. Each of the first and second surfaces 1628*g* and 1629*g* is provided with a plurality of fifth receiving slots 1621*g*. The third tongue 162*g* can be mated with a standard HDMI type plug electrical connector.

The fourth and third tongue 163*g* and 162*g* are configured to be parallel with each other and arranged in an upper and lower relationship. The third tongue 162*g* has a width W3 larger than that W4 of the fourth tongue 163*g*. Two sixth receiving slots 1631*g* are provided in the lower surface of the fourth tongue 163*g*.

Each of the fifth terminals 167*g* comprises a mating portion 1671*g* in a plate shape and a soldering portion 1672*g*. The mating portions 1671*g* of the fifth terminals 167*g* are received in the fifth receiving slots 1621*g* of the third tongue 162*g* in accordance with the HDMI interface standard, for transmitting high definition video signals. The mating portions 1671*g* of the first terminals 167*g* located on the upper surface 1628*g* of the third tongue 162*g* are offset relative to those on the lower surface 1629*g* of the third tongue 162*g* in an upper and lower direction.

Each of the sixth terminals 168*g* comprises a mating portion 1681*g* in a plate shape and a soldering portion 1682*g*. One second terminal 168*g* is used to connect with the negative pole of the power source, and the other is used to connect with the positive pole of the power source. The two second terminals 168*g* are used to transmit the power required by the display device, so as to save one separate power cable of the display device.

As shown in FIG. 63, the two elastic clasp elements 171*g* identical with the elastic clasp elements 171*f* are mounted on the bottoms of the first receiving chamber 145*g* and third receiving chamber 164*g* respectively.

The assembly procedure of the receptacle electrical connector 1*g* is similar as that of the receptacle electrical connector 1*f*, and the description thereof is omitted.

Figure 67:
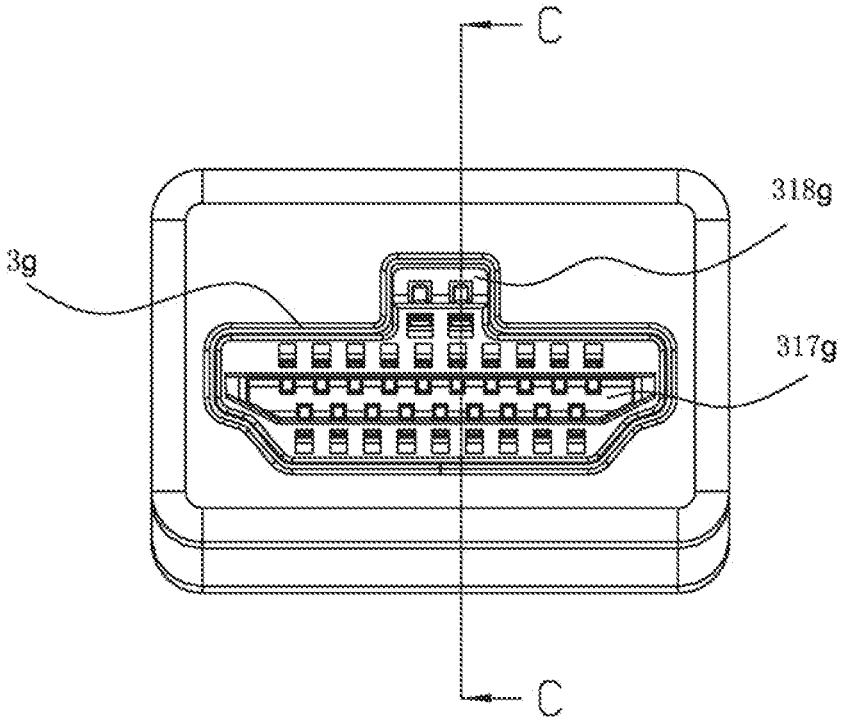
FIG. 67 is a front view of a cable connector shown in FIG. 66.
Figure 68:
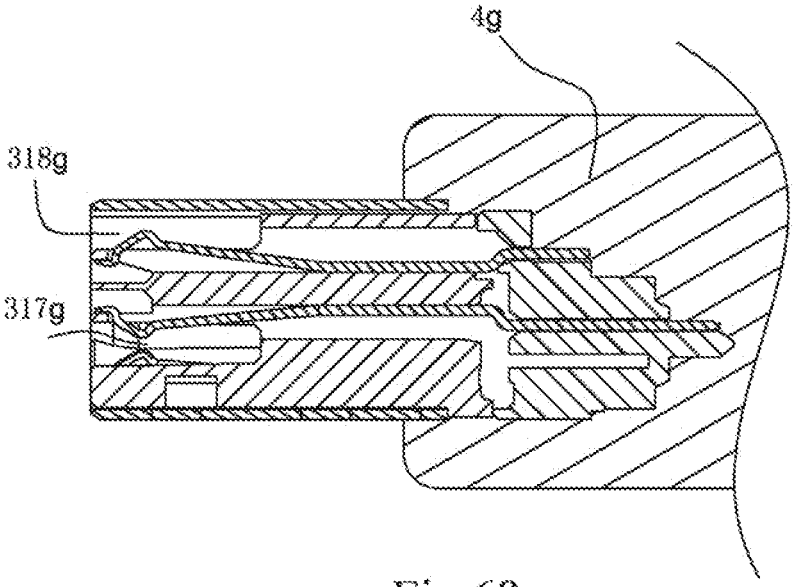
FIG. 68 is a sectional view in a C-C direction in FIG. 67.
Figure 69:
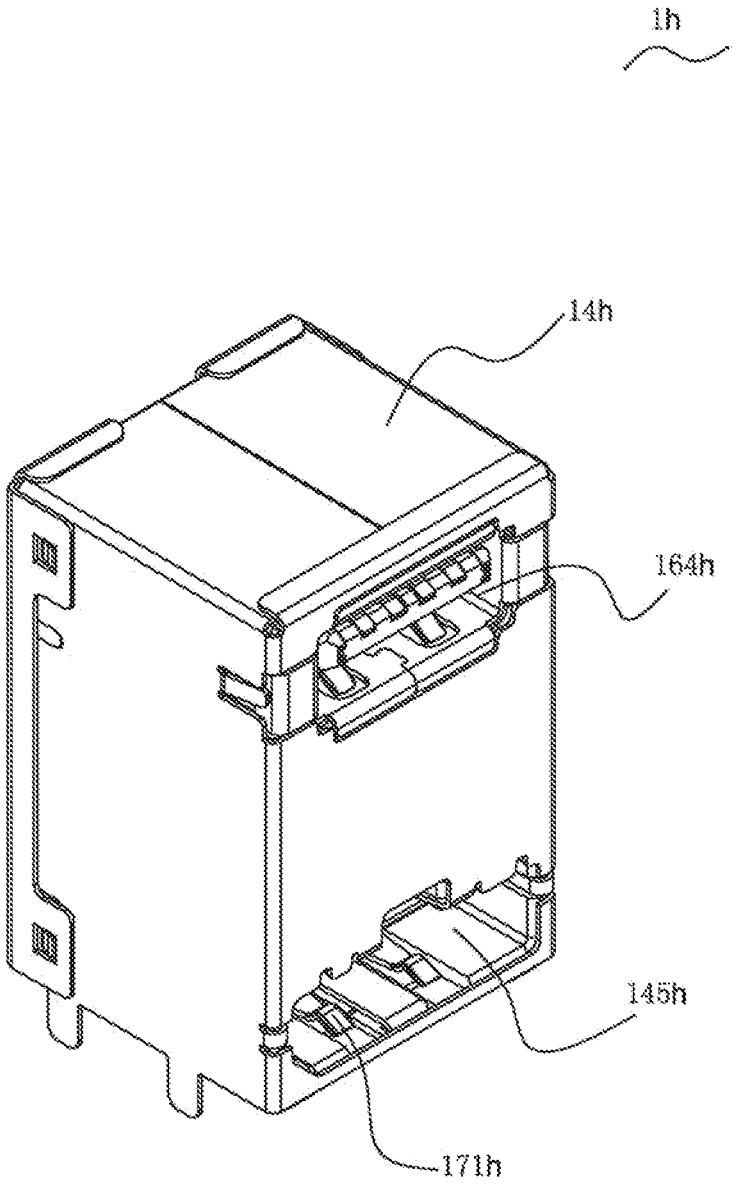
FIG. 69 is a perspective view of a ninth embodiment of a receptacle electrical connector.

Referring to FIGS. 66-68, a third cable connector with an additional power supply is shown. The third cable connector is adapted to mate with the third receiving chamber 164*g* in accordance with the eighth embodiment, and satisfied with the HDMI transport protocols. The third cable connector comprises a plug electrical connector 3*g* (the third embodiment of the plug electrical connector), a cable 5*g* electrically connected with the plug electrical connector 3*g*, and an insulated housing 4*g* covering the periphery of the connection position between the plug electrical connector 3*g* and the cable 5*g*. The mating plug 3*g* has s third mating chamber 317*g* satisfied with the HDMI interface standard and a fourth mating chamber 318*g*. The third tongue 162*g* can be inserted into the third mating chamber 317*g* for transmitting high definition signals satisfied with the HDMI transmitting standard, and the fourth tongue 163*g* can be inserted into the fourth mating chamber 318*g* for transmitting power and satisfied with the power requirement of the display device, when the plug electrical connector 3*g* is mated with the receptacle electrical connector 1*g* of the eighth embodiment.

A ninth embodiment of the receptacle electrical connector 1*h* is shown in FIGS. 69-72 and comprises a first body 11*h*; a plurality of first terminals 12*h*, two second terminals 13*h* and a plurality of fifth terminals 167*h* mounted on the first body 11*h*; an elastic clasp element 171*h*, two holding elements 172*h*, an insulated fixing element 168*h* and a third cage 169*h* mounted on the first body 11*h*; a first cage 14*h* covers the first body 11*h*; and a first retention element 15*h* mounted on a bottom of the rear end of the first body 11*h*.

The structure of the receptacle electrical connector 1*h* is similar as that of the above seventh embodiment of the receptacle electrical connector except that there is a USB 3.0 receptacle opening (corresponding to the third receiving chamber 164*h*) on the upper of the receptacle electrical connector 1*h*. The HPDP receptacle opening (corresponding to the first receiving chamber 145*h*) on the lower of the receptacle electrical connector 1*h* is the same as the HPDP receptacle opening in the seventh embodiment, and the description thereof is omitted.

Figure 70:
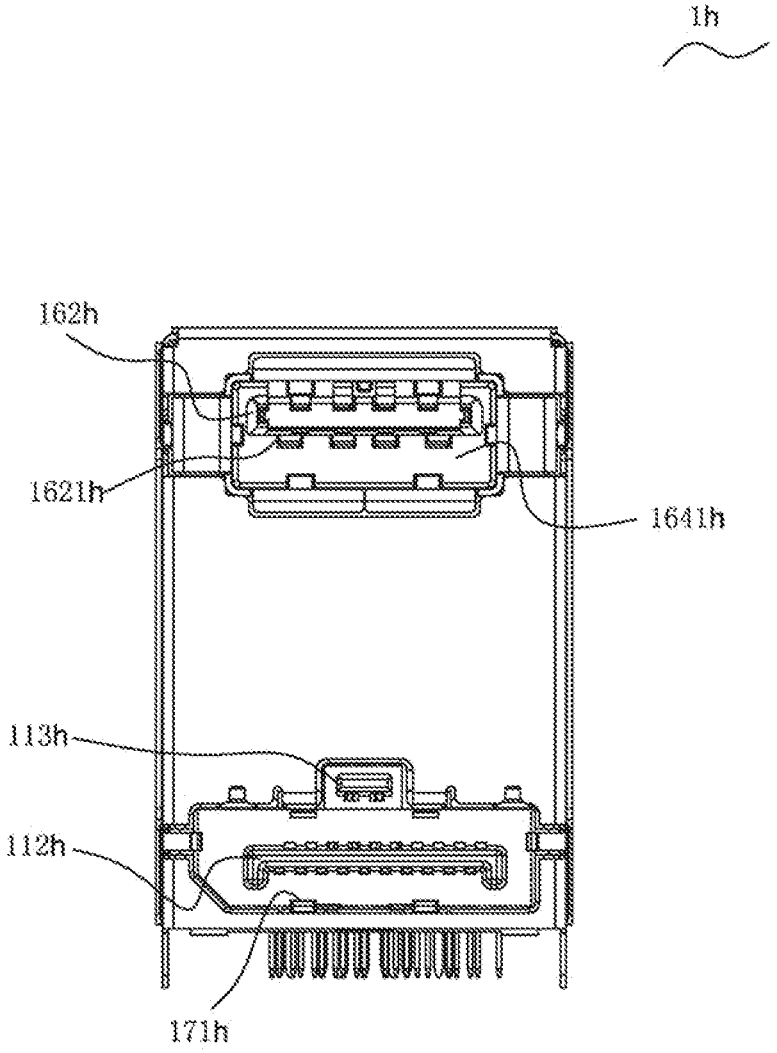
FIG. 70 is a front view of a ninth embodiment of a receptacle electrical connector.
Figure 71:
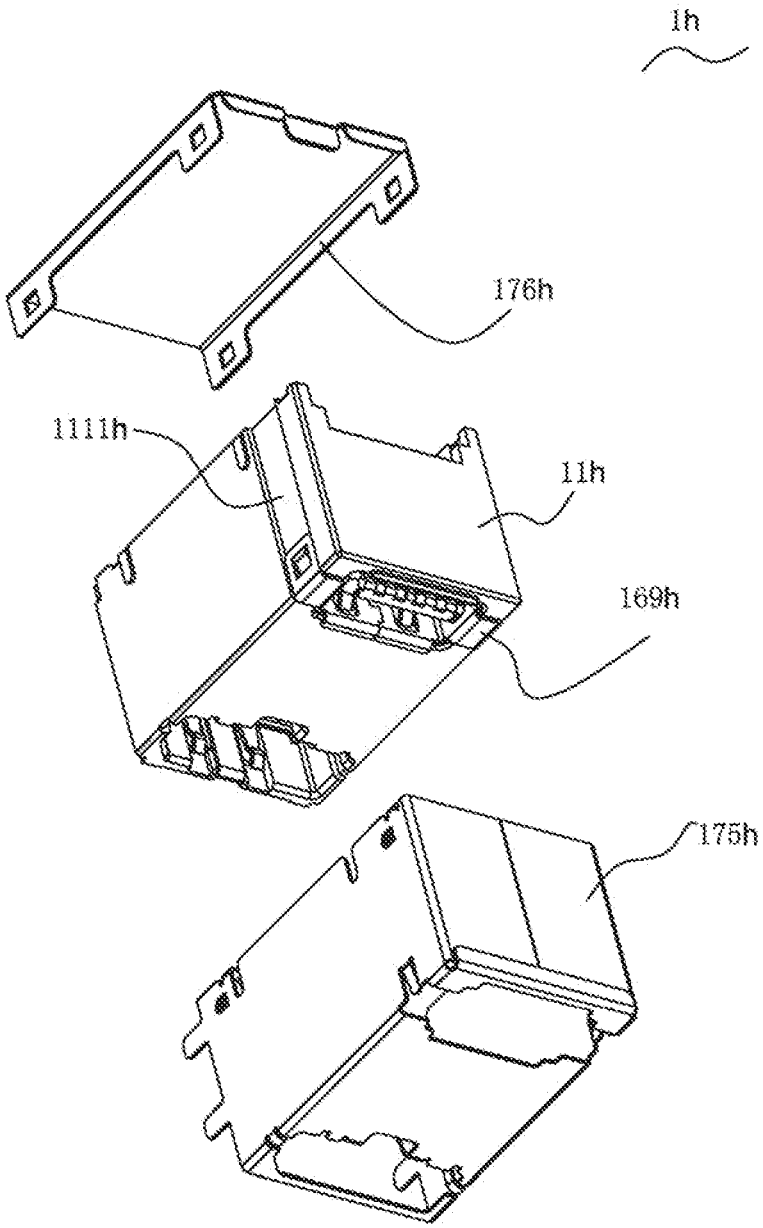
FIG. 71 is an exploded perspective view of a ninth embodiment of a receptacle electrical connector.

As shown in FIG. 70, the first body 11*h* is provided with a third receiving chamber 164*h* recessed therein. The third receiving chamber 164*h* has a rectangle shape and comprises a fifth mating chamber 1641*h* in which the third tongue 162*h* is located. A standard USB 3.0 type plug can be inserted within the fifth mating chamber 1641*h*. A plurality of fifth receiving slots 1621*h* are provided in the third tongue 162*h* which can be mated with a standard USB 3.0 plug electrical connector.

Figure 72:
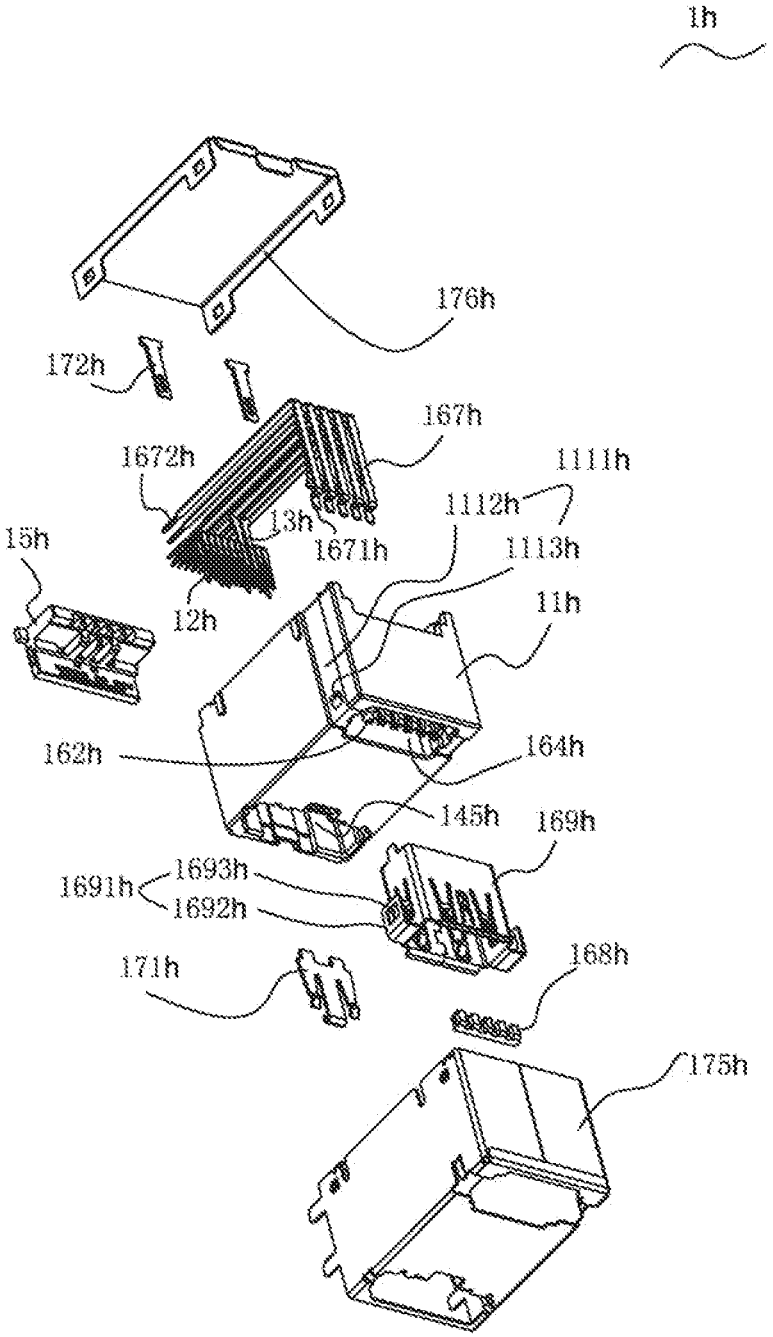
FIG. 72 is a further exploded perspective view of a ninth embodiment of a receptacle electrical connector.

As shown in FIG. 72, the first body 11*h* is formed with a clasp portion 1111*h* on sides near the third receiving chamber 164*h*. In details, each of the clasp portions 1111*h* comprises a groove 1112*h* formed on two sides of the first body 11*h* and a clasping block 1113*h* protruded from the groove 1112*h*.

Each of the fifth terminals 167*h* comprises a mating portion 1671*h* and a soldering portion 1672*h*. The mating portions 1671*h* of the fifth terminals 167*h* are provided in the fifth receiving slots 1621*h* of the third tongue 162*h*. An insulated fixing element 168*h* is mounted on a front end of the third tongue 163*h* to realize the separation between the front and rear rows of fifth terminals 167*h*.

The third cage 169*h* is mounted in the third receiving chamber 164*h*, and has two buckle portions 1691*h* bending outwardly and then bending backwardly from two sides thereof respectively. In details, the buckle portions 1691*h* comprise a buckling arm 1692*h* bending outwardly and backwardly from the sides thereof, and a buckling hole 1693*h* provided in the buckling arm 1692*h*. The buckling arm 1692*h* is corresponding to the grooves 112*h* in the clasp portions 1111*h* of the first body 11*h*, and the buckling hole 1693*h* is mated with the clasping block 1113*h*, when the third cage 169*h* is inserted into the third receiving chamber 164*h*.

The assembly procedure of the receptacle electrical connector 1*h* is as follows: inserting the first terminals 12*h*, the second terminals 13*h* and the fifth terminals 167*h* into the first body 11*h* in a direction of from rear to front, and mounting the insulated fixing element 168*h* in the front end of the third tongue 162*h*; and mounting the third cage 169*h* into the third receiving chamber 164*h* in a direction of from front to rear; aligning the first retention element 15*h* with the soldering portions of those terminals and inserting the first retention element 15*h* in a direction of from lower to upper; inserting the two holding portions 172*h* into the first body 11*h* in a direction of from rear to front, and then inserting the two elastic elements 171*h* into the first body 11*h* in a direction of from front to rear; and finally mounting the front shielding element 175*h* and the rear shielding element 176*h* into the first body 11*h*.

As compared with the conventional connector, the receptacle electrical connectors 1*f*, 1*g*, 1 *h* in accordance with the seventh, eighth and ninth embodiments have the following advantageous effects in addition to the effects in the first embodiment: the first receiving chambers 145*f*, 145*g*, 145*h* are recessed from the first insulated bodies 11*f*, 11*g*, 11*h*, and thusly the receiving chambers formed as above have a improved strength, are not easily broken and deformed. In addition, the third receiving chambers 164*f*, 164*g*, 164*h* are recessed from the first insulated bodies 11*f*, 11*g*, 11 *h*, and thusly two identical or different receptacle openings of the electrical connector can be combined together, so as to increase the function of the connector.

While preferred embodiments of the present application, not for limiting the present invention, are shown and described, it is envisioned that those skilled in the art may easily devise various modifications in accordance with the spirit and scope of the foregoing Description and the appended Claims.

What is claimed is:

1. A connector, comprising:

a first body that includes a first main body portion, a first tongue and a second tongue, the first and second tongues being parallel with each other and extending forward from the first main body portion, wherein the first tongue has a first surface and a second surface opposite the first surface and a first width and the second tongue has a third surface and a second width that is less than the first width, the first tongue including a plurality of first receiving slots provided on the first and second surfaces and a plurality of second receiving slots provided on the third surface;

a plurality of first terminals provided in the first receiving slots, each first terminals being provided with a mating portion in a plate shape and a soldering portion, the mating portions of the first terminals located on a first surface being offset relative to the mating portions on a second surface;

at least two second terminals for transmitting power provided in the plurality of second receiving slots, each second terminals being provided with a mating portion in a plate shape and a soldering portion; and a cage mounted on the first body that forms a first mating chamber and a second mating chamber, the first mating chamber formed around and enclosing the first tongue and having a third width, the second mating chamber formed around and enclosing the second tongue and having a fourth width that is less than the third width, wherein the first and second mating chambers are in communication with each other, wherein two of the plurality of second terminals are configured to be connected to a negative power input and positive power input and wherein an end of the mating portion of the second terminal for connecting with the negative power input is located at a position closer to a front than an end of the mating portion of the second terminal for connecting with the positive power input.

2. The connector according to claim 1, wherein in that the first tongue comprises a base with a plate shape and two keying ribs protruding away from two sides of the base.

3. The connector according to claim 1, wherein each of the second terminals comprises a fixing portion provided between the mating portion and the soldering portion, the soldering portions of the plurality of second terminals are bent and extended away from each other and from ends of the fixing portions such that a distance between the soldering portions is greater than a distance between the mating portions.

4. The connector according to claim 1, wherein the cage encloses the first tongue and the second tongue so as to form a first receiving chamber.

5. The connector according to claim 4, wherein the cage is configured to have an arching portion that forms the second mating chamber and a hole is provided on both sides of the arching portion.

6. The connector according to claim 4, wherein the connector further comprises a first retention element fixed on the first body, the first retention element being provided with a plurality of perforations through which the soldering portions of the plurality of the first terminals and at least two second terminals are inserted.

7. The connector according to claim 4, wherein a clasp portion is provided on the cage, the connector further comprising a first retention element which is provided with a holding portion corresponding to the clasp portion such that the first retention element is fixed in the cage and abutted against the rear end of the first main body portion.

8. The connector according to claim 7, wherein the first retention element includes a base on which a plurality of first perforations for inserting the soldering portion of the first terminals are provided, and further includes a protrusion extending upward from the base, the protrusion including at least two second perforations for inserting the soldering portion of at least two second terminals are provided, the base of the first retention element having an upper and lower surface, each of the upper and lower surfaces of the base having a clasp portion provided thereon.

9. The connector according to claim 7, wherein the first cage comprises a top plate, two opposite side plates and a bottom plate and each of the top plate and the bottom plate are provided with two clasp portions.

10. The connector according to claim 7, wherein the cage is configured to have an arching portion for forming the second mating chamber and a hole is provided on the left and right side of the arching portion respectively and one of the clasp portions is provided at each side of the arching portion.

11. A connector, comprising:

a first body that includes a first main body portion, a first tongue and a second tongue, the first and second tongues being parallel with each other and extending forward from the first main body portion, wherein the first tongue has a first surface and a second surface opposite the first surface and a first width and the second tongue has a third surface and a second width that is less than the first width, the first tongue including a plurality of first receiving slots provided on the first and second surfaces and a plurality of second receiving slots provided on the third surface;

a plurality of first terminals provided in the first receiving slots, each first terminals being provided with a mating portion in a plate shape and a soldering portion, the mating portions of the first terminals located on a first surface being offset relative to the mating portions on a second surface;

at least two second terminals for transmitting power provided in the plurality of second receiving slots, each second terminals being provided with a mating portion in a plate shape and a soldering portion; and a cage mounted on the first body that forms a first mating chamber and a second mating chamber, the first mating chamber formed around and enclosing the first tongue and having a third width, the second mating chamber formed around and enclosing the second tongue and having a fourth width that is less than the third width, wherein the connector further comprises a first retention element fixed on the first body, the first retention element being provided with a plurality of perforations through which the soldering portions of the plurality of the first terminals and at least two second terminals are inserted, wherein the first retention element includes a base on which a plurality of first perforations for inserting the soldering portion of the first terminals are provided, and further includes a protrusion extending upward from the base, the protrusion including at least two second perforations for inserting the soldering portion of at least two second terminals are provided, the base of the first retention element having an upper and lower surface, each of the upper and lower surfaces of the base having a clasp portion provided thereon, and wherein the protrusion comprises a vertical wall extending upward from the rear end of the upper surface of the base, a top plate extending forward from the top end of the vertical wall, and a partition plate extending downward from the bottom of the top plate, and at least one said second perforation is provided at each of the two sides of the partition plate on the vertical wall.

* * * * *